US007440718B2

(12) United States Patent
Hagiwara et al.

(10) Patent No.: US 7,440,718 B2
(45) Date of Patent: Oct. 21, 2008

(54) DEVELOPING APPARATUS FEATURING IMAGE DEFECT SUPRESSION

(75) Inventors: Kazunari Hagiwara, Numazu (JP); Kenya Ogawa, Susono (JP); Shuji Moriya, Sunto-gun (JP); Naoto Kichijima, Mishima (JP); Yasushi Shimizu, Sunto-gun (JP); Koichi Okuda, Katsushika-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 401 days.

(21) Appl. No.: 11/275,729

(22) Filed: Jan. 26, 2006

(65) Prior Publication Data

US 2006/0171745 A1 Aug. 3, 2006

(30) Foreign Application Priority Data

Jan. 28, 2005 (JP) ..... 2005-021757

(51) Int. Cl.
*G03G 15/09* (2006.01)

(52) U.S. Cl. ..... 399/270; 399/274; 399/277

(58) Field of Classification Search ..... 399/53, 399/55, 149, 150, 267, 270, 274, 277
See application file for complete search history.

(56) References Cited

U.S. PATENT DOCUMENTS

| | | | | |
|---|---|---|---|---|
| 4,281,329 | A | 7/1981 | Yano et al. | 346/1.1 |
| 4,292,387 | A | 9/1981 | Kanbe et al. | 430/102 |
| 4,395,476 | A | 7/1983 | Kanbe et al. | 430/102 |
| 4,473,627 | A | 9/1984 | Kanbe et al. | 430/102 |
| 4,766,458 | A * | 8/1988 | Oka et al. | 399/274 |
| 4,913,088 | A | 4/1990 | Kanbe et al. | 118/651 |
| 5,032,485 | A | 7/1991 | Kanbe et al. | 430/120 |
| 5,044,310 | A | 9/1991 | Kanbe et al. | 118/653 |
| 5,096,798 | A | 3/1992 | Kanbe et al. | 430/120 |
| 5,194,359 | A | 3/1993 | Kanbe et al. | 430/120 |
| 5,283,762 | A | 2/1994 | Fujishima | |
| 5,570,166 | A | 10/1996 | Ohzeki et al. | |

(Continued)

FOREIGN PATENT DOCUMENTS

| | | |
|---|---|---|
| JP | 54-43027 | 4/1979 |

(Continued)

*Primary Examiner*—William J Royer
(74) *Attorney, Agent, or Firm*—Fitzpatrick. Cella, Harper & Scinto

(57) ABSTRACT

A developing apparatus having a developing sleeve provided with an elastic layer on its surface, and for developing an electrostatic image formed on an image bearing member with a mono-component magnetic toner having a mean degree of circularity of 0.965 or greater, a magnet provided in the developing sleeve, and a blade for regulating the amount of the developer carried on the developing sleeve satisfies the expressions $|Br|/|B| \geqq 0.5$ and $Nsb/(Bs \times R) \leqq 0.5$, where B (G) is magnetic flux density formed on the surface of the developing sleeve by the magnet at the contact position between the blade and the developing sleeve, Nsb (mm) is the contact width between the blade and the developing sleeve, Br (G) is a component of magnetic flux density B (G) in a direction perpendicular to the surface of the developing sleeve, Bs (rad) is a half value width of the perpendicular component of the magnetic flux density of the nearest one of the magnetic poles of the magnet to the contact position on the surface of the developing sleeve, and R (mm) is the radius of the developing sleeve.

12 Claims, 19 Drawing Sheets

U.S. PATENT DOCUMENTS

| | | | | |
|---|---|---|---|---|
| 5,682,585 | A * | 10/1997 | Yamaguchi et al. | 399/274 |
| 5,708,921 | A | 1/1998 | Yagi et al. | 399/98 |
| 6,229,980 | B1 | 5/2001 | Ogawa et al. | |
| 6,272,306 | B1 | 8/2001 | Saito et al. | |
| 6,463,245 | B1 | 10/2002 | Suwa et al. | |
| 6,630,275 | B2 | 10/2003 | Hiratsuka et al. | |
| 7,031,629 | B2 | 4/2006 | Kawamura et al. | |
| 7,233,758 | B2 * | 6/2007 | Osada et al. | 399/267 |
| 2005/0152718 | A1 | 7/2005 | Osada et al. | |
| 2005/0196201 | A1 | 9/2005 | Hagiwara et al. | |
| 2005/0214031 | A1 | 9/2005 | Hagiwara et al. | |
| 2006/0233572 | A1 | 10/2006 | Ogawa et al. | |

FOREIGN PATENT DOCUMENTS

| | | | |
|---|---|---|---|
| JP | 55-18656 | | 2/1980 |
| JP | 4-15949 | A | 1/1992 |
| JP | 4-49159 | A | 2/1992 |
| JP | 6-289703 | | 10/1994 |
| JP | 8-137257 | A | 5/1996 |
| JP | 10-301396 | | 11/1998 |
| JP | 10-307455 | | 11/1998 |
| JP | 2001-92201 | | 4/2001 |
| JP | 2001-183872 | | 7/2001 |
| JP | 2001-235899 | | 8/2001 |
| JP | 3225759 | | 8/2001 |
| JP | 2002-341590 | A | 11/2002 |

* cited by examiner

DEVELOPING APPARATUS FEATURING IMAGE DEFECT SUPRESSION

BACKGROUND OF THE INVENTION

1. Field of the Invention

The invention relates to a developing apparatus for developing an image on an image bearing member with a developer, and more particularly to a developing apparatus of a mono-component developing type in which a developer carrying member contacts with an image bearing member to thereby effect development with a mono-component developer.

This developing apparatus is preferably used as developing means for an image bearing member such as an electrophotographic photosensitive member or an electrostatic recording dielectric member in a process cartridge or an image forming apparatus such as a copying machine or a printer.

2. Related Background Art

For example, in an electrophotographic image forming apparatus, as a conventional mono-component developing method of developing an electrostatic latent image formed on an electrophotographic photosensitive member as a member to be developed (image bearing member with a mono-component developer), use is widely made of (1) a nonmagnetic contact developing method and (2) a magnetic non-contact developing method, as will hereinafter be described.

(1) Nonmagnetic Contact Developing Method

There has been proposed a method of carrying a nonmagnetic developer on a developing roller (developer carrying member) having a dielectric material layer and bringing the developing roller into contact with the surface of a photosensitive member to thereby effect development (Japanese Patent Application Laid-open No. 2001-92201).

A developer in a developing apparatus (hereinafter referred to as the developing device) is supplied to a developing roller by a mechanical agitating mechanism or gravity. An elastic roller for contacting with the developing roller is provided, and the carrying and supply of the developer are effected by the elastic roller. This elastic roller also performs the function of once removing any developer not transferred to the photosensitive member, but residual on the developing roller, with a view to uniformize the developer on the developing roller. A DC bias is applied between a base material of the photosensitive member and the developing roller.

(2) Magnetic Non-contact Developing Method

This method uses a magnetic mono-component developer, carries the developer on a developing sleeve (developer carrying member) including a magnet (magnetic field generating means) therein, opposes the developing sleeve to the photosensitive member with a predetermined minute gap provided from the surface of the developing sleeve, and develops an image on the photosensitive member with the developer flying in the gap (Japanese Patent Application Laid-open No. S54-43027 and Japanese Patent Application Laid-open No. S55-18656).

The developer in the developing device is carried to the developing sleeve by a mechanical agitating mechanism or gravity and also, the developer receives a constant magnetic force by the magnet and is supplied to the developing sleeve. Then, a constant developer layer is formed on the developing sleeve by regulating means for regulating a developer amount, and is used for development. A force exerted on the developer by the magnet is positively used not only for the carrying of the developer, but also in a developing portion. In the developing portion, the developer is prevented from shifting a non-image portion to thereby cause the occurrence of a faulty image such as fog. This is because during development, the developer receives a magnetic force toward the magnet included in the developing sleeve. For the flying of the developer, use is made of a bias comprising an AC bias superimposed upon a DC bias. The DC bias voltage is adjusted to a value between an image portion potential and non-image portion potential of the photosensitive member. Further, an AC voltage is superimposed, and the developer effects reciprocal movement relative to the image portion and the non-image portion, whereby the image portion is developed with the developer.

(3) Cleaner-less (Toner Recycle) System

From the viewpoints of the simplification of the apparatus construction and the elimination of waste, there has been proposed an electrophotographic process of disusing an exclusive drum cleaner which is surface cleaning means after the transferring step from the photosensitive member in an image forming apparatus of a transfer type, and recycling the developer in the apparatus. There has been proposed, for example, an image forming apparatus which uses the aforedescribed nonmagnetic contact developing method to collect any developer untransferred during development simultaneously with the development (Japanese Patent No. 2598131).

There has also been proposed an image forming apparatus which uses the aforedescribed magnetic non-contact developing method to collect any developer untransferred during development simultaneously with the development (Japanese Patent Application Laid-open No. H10-307455).

In the nonmagnetic contact developing method of item (1) above, a reduction in fog performance has been a problem. The characteristic of the developer (hereinafter referred to as toner) is reduced while the mechanical stripping-off by the elastic roller is repeated, and fog is sometimes aggravated by a reduction in the frictional charging characteristic or the like of the toner. The fog refers to a faulty image appearing like a ground stain by the toner being slightly used for development in a blank portion (unexposed portion) which is originally not printed. For the prevention of the reduction in the characteristic of the toner, it is also possible to weaken the frictionally contacting force of the elastic roller, but the compatibility thereof with the fault of a ghost image is difficult. Here, the ghost image is a phenomenon that the hysteresis of a toner amount used for development in the last revolution of the developing roller appears as uneven density in a uniform halftone image with the phase difference of the outer periphery of the developing roller in the next and subsequent revolutions. Also, the presence of a ghost image means that there is some toner not stripped off, but residual on the developing roller.

That is, the toner continuously receives the frictional contact by the elastic roller and therefore, this is not preferable also from the viewpoint of the reduction in the characteristic of the toner. The adjustment of the frictionally contacting force has a problem not only being contrary from the viewpoints of the fog and the ghost image, but also contrary in the single matter of fog.

Also, there has arisen the problem that when the characteristic of the toner is reduced, the toner is liable to be affected by the circulation thereof in the developing device. Specifically, in the mechanical circulation or the circulation using gravity, there is formed particularly an area in which the toner hardly changes places around the developing roller and is not circulated. On the other hand, the toner being circulated suffers from a constant reduction in the characteristic thereof. If such two kinds of toners are mixed together when the toner in a container has decreased, compaction or the like has been caused and this has led to the problem of fog or the like. Further, there is the problem of a faulty image attributable to the elastic roller itself. As the elastic roller, from the viewpoint of the performance of stripping off and supplying the toner, use is made of a roller in the form of a sponge, and the developer is compressed and forms compact clusters in the cells of this sponge, and when these come off from the sponge and appear to the surface thereof, an image defect occurs particularly in the halftone. Also, in a combination with the cleaner-less method, paper dust goes into the elastic roller to thereby cause the image defect of the cycle of the elastic roller.

On the other hand, in the magnetic non-contact developing method of item (2) above, there is the image fault by a magnetic brush. There is the problem that the uniformity of a thin line differs between length and width. When the magnetic brush develops while moving in parallelism to the direction of movement of the photosensitive member (photosensitive drum), the uniformity of the thin line is good and becomes liable to break in a direction orthogonal thereto. Also, an image edge fault is caused. The edge of a high density portion, and particularly the process downstream side thereof is developed darkly, and a halftone portion adjacent to the high density portion is developed lightly. The factor for this is expected to reside in developing while reciprocally moving the developer in non-contact by an AC electric field. In the developing portion, the toner is moved toward the surface, and the toner stagnates particularly downstream of the edge portion and conversely, the toner is drawn near from the outside of the edge to thereby cause the image fault as described above. Further, the image forming apparatus adopting the cleaner-less system is low in the capability of collecting the toner on the photosensitive drum, because of non-contact, and suffers from the problem that the untransferred toner becomes a ghost image and appears in solid white and the halftone. Also, white dots occur in solid black. These white dots are liable to occur when under a high-temperature and high-humidity environment paper dust goes mixed between the developing roller and the photosensitive drum. This is expected to be because bias leak has occurred between the developing roller and the photosensitive drum with a result that the potential of a latent image on the photosensitive drum has risen (to the negative).

SUMMARY OF THE INVENTION

It is an object of the present invention to provide a developing apparatus which suppresses an image fault.

It is another object of the present invention to provide a developing apparatus which prevents fog.

It is another object of the present invention to provide a developing apparatus which prevents the occurrence of a ghost image.

It is another object of the present invention to provide a developing apparatus which prevents uneven density.

It is another object of the present invention to provide a developing apparatus which improves the uniformity of a thin line.

It is another object of the present invention to provide a developing apparatus which prevents the edge of an image from becoming dark or light.

DESCRIPTION OF THE PREFERRED EMBODIMENTS

Example 1 of Image Forming Apparatus

Figure 1:
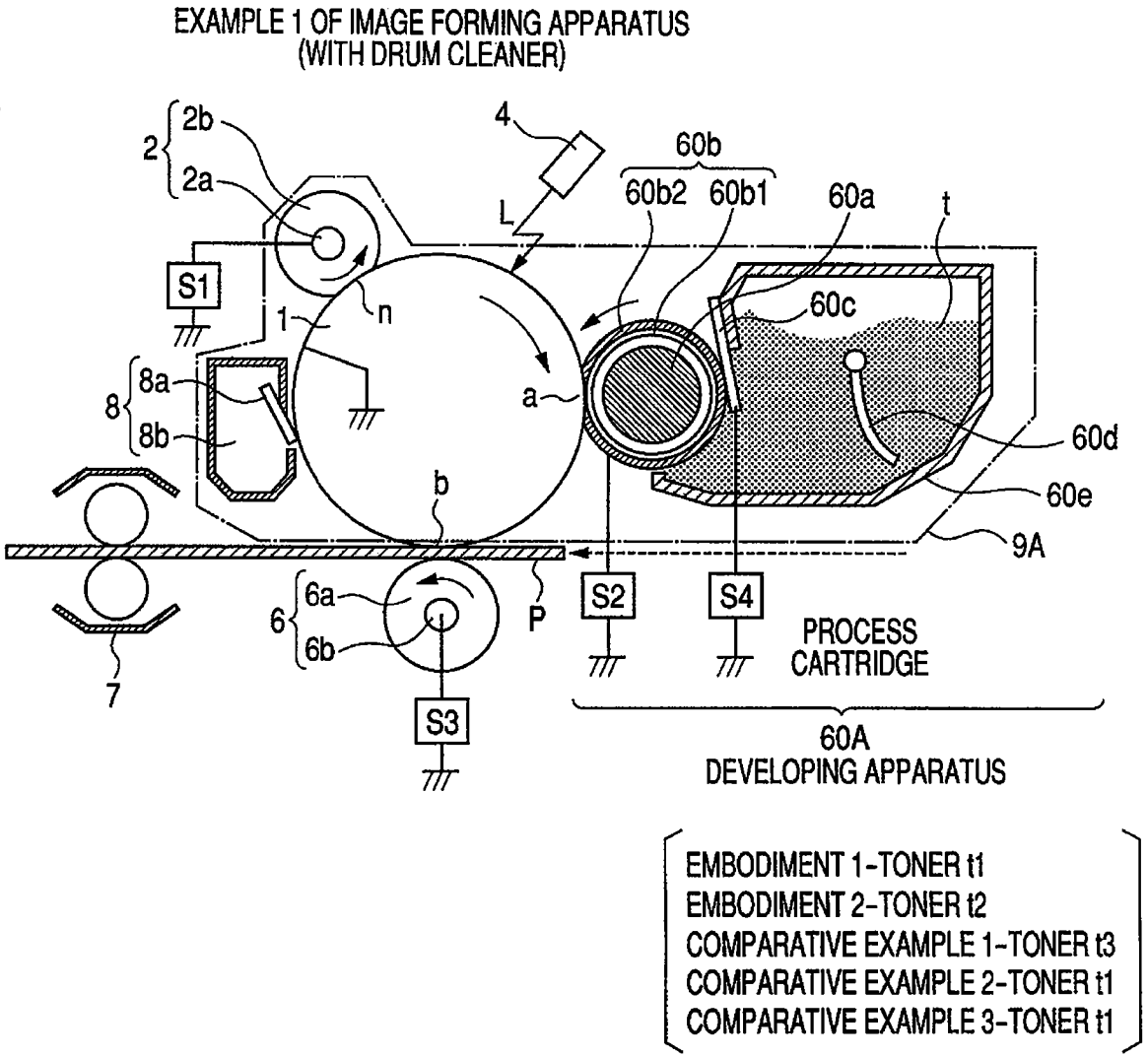
FIG. 1 is a schematic view of Example 1 of an image forming apparatus using Embodiment 1 of the present invention.

FIG. 1 schematically shows the construction of a first example of an image recording apparatus (image forming apparatus) using a developing apparatus according to the present invention. This image recording apparatus is a laser printer utilizing a transfer type electrophotographic process.

(1) General Schematic Construction of the Image Recording Apparatus

The process numeral 1 designates an image bearing member as a member to be developed. In the present example, it is a rotatable drum-shaped negative polarity OPC photosensitive member (negative photosensitive member, hereinafter referred to as the photosensitive drum) having a diameter of 24 mm. This photosensitive drum 1 is rotatively driven at a constant speed of peripheral speed 85 mm/sec. (=process speed PS, printing speed) in the clockwise direction indicated by the arrow.

The reference numeral 2 denotes a charging roller as charging means for the photosensitive drum 1. This charging roller 2 is an electrically conductive elastic roller, and the reference character 2*a* designates a mandrel, and the reference character 2*b* denotes an electrically conductive elastic layer. This charging roller 2 is brought into pressure contact with the photosensitive drum 1 with a predetermined pressure force to thereby form a charging portion "n" between itself and the photosensitive drum 1. In the present example, this charging roller 2 is driven to rotate by the rotation of the photosensitive drum 1.

S1 designates a charging voltage source for applying a charging bias to the charging roller 2. In the present example, a DC voltage equal to or greater than a discharge starting voltage is applied from this charging voltage source S1 between the photosensitive drum 1 and the charging roller 2. Specifically, a DC voltage of −1300 V is applied as a charging bias to thereby uniformly contact-charge the surface of the photosensitive drum 1 to a charging potential (dark section potential) of −700 V.

The reference numeral 4 denotes a laser beam scanner (exposing apparatus) including a laser diode, a polygon mirror, and the like. This laser beam scanner 4 outputs a laser beam intensity-modulated correspondingly to the time-series electrical digital pixel signal of desired image information, and subjects the uniformly charged surface of the rotatable photosensitive drum 1 to scanning exposure L by the laser beam. Laser power is adjusted so that the potential of the surface of the photosensitive drum 1 may be −150 V when the uniformly charged surface of the photosensitive drum 1 is generally exposed to the laser beam. By this scanning exposure L, an electrostatic latent image corresponding to the desired image information is formed on the surface of the rotatable photosensitive drum 1.

60A designates a developing apparatus (developing device) according to Embodiment 1 which will be described later. A toner "t" as a developer bears predetermined frictional charge, and visualizes the electrostatic latent image on the photosensitive drum 1 in a developing area "a" by a developing bias applied between a developing sleeve 60*b* as a developer carrying member (toner carrying member) an the photosensitive drum 1 by a developing bias applying voltage source S2. The developing apparatus 60A will be described in detail in each embodiment and each comparative example which will be described later.

The reference numeral 6 denotes a transfer roller of medium resistance as contact-transferring means, which is brought into pressure contact with the photosensitive drum 1 with a predetermined pressure force to thereby form a transfer nip portion "b". A transfer material P as a recording material is fed to this transfer nip portion "b" at predetermined timing from a sheet feeding portion (not shown) and a predetermined transfer bias voltage is applied from a transfer bias applying voltage source S3 to the transfer roller 6, whereby a toner image on the photosensitive drum 1 is sequentially transferred to the surface of the transfer material P fed to the transfer nip potion "b".

The transfer roller 6 used in the present example is one of a roller resistance value $5\times10^8\Omega$ having a medium resistance foamed layer 6*b* formed on a mandrel 6*a*, and a voltage of +2.0 kV was applied to the mandrel 6*a* to thereby effect transfer. The transfer material P introduced into the transfer nip portion "b" is nipped by and conveyed through this transfer nip portion "b", and the toner image formed and borne on the surface of the rotatable photosensitive drum 1 is sequentially transferred to the surface of the transfer material P by an electrostatic force and a pressure force.

The reference numeral 7 designates a fixing apparatus of a heat fixing type or the like. The transfer material P fed to the transfer nip portion "b" and having received the transfer of the toner image from the photosensitive drum 1 is separated from the surface of the photosensitive drum 1 and is introduced into the fixing apparatus 7, whereby it is subjected to the fixing of the toner image, and is discharged out of the apparatus as an image-formed matter (a print or a copy).

The reference numeral 8 denotes a drum cleaner (a photosensitive drum cleaning apparatus) which scrapes off any untransferred toner residual on the photosensitive drum 1 by a cleaning blade 8*a* and collects it into a waste toner container 8*b*.

Then, the photosensitive drum 1 is charged again by the charging roller 2 and is repetitively used for image formation.

The reference character 9A designates a process cartridge into which the photosensitive drum 1, the charging roller 2, the developing apparatus 60A and the drum cleaner 8 are integrally formed, and which is made detachably mountable with respect to the image forming apparatus.

It is to be understood here that a process cartridge refers to at least one of charging means, developing means and cleaning means and an electrophotographic photosensitive member integrally made into a cartridge detachably mountable to a main body of an image forming apparatus.

Example 2 of Image Forming Apparatus

Figure 2:
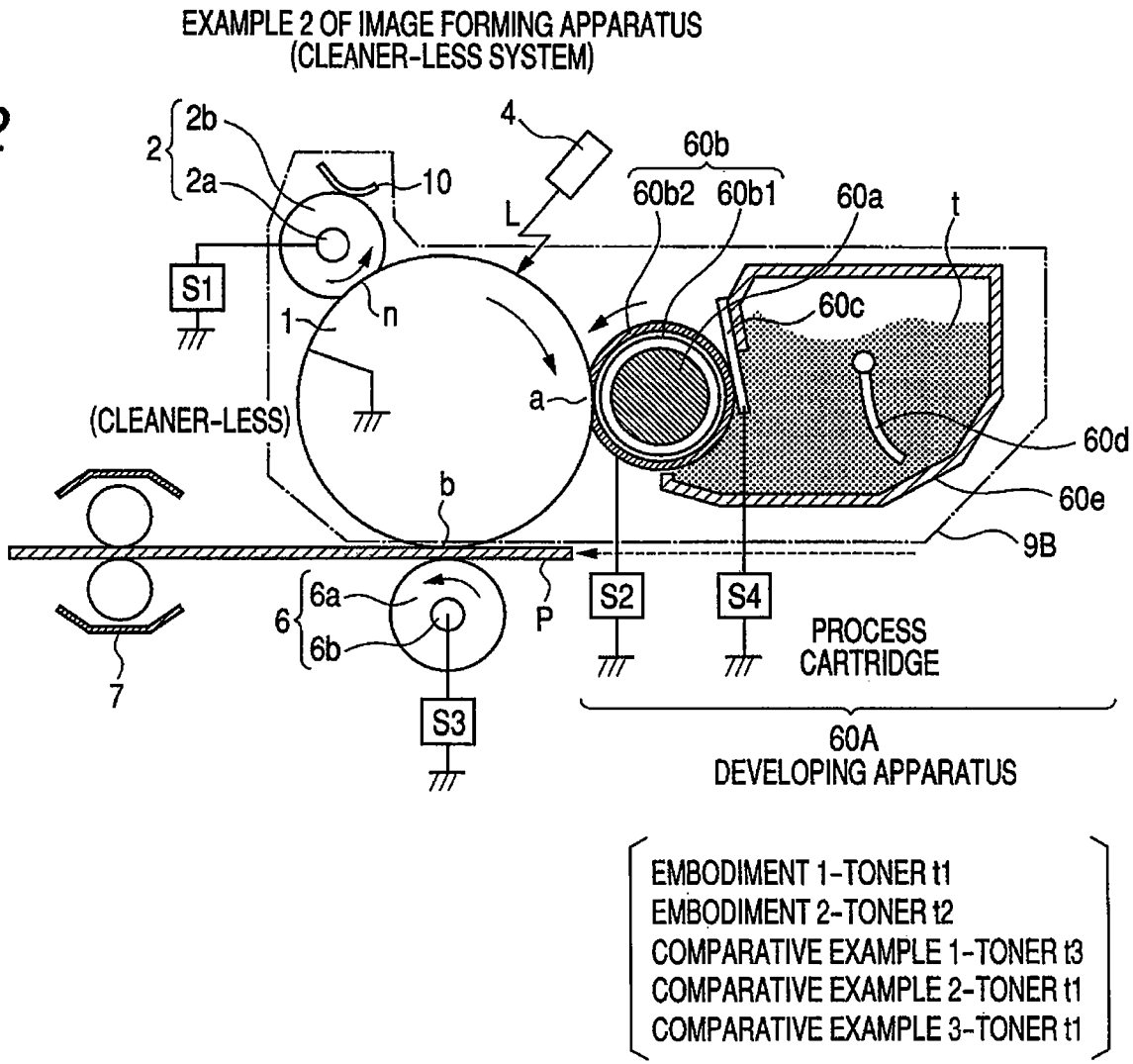
FIG. 2 is a schematic view of Example 2 of the image forming apparatus using Embodiment 1 of the present invention.

FIG. 2 schematically shows the construction of a second form of the image recording apparatus using the developing apparatus of the present invention. The image recording apparatus of this embodiment is a laser printer utilizing a transfer type electrophotographic process and a toner recycle process (cleaner-less system). The similarities of this example to the aforedescribed Example 1 of the image forming apparatus need not be described again, and the different points thereof will hereinafter be described.

The most different point of this embodiment is that the drum cleaner 8 is disused and the untransferred toner is recycled. The untransferred toner is circulated so as not to adversely affect other processes such as charging, and the like, and the toner is collected into the developing apparatus 60A. Specifically, the construction has been changed in the following points relative to Example 1 of the image forming apparatus.

About charging, a charging roller 2 similar to that in Example 1 of the image forming apparatus is used, but in the present embodiment, the driving of the charging roller 2 is effected. The number of revolutions of the charging roller 2 is adjusted so that the surface speed of the charging roller 2 and the surface speed (process speed) of the photosensitive drum 1 may become the same. By the charging roller 2 being driven, the charging roller 2 reliably contacts with the photosensitive drum 1 and an abutting member 10 to thereby charge the toner to minus (a regular polarity). Also, the charging roller 2 is provided with the abutting member 10 for the purpose of preventing the charging roller 2 from being stained with the toner. Even when the charging roller 2 is stained with the toner of an opposite polarity (plus polarity) to the charging polarity thereof, the charges of the toner are charged from plus to minus, and the toner is quickly discharged from the charging roller 2 to the photosensitive drum 1. The toner discharged to the photosensitive drum 1 becomes capable of being subjected to a collecting operation simultaneously with a developing operation being performed by the developing apparatus 60A. The abutting member 10 used is a film of polyimide of 100 μm, and is made to abut against the charging roller 2 with a line pressure of 10 (N/m) or less. Polyimide is used because it has a frictional charging characteristic giving negative charges to the toner.

The reference character 9B designates a process cartridge into which the photosensitive drum 1, the charging roller 2, the abutting member 10 and the developing apparatus 60A are integrally formed, and which is made detachably mountable with respect to the image forming apparatus.

EMBODIMENTS AND COMPARATIVE EXAMPLES

Embodiment 1

<Including Contact Development, Elastic Sleeve, Polar Position Regulation, Degree of Circularity 0.976 and Blade Bias>

Description will hereinafter be made of the developing apparatus 60A (FIGS. 1 and 2) according to the present embodiment. The reference character 60*b* denotes the developing sleeve as a developer carrying member (developer carrying and conveying member) including therein a magnet roll 60*a* as stationary (non-rotatable) magnetic field generating means. The developing sleeve 60*b* is constituted by an aluminum cylinder 60*b*1 and a nonmagnetic electrically conductive elastic layer 60*b*2 formed thereon, and is brought into contact with the photosensitive drum 1 with a constant pressure force. The pressure between the photosensitive drum 1 and the developing sleeve 60*b* is adjusted so as to be 200 N/m in terms of drawing pressure. The drawing pressure is a value corresponding to line pressure obtained by converting the force with which an SUS plate having a thickness of 30 μm sandwiched between two SUS plates also having a thickness of 30 μm is drawn out per length 1 m of the SUS plate.

The developing sleeve 60*b* was manufactured by kneading a material forming the nonmagnetic electrically conductive elastic layer 60*b*2, extrusion-molding it, adhesively securing it as the layer 60*b*2 onto the aluminum cylinder 60*b*1, and thereafter grinding the layer 60*b*2 to a thickness of 500 μm. The microhardness of the developing sleeve 60*b* was 72 degrees, and the surface roughness thereof was 3.8 μm in terms of Rz, and 0.6 μm in terms of Ra.

In the present embodiment, the measurement of surface hardness to be measured by a microhardness meter was carried out by the use of a microhardness meter (Asker MD-1F360A: produced by High Molecule Co., Ltd.). As a surface roughness measuring machine, use was made of Surfcorder SE 3400 produced by Kosaka Research Institute (Ltd.) and a contact detection unit PU-DJ2S, and the measuring conditions were a measurement length 2.5 mm, a vertical magnification 2,000 times, a horizontal magnification 100 times cutoff 0.8 mm and filter setting 2CR, and leveling setting was effected by front data.

Figure 3A:
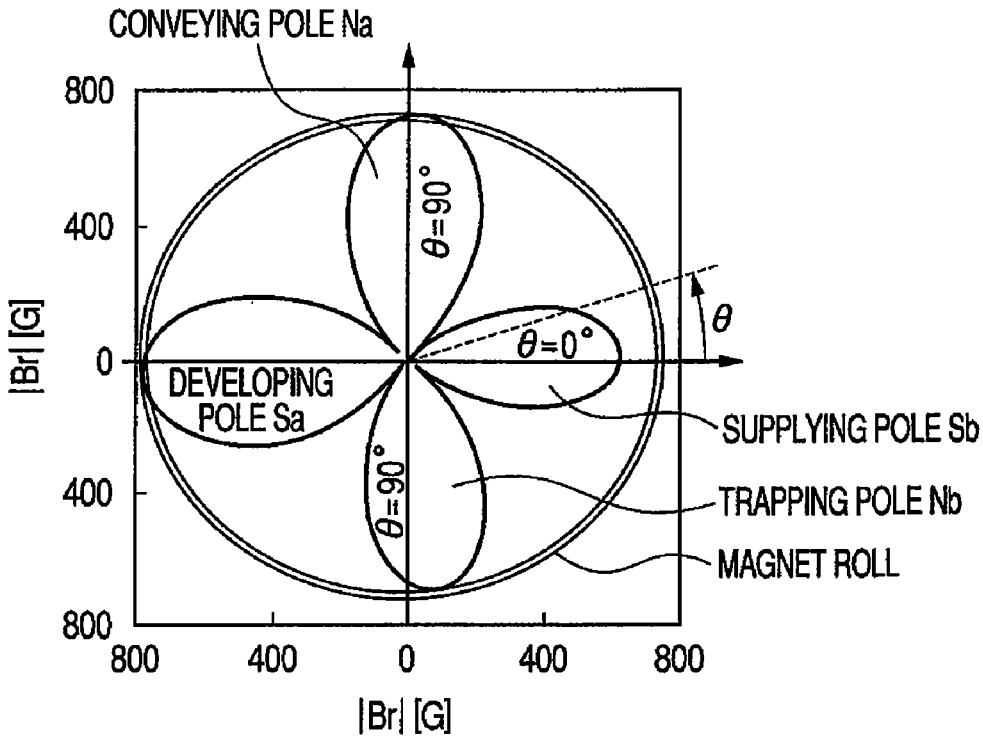
FIG. 3A shows the magnetic flux density of a magnet roll used in Embodiment 1 in a direction perpendicular to the surface of a developing sleeve.

The magnet roll 60*a* is a fixed magnet as magnetic field generating means for generating a magnetic force at each place on the surface of the developing sleeve 60*b*. As shown in FIG. 3A, the magnetic flux density on the surface of the developing sleeve 60*b* in a direction perpendicular to the surface of the developing sleeve 60*b* has peak density in each of a developing portion pole Sa, a conveying portion pole Na, a supplying pole Sb and a trapping pole Nb. That is, the magnet roll 60*a* has four magnetic poles, i.e., the developing pole Sa, the conveying pole Na, the supplying pole Sb and the trapping pole Nb. The measurement of the magnetic flux density in the present invention was carried out by the use of Series 9900, Probe A-99-153 of a gauss meter produced by Bell Inc. This gauss meter has a bar-shaped axial probe connected to a gauss meter main body. The developing sleeve 60*b* is horizontally fixed, and the magnet roll 60*a* therein is rotatably mounted. A probe in a horizontal posture is disposed at right angles with some interval provided with respect to the developing sleeve 6*b*, and is fixed so that the center of the developing sleeve 60*b* and the center of the probe may be located on substantially the same horizontal plane, and the magnetic flux density is measured in that state. The magnet roll 60*a* is a cylindrical member substantially concentric with the developing sleeve 6*b*, and the interval between the developing sleeve 60*b* and the magnet roll 60*a* may be considered to be equal everywhere. Accordingly, what has been measured at all positions with respect to the circumferential direction of the developing sleeve 60*b* can be replaced by measuring the magnetic flux density at the surface position of the developing sleeve 60*b* and in the direction of a normal at the surface position while rotating the magnet roll 60*a*.

The vertical peak intensity of each position was found from the obtained magnetic flux density in the circumferential direction, and was defined as Br.

Next, a vertically disposed probe was rotated by 90 degrees in a tangential direction with respect to the circumferential direction, and the magnet roll 60*a* was rotated to thereby measure the magnetic flux density at the surface position of the developing sleeve 60*b* and in the tangential direction at the surface position, and this magnetic flux density was defined as Bθ.

From the values of Br and Bθ at each angle, the magnitude $$|B|=|Br^2+B\theta^2|^{1/2}$$

of the magnetic flux density B was calculated.

Next, the ratio |Br|/|B| of the magnitude |Br| of the vertical component of the developing sleeve surface to the magnitude |B| of the magnetic flux density was found.

Figure 3B:
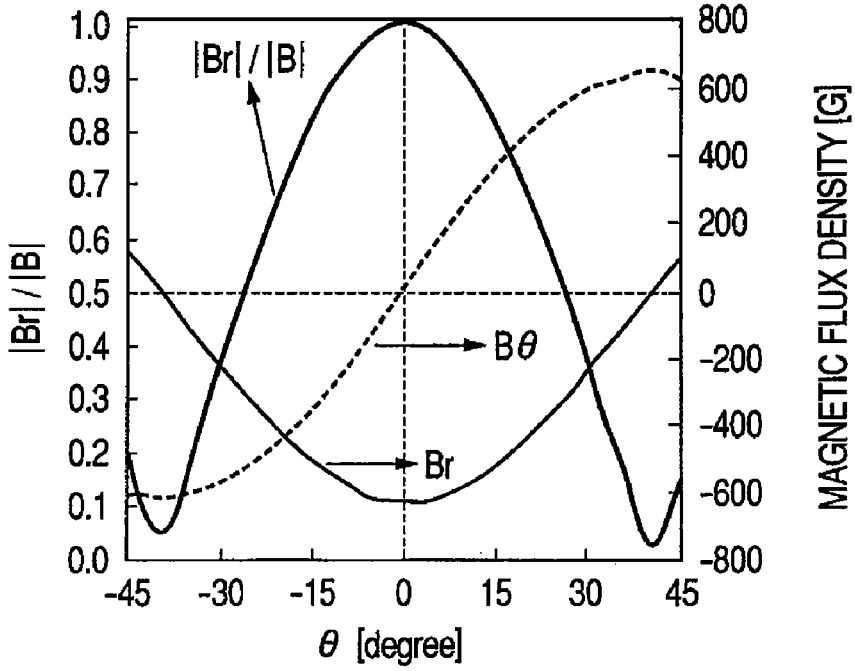
FIG. 3B shows |Br|/|B| of the magnet roll used in Embodiment 1.

The result and Br and Bθ are shown in FIG. 3B. The angle of the axis of abscissas is such that the origin is taken at the trapping pole Sb pole, and the positive direction is selected to a downstream direction (Sb→Na→Sa→Nb→Sb) relative to the rotation direction of the developing sleeve 60*b*. The right axis of ordinates shows the intensity of the magnetic flux density, and has the N pole as positive and the S pole as negative, and the left axis of ordinates shown |Br|/|B|.

Toner t1: a mono-component magnetic toner t1 which is a developer is a magnetic mono-component toner (spherical toner) having a mean degree of circularity of 0.976 made by a suspension polymerization method. As a method of making such a magnetic polymerization toner, use was made of a method proposed in Japanese Patent Application Laid-open No. 2001-235899, and the like.

The mean degree of circularity in the present invention is used as a simple method of quantitatively expressing the shape of a particle, and in the present invention, measurement was carried out by the use of a flow particle image analyzer "FPIA-2100" produced by Sysmex, and the degree of circularity (Ci) of each particle measured about a group of particles having a diameter corresponding to a circle of 3 μm or greater was found by the following expression (5), and a value obtained by dividing the sum total of the degrees of circularity of all particles measured as shown by the following expression (6) by the number of all particles (m) is defined as the mean degree of circularity ($\overline{C}$).

$$\text{Degree of circularity } (Ci) = \frac{\text{circumferential length of a circle having the same projection area as the number of particles}}{\text{circumferential length of the projection image of particle}} \quad \text{Expression (5)}$$

$$\text{Mean degree of circularity } (\overline{C}) = \sum_{i=1}^{m} Ci/m \quad \text{Expression (6)}$$

Magnetic material particles were prescribed by the same weight as binding resin to thereby make magnetic particles capable of being conveyed by a sufficient magnetic force. Here, the amount of magnetic material was 100 parts by weight relative to 100 parts by weight of binding resin, but if the amount of magnetic material relative to 100 parts by weight of binding resin is 70-120 parts by weight, the effect of the present invention can be sufficiently obtained. Also, the mean particle diameter (D4) of the toner was 6 μm.

The mean particle diameter of the toner in the present embodiment refers to a weight mean particle diameter (D4), and can be measured by one of various methods such as Coulter Counter TA-II type and Coulter Multisizer (produced by Coulter Co., Inc.).

Specifically, it can be measured as follows. Coulter Multisizer (produced by Coulter Co., Inc.) is used to connect an interface (produced by Nikkaki) outputting the distribution of particle number and the distribution of volume and PC9801 personal computer (produced by NEC) together, and as regards an electrolyte, 1% NaCl water solution is adjusted by the use of first class sodium chloride. For example, ISOTON R-II (produced by Coulter Scientific Japan) can be used. The measuring procedure is as follows. The aforementioned electrolytic water solution is added by 100-150 ml, and further a measurement sample is added by 2-20 mg. The electrolyte having the sample suspended therein is subjected to dispersion processing for about 1 to 3 minutes by an ultrasonic disperser, and by the aforementioned Coulter Multisizer, the volume and number of toner particles of 2 μm or larger are measured by the use of an aperture to thereby calculate the distribution of volume. Then, the weight mean particle diameter (D4) of the volume standard found from the distribution of volume according to the present invention is found.

The toner t1 is subjected to layer thickness regulation (developer amount regulation) by a regulating blade 60*c* as a developer amount regulating member and the imparting of charges, in the process of being conveyed on the developing sleeve 60*b* while receiving the magnetic force by the magnet roll 60*a*. The reference character 60*d* designates an agitating member for effecting the circulation of the toner in a developer container 60*e* and sequentially conveying the toner into the magnetic force reach range around the developing sleeve 60*b*.

The present developing apparatus 60A, in order to obtain a desired toner charging amount and a desired coat amount, uses phosphor bronze having a thickness of 100 μm and microhardness of 100 degrees as the regulating blade 60*c*, and the abutting position (regulating position) of the regulating blade against the developing sleeve was set to θ=7 degrees (|Br|/|B|=0.96) in FIGS. 3A and 3B, drawing pressure of 55 (N/m) and a blade free length of 2.0 mm. The blade free length means the length of the free end when the contact portion between the regulating blade 60*c* and the developing sleeve 60*b* is defined as a fulcrum. Also, it will be called polar position regulation to set the abutting position of the regulating blade 60*c* against the developing sleeve 60*b* to a magnetic pole area (|Br|/|B|≧0.9) in which a perpendicular magnetic field is dominant, as in the present embodiment.

Further, the nip width Nsb over which the regulating blade 60*c* abuts against the developing sleeve 60*b* under the present conditions was 1.5 mm.

In the present invention, the measurement of the nip width between the regulating blade 60*c* and the developing sleeve 60*b* was carried out by the following method. First, in the developing sleeve in the developing apparatus capable of developing, a state in which the developing sleeve is coated with the toner is kept, and only the developing sleeve is removed. Next, the amount of toner corresponding to a half rotation relative to the rotation direction of the developing sleeve coated with the toner is removed (but the toner on the longitudinal end portions is kept). Thereafter, the fixed magnet roller in its detached state is mounted on the developing apparatus which is not filled with the toner. At this time, it is mounted so that the surface from which the toner has been removed may contact with the regulating blade. In this state, the developing sleeve is rotated by one revolution in the rotation direction thereof, and is removed. Then, the toner adhering to the surface of the regulating blade is stripped off by a tape, and is stuck on paper together with the tape. In this case, the toner does not adhere to the contact width between the developing sleeve and the regulating blade, but the toner adheres to the outside thereof. That is, two lines of toner are obtained, and by measuring the interval between the two lines, it is possible to obtain the nip width.

Figure 4:
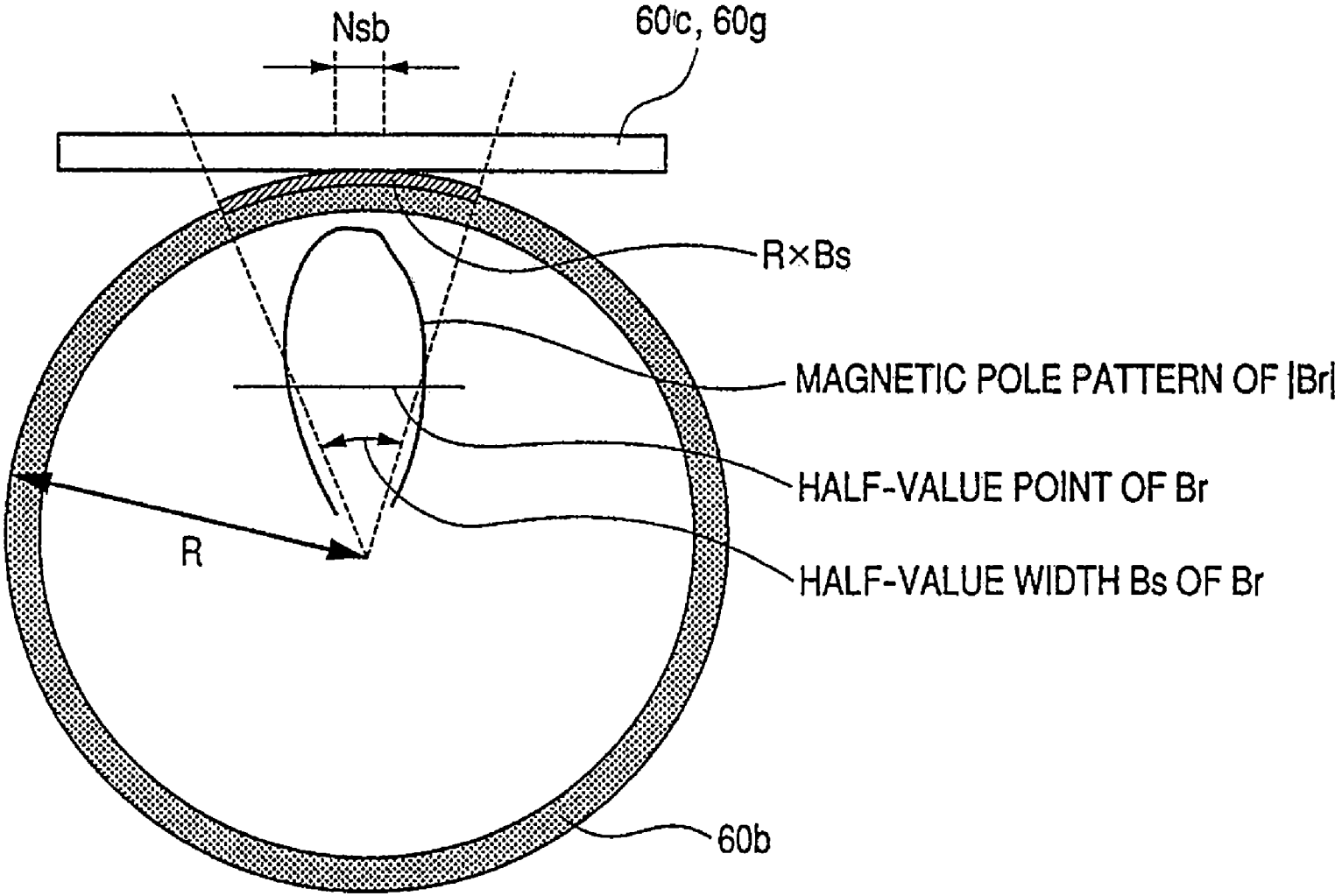
FIG. 4 shows the relation among Nsb, R and Bs.

Further, the half-value width Bs about Br of the magnetic pole nearest to the contact position between the regulating blade 60*c* and the developing sleeve 60*b* is 52 degrees (≈0.91 rad), the radius R of the developing sleeve 60*b* which is the developer carrying member is 6.5 mm, and Nsb/(Bs×R) =0.25. This specific disposition relation is shown in FIG. 4.

The toner t1 coating the developing sleeve 60*b* is conveyed to a developing region (developing area portion) which is the opposed portion of the photosensitive drum 1 to the developing sleeve 60*b*. Also, a developing bias voltage (DC voltage of −450 V) is applied from the developing bias applying voltage source S2 to the developing sleeve 60*b*.

Further, a DC voltage of −550 V is applied from an applying voltage source S4 to the regulating blade 60*c* with a potential difference of 100 V given between the regulating blade 60*c* and the developing sleeve 60*b* through the toner.

That is, the potential (−550 V) of the regulating blade side is more adjacent to the polarity side (minus side) of the toner which is the developer than the potential (−450 V) of the developing sleeve 60*b* which is the developer carrying member.

In the following, the bias applied to the regulating blade 60*c* is called a blade bias. The developing sleeve 60*b* is driven at a peripheral speed 1.2 times as high relative to the photosensitive drum 1. Thereby, the electrostatic latent image on the photosensitive drum 1 is reversal-developed with the toner t1. Here, the peripheral speed of the developing sleeve 60*b* relative to the photosensitive drum 1 has been mentioned as 1.2 times, but if the peripheral speed of the developing sleeve 60*b* relative to the photosensitive drum 1 is 1.0 to 2.0 times, the effect of the present invention can be sufficiently obtained.

Embodiment 2

<Mean Degree of Circularity 0.968>

A developing apparatus according to this embodiment basically conforms to the developing apparatus 60A described in Embodiment 1, but used a toner t2 as the developer, as shown below.

Toner t2: The mono-component magnetic toner t2 which is the developer was made via the steps of mixing, kneading and crushing a binding resin, magnetic material particles and a charge controlling agent, and improving the surface quality thereof and classifying them, and adding a fluidizing agent or the like as an extraneous agent (a crushing method, see for example, Japanese Patent Application Laid-open No. 2002-341590). The magnetic material particles were prescribed by the same weight as the binding resin to thereby make magnetic particles which are conveyable by a sufficient magnetic force. Also, the mean particle diameter (D4) of the toner was 6 μm, and the mean degree of circularity found by the above-described method was 0.968.

Comparative Example 1

<Mean Degree of Circularity 0.955>

A developing apparatus according to this comparative example basically conforms to the developing apparatus 60A described in Embodiment 1, but used a toner t3 as the developer, as shown below.

Toner t3: The mono-component magnetic toner t3 which is the developer was made via the steps of mixing, kneading, crushing and classifying a binding resin, magnetic material particles and a charge controlling agent, and adding a fluidizing agent or the like as an extraneous agent (crushing method). The magnetic material particles were prescribed by the same weight as the binding resin to thereby make magnetic particles which are conveyable by a sufficient magnetic force. Also, the mean particle diameter (D4) of the toner was 6 μm, and the mean degree of circularity found by the above-described method was 0.955.

Comparative Example 2

<Nsb/(Bs×R)>0.5, Nip Width Great>

A developing apparatus according to this comparative example basically conforms to the developing apparatus 60A described in Embodiment 1, but differs in the following points from the developing apparatus 60A.

As the regulating blade 60*c* which is the regulating member, use was made of urethane having a thickness of 1.5 mm and having a nonmagnetic electrically conductive layer having a thickness of 50 μm on the surface thereof contacting with the toner. The regulating blade was manufactured by kneading a material providing the nonmagnetic electrically conductive layer, and uniformly applying it onto the surface of the urethane. The microhardness of the elastic layer on the surface of the developing sleeve is 51 degrees, the microhardness of the regulating blade is 58 degrees, Nsb is 3.2 mm, Nsb/(Bs×R)=0.54>0.5, and the drawing pressure is 45 N/m.

Comparative Example 3

<Contact Elastic Sleeve Inter-pole Position Regulation Blade Bias>

A developing apparatus according to this comparative example basically conforms to the developing apparatus 60A described in Embodiment 1, but differs in the abutting condition of the regulating blade 60*c* against the developing sleeve 60*b* from the developing apparatus 60A.

In the present example, the abutting position of the regulating blade 60*c* was set to θ=40 degrees (|Br|/|B|=0.03) in FIGS. 3A and 3B, the drawing pressure was set to 55 (N/m), the blade free length was set to 1.5 mm.

Also, it will hereinafter be called inter-pole position regulation (inter-pole regulation to set the abutting position of the regulating blade 60*c* against the developing sleeve 60*b* to a magnetic pole area (|Br|/|B|≦0.1) in which a perpendicular magnetic field is dominant as in the present example.

Comparative Example 4

<Contact Elastic Sleeve Pole Position Regulation Sleeve Conduction>

Figure 5:
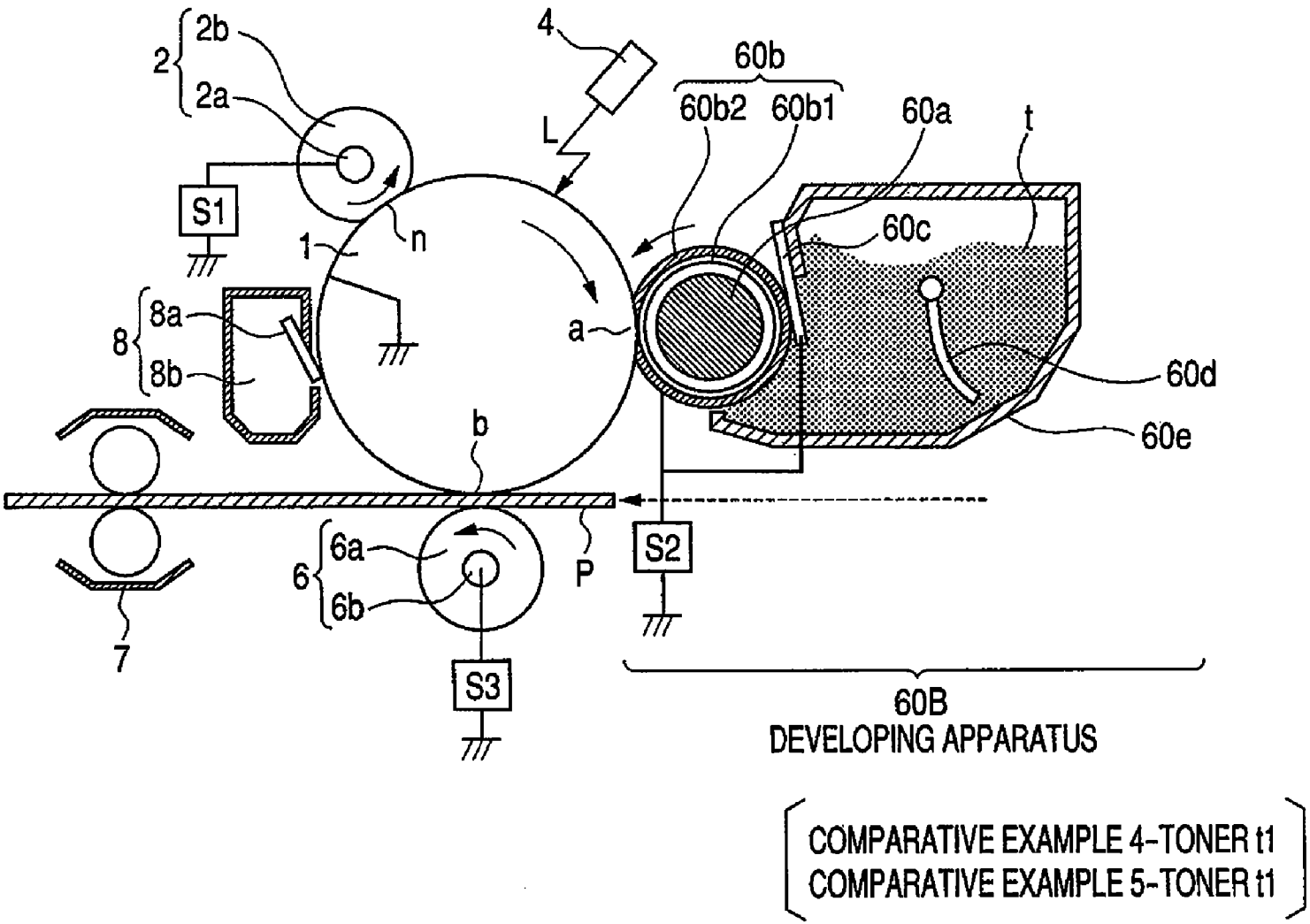
FIG. 5 is a schematic view of Example 1 of an image forming apparatus using Comparative Example 4.

Description will now be made of a developing apparatus according to this comparative example. FIG. 5 shows a schematic view of Example 1 of an image forming apparatus using the present comparative example. The developing apparatus 60B according to the present comparative example basically conforms to the developing apparatus 60A described in Embodiment 1, but differs in the following point from the developing apparatus 60A.

In the present example, the regulating blade 60*c* is made to conduct with the developing sleeve 60*b*, and the two were at the same potential.

Comparative Example 5

<Contact Elastic Sleeve Inter-pole Position Regulation Sleeve Conduction>

A developing apparatus according to this comparative example basically conforms to the developing apparatus 60B described in Comparative Example 4, but differs in the abutting condition of the regulating blade 60*c* against the developing sleeve 60*b* from the developing apparatus 60B.

In the present example, the abutting position of the regulating blade 60*c* was set to θ=40 degrees (|Br|/|B|=0.03) in FIGS. 3A and 3B, the drawing pressure was set to 55 (N/m), and the blade free length was set to 1.5 mm.

Comparative Example 6

<Magnetic Non-contact Developing Method Inter-pole Position Regulation>

Figure 6:
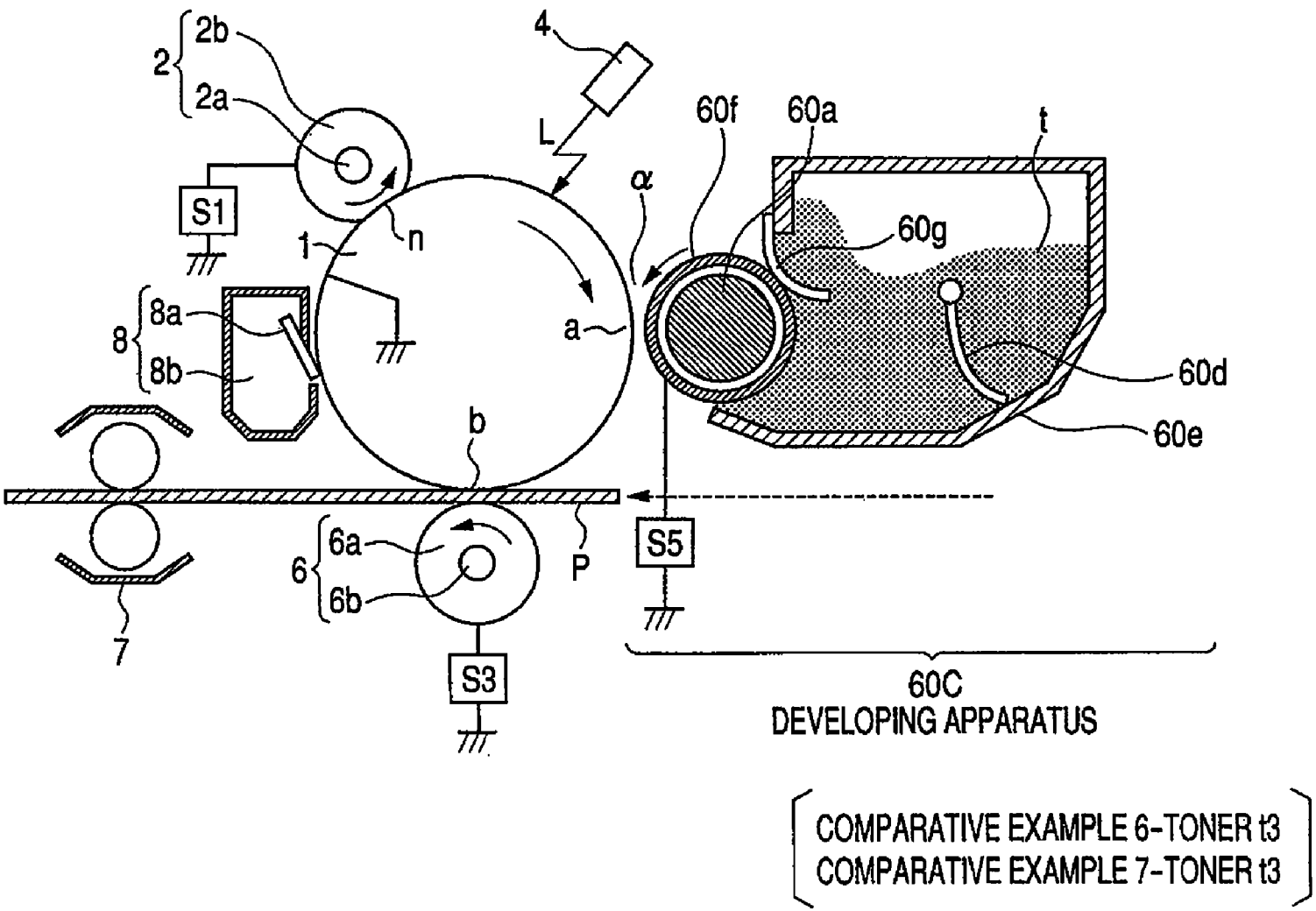
FIG. 6 is a schematic view of Example 1 of an image forming apparatus using Comparative Example 6.

Description will now be made of a developing apparatus 60C according to this comparative example. FIG. 6 shows a schematic view of Example 1 of an image forming apparatus using the present comparative example. A toner t3 which will be described later was used as the developer.

The reference character 60*f* designates a developing sleeve as a developer carrying and conveying member including therein the magnet roll 60*a* used in Embodiment 1. The developing sleeve 60*f* is constructed by adjusting the roughness of the surface of an aluminum cylinder by sandblast, and is installed with a gap α of 300 μm relative to the photosensitive drum 1. The microhardness of the developing sleeve 60*f* was 100 degrees, the surface roughness Rz thereof was 11.5 μm, and Ra was 1.5 μm. The toner t3 filling the developing apparatus 60C is subjected to layer thickness regulation by a regulating blade 60*g* of urethane having a thickness of 1.5 mm and the imparting of charges, in the process of being conveyed on the developing sleeve 60*f* while receiving the magnetic force by the magnet roll 60*a*. The reference character 60*d* denotes an agitating member for effecting the circulation of the toner in a developer container 60*e* and sequentially conveying the toner into a magnetic force reach range around the developing sleeve 60*f*.

In the present developing apparatus 60C, in order to obtain a desired toner charging amount and a desired coat amount, the abutting position of the regulating blade 60*g* against the developing sleeve 60*f* was set to θ=40 degrees (|Br|/|B|=0.03) in FIGS. 3A and 3B, the drawing pressure was set to 30 N/m, and the blade free length was set to 1.2 mm. Nsb/(R×Bs) at this time was 0.52.

The toner t1 coating the developing sleeve 60*f* is conveyed to a developing region (developing area portion) "a" which is the opposed portion between the photosensitive drum 1 and the developing sleeve 60*f* by the rotation of the developing sleeve 60*f*. Also, a developing bias voltage (DC voltage of −450 V, AC voltage (rectangular wave, 1.8 kvpp, 1.6 kHz)) is applied from a developing bias applying voltage source S5 to the developing sleeve 60*f*. The developing sleeve 60*f* is driven at a peripheral sped 1.2 times as high relative to the photosensitive drum 1. Thus, the electrostatic latent image on the photosensitive drum 1 is reversal-developed with the toner t3. The toner t3 was used as the developer, as shown below.

Toner t3: This conforms to Comparative Example 1.

Comparative Example 7

<Magnetic Non-contact Developing Method Pole Position Regulation>

A developing apparatus according to this comparative example basically conforms to the developing apparatus 60C described in Comparative Example 6, but differs in the abutting condition of the regulating blade 60*g* against the developing sleeve 60*f* from the developing apparatus 60C.

In the present example, the abutting position of the regulating blade 60*g* was θ=7 degrees (|Br|/|B|=0.96) in FIGS. 3A and 3B.

Comparative Example 8

<Magnetic Non-contact Developing Method Pole Position Regulation Blade Bias is Present>

Figure 7:
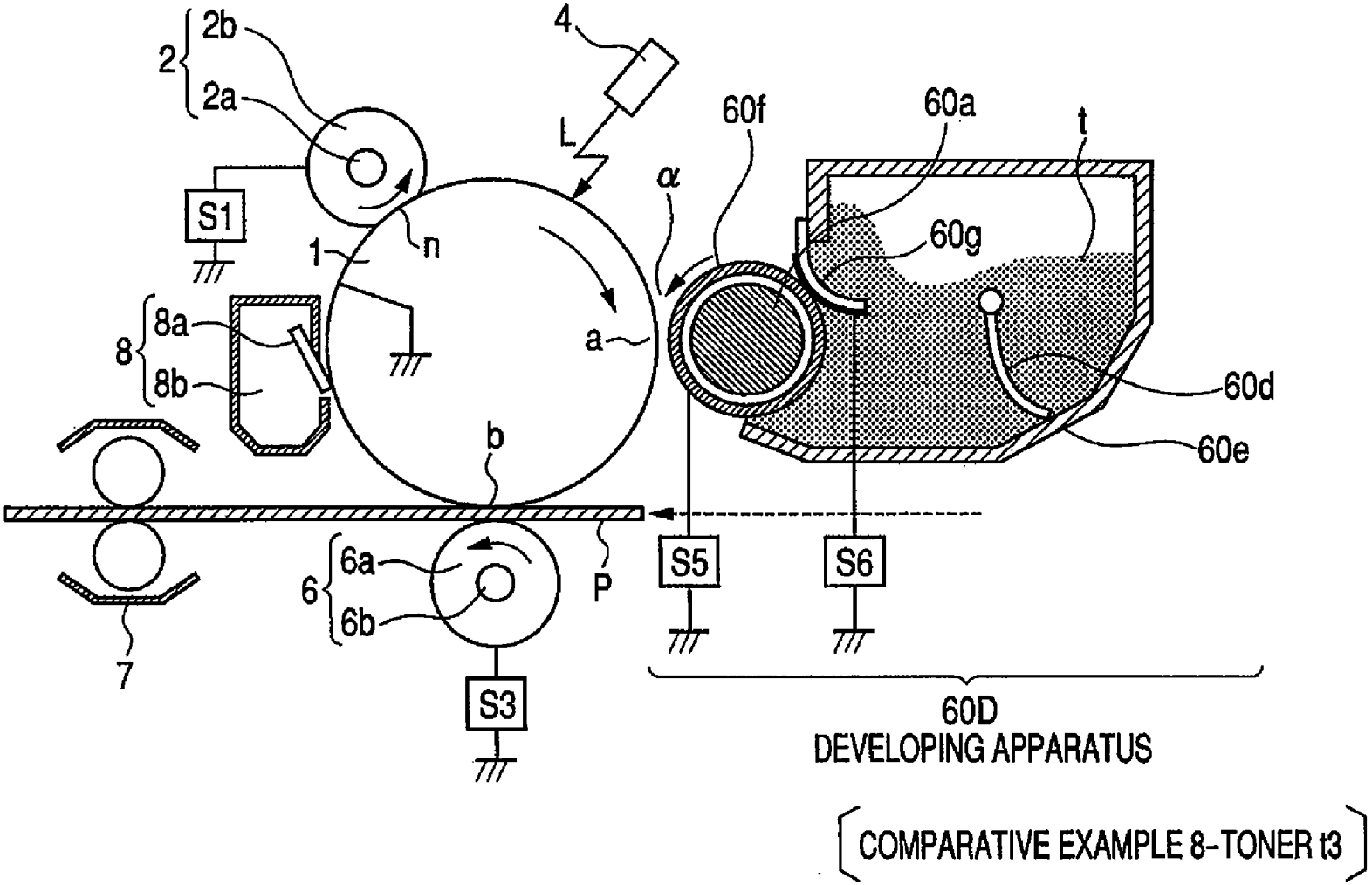
FIG. 7 is a schematic view of Example 1 of an image forming apparatus using Comparative Example 8.

Description will now be made of a developing apparatus 60D according to this comparative example. FIG. 7 shows a schematic view of Example 1 of an image forming apparatus using the present comparative example. The developing apparatus 60D according to the present comparative example basically conforms to the developing apparatus 60C described in Comparative Example 6, but differs in the following points from the developing apparatus 60C.

In the abutting condition of the regulating blade 60*g* against the developing sleeve 60*f*, the present comparative example set the abutting position of the regulating blade 60*g* to θ=7 degrees (|Br|/|B|=0.96) in FIGS. 3A and 3B.

Further, as the regulating blade 60*g*, use was made of an electrically conductive layer having a thickness of 50 μm and applied to the surface of urethane having a thickness of 1.5 mm. The method of making this blade conforms to that in Comparative Example 2. Furthermore, a bias (DC voltage of −550 V, AC voltage (rectangular wave of the same phase as the developing bias, 1.8 kvpp, 1.6 kHz)) is applied to the electrically conductive layer on the surface of the regulating blade by an applying voltage source S6. The toner t3 was used as the developer, as shown below. Toner t3: This conforms to Comparative Example 1.

Comparative Example 9

<Rotating Type Multi-pole Magnet Roll>

Figure 8:
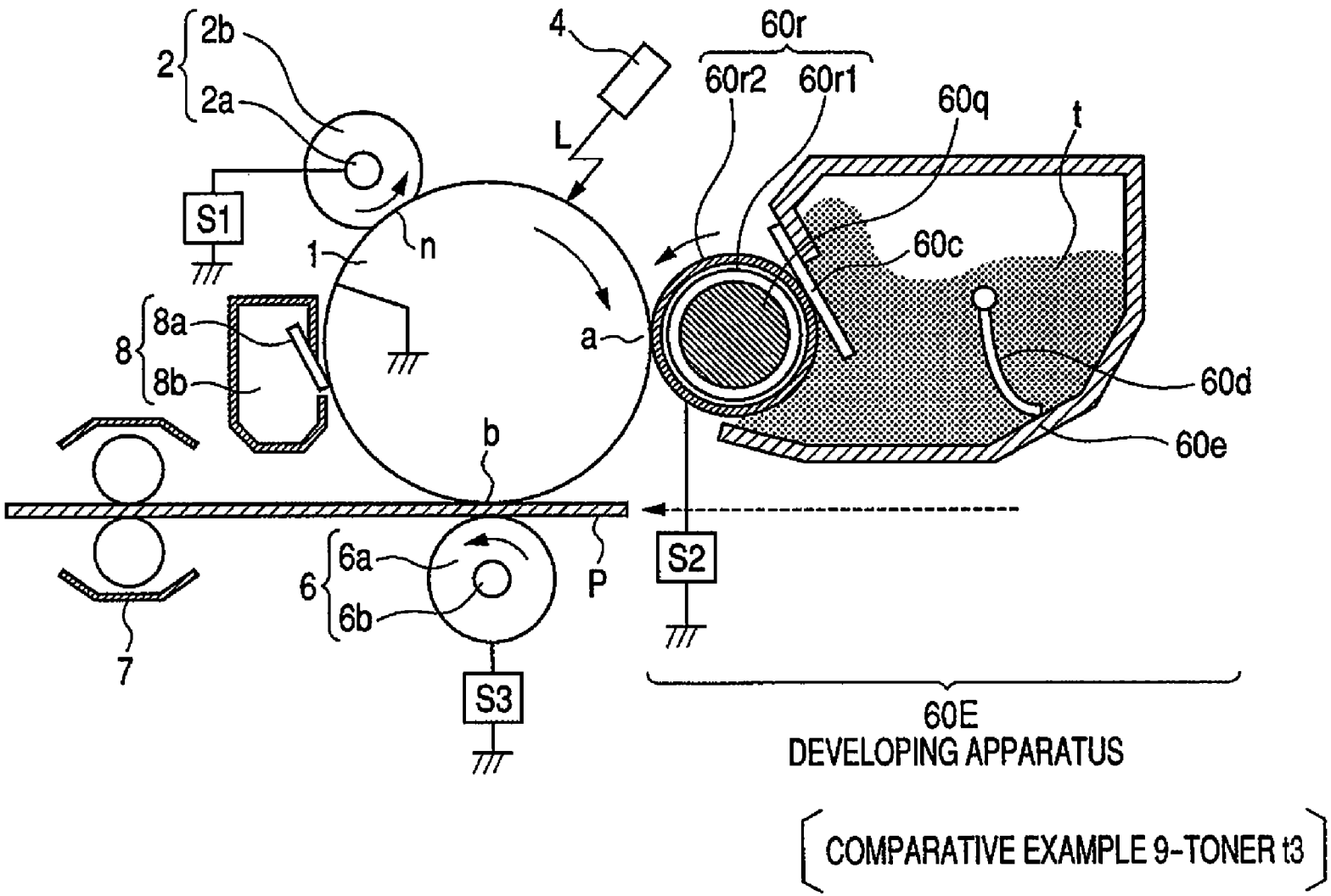
FIG. 8 is a schematic view of Example 1 of an image forming apparatus using Comparative Example 9.

Description will now be made of a developing apparatus 60E according to this comparative example. FIG. 8 shows a schematic view of Example 1 of an image forming apparatus using Comparative Example 9.

The reference character 60*r* designates a developing sleeve as a developer carrying and conveying member including a magnet roll 60*q* therein. The developing sleeve 60*r* is constituted by an aluminum cylinder 60*r*1 and a nonmagnetic electrically conductive elastic layer 60*r*2 formed thereon, and is brought into contact with the photosensitive drum 1 with a constant pressure force. The drawing pressure was 200 N/m.

The developing sleeve 60*r* was manufactured by kneading a material providing the nonmagnetic electrically conductive elastic layer 60*r*2, extrusion-molding it, adhesively securing it as the layer 60*r*2 onto the aluminum sleeve 60*r*1, and thereafter grinding this layer 60*r*2 to a thickness of 500 μm. The microhardness was 94 degrees, and the surface roughness Ra was 1.2 μm.

As the magnet roll 60*q*, use is made of a multi-pole magnet roll having eight poles magnetized at regular intervals. Magnetic flux density of 300 G is generated at the absolute value of peak density. Also, the magnet roll 60*q* is rotatively driven in a direction opposite to the rotation direction of the developing sleeve 60*r* at a number of revolutions equal to that of the developing sleeve 60*r*.

The toner t3 is subjected to layer thickness regulation by the regulating blade 60*c* and the imparting of charges, in the process of being conveyed on the developing sleeve 60*r* while receiving the magnetic force by the magnet roll 60*q*. The reference character 60*d* denotes an agitating member for effecting the circulation of the toner in a developer container 60*e* and sequentially conveying the toner into a magnetic force reach range around the developing sleeve 60*r*.

In the present developing apparatus 60E, in order to obtain a desired toner charging amount and a desired coat amount, the regulating blade 60*c* was set to drawing pressure of 30 N/m, and a blade free length of 1.2 mm.

The toner t3 coating the developing sleeve 60*r* is conveyed to a developing region (developing area portion) "a" which is the opposed portion between the photosensitive drum 1 and the developing sleeve 60*r* by the rotation of the sleeve 60*r*. Also, a developing bias voltage (DC voltage of −340 V) is applied from the developing bias applying voltage source S2 to the developing sleeve 60*r*. The developing sleeve 60*r* is driven at a peripheral speed 1.2 times as high relative to the photosensitive drum 1. Thereby, the electrostatic latent image on the photosensitive drum 1 is reversal-developed with the toner t3.

Toner t3: This conforms to Comparative Example 1.

Also, as a construction resembling the present example, there is a developing apparatus disclosed in Japanese Patent Application Publication No. H4-15949.

Comparative Example 10

<Nonmagnetic Contact Developing Method>

Figure 9:
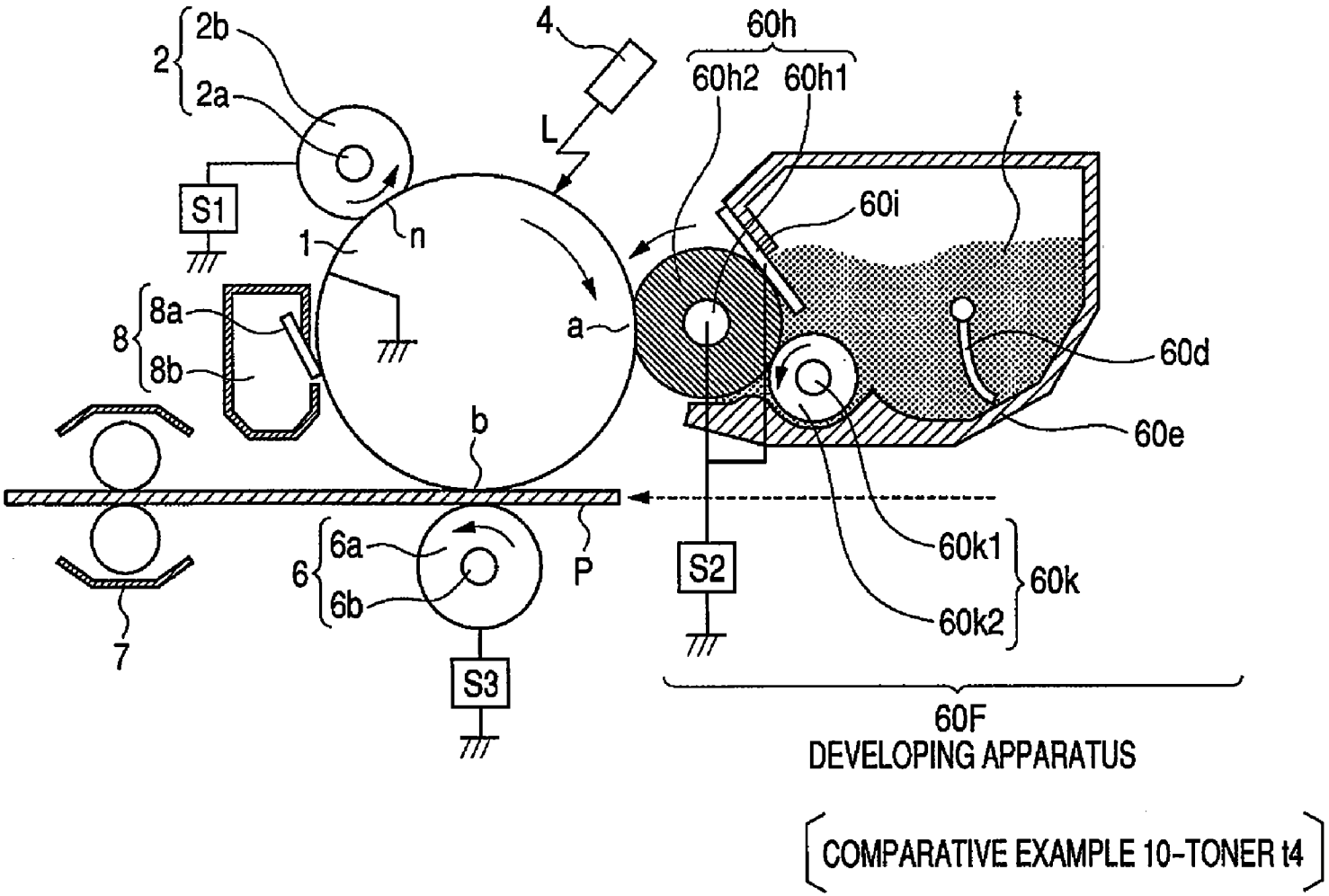
FIG. 9 is a schematic view of Example 1 of an image forming apparatus using Comparative Example 10.

Description will now be made of a developing apparatus 60F according to this comparative example. FIG. 9 shows a schematic view of Example 1 of an image forming apparatus using Comparative Example 10.

The reference character 60*h* designates a developing roller constituted by a mandrel 60*h*1 and an electrically conductive elastic layer 60*h*2 formed thereon. Also, the reference character 60*k* denotes an elastic roller constituted by a mandrel 60*k*1 and an elastic layer 60*k*2 formed thereon. The developing roller 60*h* is brought into contact with the photosensitive drum 1 with a constant pressure force, and the drawing pressure thereof was 20 N/m. Also, the elastic roller 60*k* is fixed with a constant axis interval relative to the developing roller 60*h*, and the drawing pressure thereof was 40 N/m. Also, the developing roller 60*h* is driven at a peripheral speed 1.4 times as high relative to the photosensitive drum 1, and the elastic roller 60*k* is rotatively driven at the same number of revolutions as the developing roller 60*h* so that the surface thereof may move in the opposite direction. The rubber hardness of the developing roller 60*h* was 50 degrees in terms of ASKER C (load of 500 g), and 42 degrees in terms of microhardness.

A toner t4 which will be described later is supplied to the elastic roller 60*k* by an agitating member 60*d*. Further, the elastic roller 60*k* supplies the toner t4 to the developing roller 60*h* by the rotation thereof, and the toner t4 is conveyed to a regulating portion. Then, the toner supplied onto the developing roller 60*h* is regulated to predetermined frictional charging and a predetermined coat length by a regulating blade 60*i*, and is conveyed to a developing portion a. The toner conveyed on the developing roller 60*h* is used for the development of the photosensitive drum 1 in the developing portion a. Also, any toner not used for development but residual on the developing roller 60*h* is once stripped off by the elastic roller 60*k* and is again circulated in a developer container 60*e*, and again coats the developing roller 60*h*.

A DC voltage of −340 V as a developing bias was applied to the mandrel 60*h*1 of the developing roller 60*h*. Also, the elastic roller 60*k* and a regulating blade 60*i* were made electrically common to the developing bias, and the same developing bias potential was applied thereto.

Toner t4: The mono-component nonmagnetic toner t which is the developer was made by mixing a binding resin and a charge controlling agent together, and via the steps of kneading, crushing and classifying, and adding a fluidizing agent or the like as an extraneous agent (crushing method). Also, the mean particle diameter (D4) of the toner was 6 μm, and the mean degree of circularity thereof was 0.953.

Comparative Example 11

<Nonmagnetic Contact Developing Method Blade Bias Applied>

Figure 10:
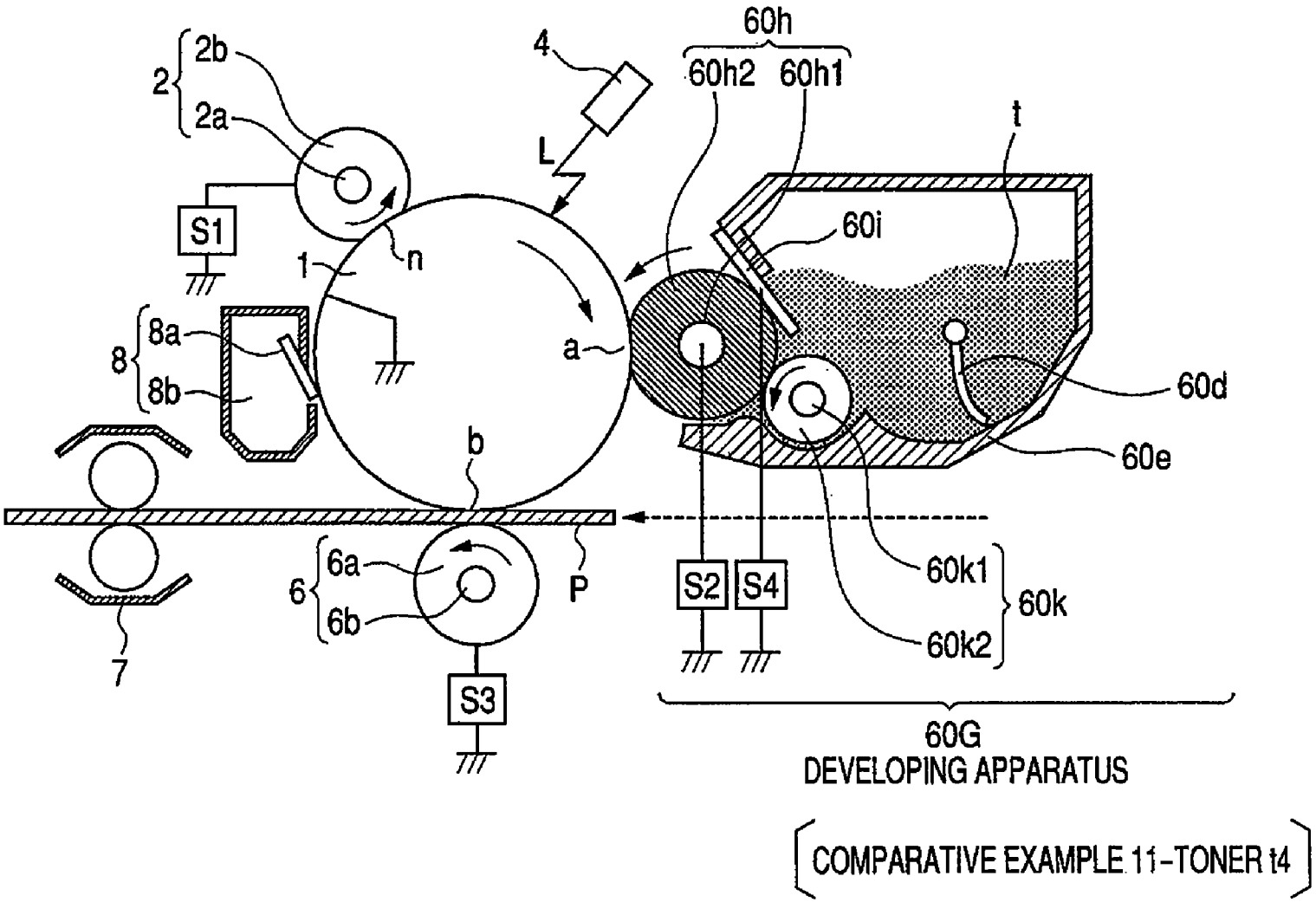
FIG. 10 is a schematic view of Example 1 of an image forming apparatus using Comparative Example 11.

Description will now be made of a developing apparatus 60G according to this comparative example. FIG. 10 shows a schematic view of Example 1 of an image forming apparatus using Comparative Example 11. The developing apparatus 60G according to the present comparative example basically conforms to the developing apparatus 60F described in Comparative Example 10, but differs in the following point from the developing apparatus 60F.

−550 V was applied to phosphor bronze which is a regulating blade 60*i* by an applying voltage source S4.

Comparative Example 12

<Non-contact Conveying Roller>

Figure 11:
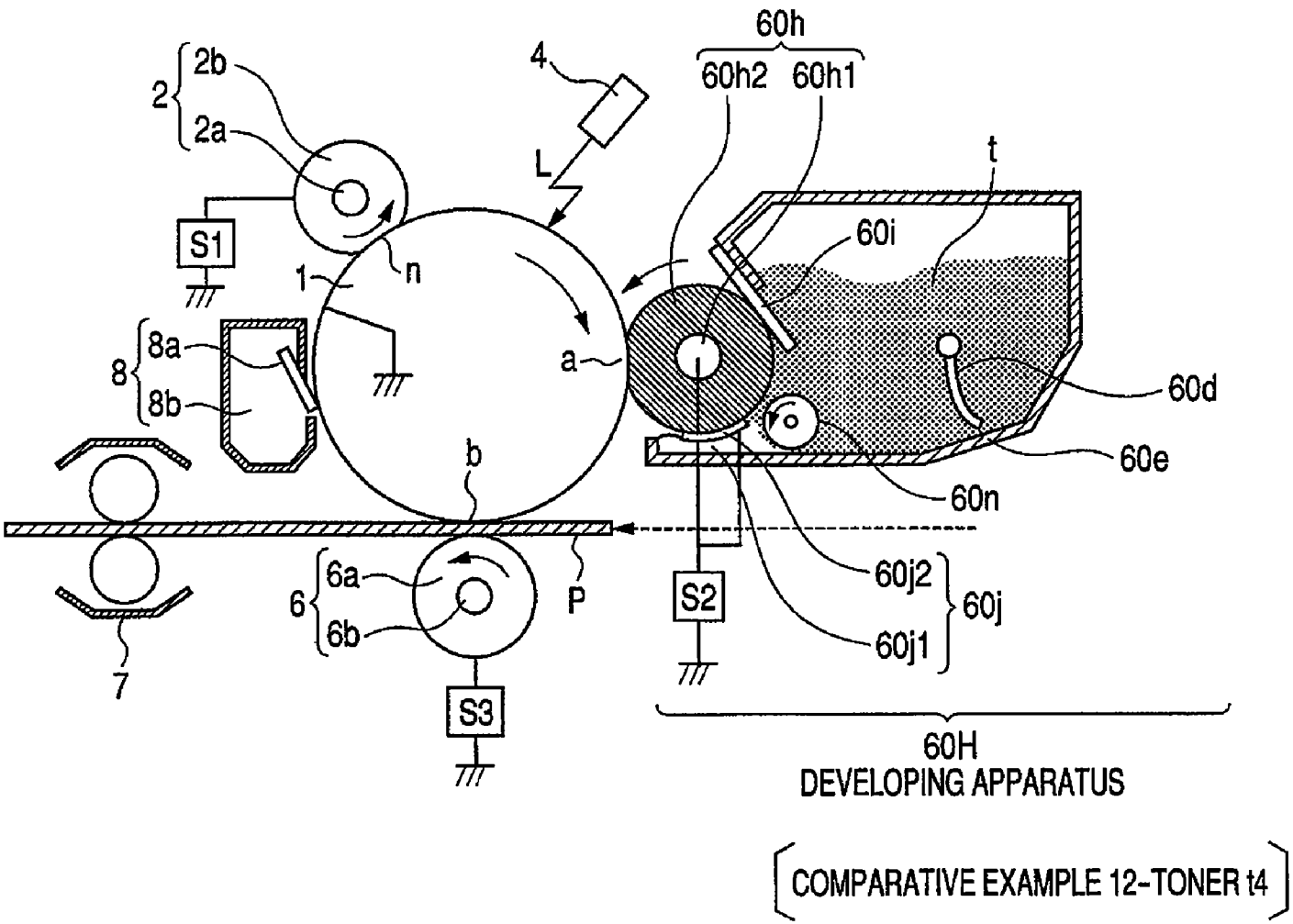
FIG. 11 is a schematic view of Example 1 of an image forming apparatus using Comparative Example 12.

Description will now be made of a developing apparatus 60H according to this comparative example. FIG. 11 shows a schematic view of Example 1 of an image forming apparatus using Comparative Example 12.

The reference character 60*h* designates a developing roller constituted by a mandrel 60*h*1 and an electrically conductive elastic layer 60*h*2 formed thereon. Also, the reference character 60*j* denotes a charge eliminating sheet constituted by an electrically conductive sheet 60*j*2 backed with an elastic material 60*j*1. The developing roller 60*h* is brought into contact with the photosensitive drum 1 with a constant pressure force, and the drawing pressure thereof was 20 N/m. Also, the charge eliminating sheet 60*j* is fixed to the developing roller 60*h* with a constant inroad amount, and the drawing pressure thereof was 55 N/m. Also, the developing roller 60*h* was driven at a peripheral speed 1.4 times as high relative to the photosensitive drum 1. Also, a conveying roller 60*n* disposed in non-contact with the developing roller 60*h* was provided and was rotatively driven so that the peripheral speed thereof might be the same as that of the developing roller 60*h*. The rubber hardness of the developing roller 60*h* was 50 degrees in terms of ASKER C (load of 500 g), and 42 degrees in terms of microhardness.

The toner t4 is supplied to the conveying roller 60*n* by an agitating member 60*d*. Further, the conveying roller 60*n* disposed in non-contact with the developing roller 60*h* supplies the toner t4 to the developing roller 60*h* by the rotation thereof. Then, the toner supplied onto the developing roller 60*h* is subjected to frictional charging by a regulating blade 60*i*, and is regulated to a constant coat length and is conveyed to the developing portion a. The toner conveyed on the developing roller 60*h* is used for the development of the photosensitive drum 1 in the developing portion a. Also, any toner not used for development but residual on the developing roller 60*h* is once charge-eliminated by the charge eliminating sheet 60*j*, is again circulated in the developer container 60*e*, and again coats the developing roller 60*h*.

A DC voltage of −340 V as a developing bias was applied to the mandrel 60*h*1 of the developing roller 60*h*. Also, the conveying roller 60*n* and the regulating blade 60*i* were made electrically common to the developing bias, and the same developing bias potential was applied thereto.

Toner t4: This conforms to Comparative Example 10.

Also, as a construction resembling the present example, there is a developing apparatus disclosed in Japanese Patent No. 3225759.

About the Superiority of the Present Embodiment to the Conventional Art

Method of Evaluating Each Embodiment and Comparative Examples

Image evaluation for examining the differences between the present invention and the comparative examples will hereinafter be described.

(1) Various Image Evaluations in Example 1 of the Image Forming Apparatus

Description will first be made of various image evaluations by Example 1 of an image forming apparatus having a drum cleaner.

a) Fog Evaluation

Fog refers to an image fault that the toner is slightly used for development and appears like a ground stain in a blank portion (unexposed portion) which is originally not printed.

As regards a fog amount, the optical reflectance by a green filter was measured by an optical reflectance measuring machine (TC-6DS produced by Tokyo Denshoku Co.), and was subtracted from the reflectance of recording paper alone to thereby find a reflectance amount corresponding to the fog, and this reflectance amount was evaluated as a fog amount. The fog amount was measured over ten points or more on the recording paper to thereby find the mean value thereof.

x: The fog amount exceeds 2%.

Δ: The fog amount is 1-2%.

○: The fog amount is 0.5-1%.

○○: The fog amount is less than 0.5%.

The evaluation environment was at 32.5° C. and 80% Rh. The fog evaluation was effected at the initial time of 50 sheets, and after the printing of 5,000 sheets. A printing test was carried out with a record image of a lateral line of an image percentage of 2% intermittently passed. "Intermittently" means that after printing, the next printing is effected via a standby state. Also, when other image fault which will hereinafter be described occurred, consideration was paid so that measurement might be effected avoiding that portion and the fog could be purely evaluated.

b-1) Evaluation of the Fog Characteristic when the Remaining Toner Amount is Decreased A printing test is repeated, whereby the toner stored in the developing apparatus is decreased, and the evaluation image of the lateral line gradually becomes thin and in some cases, breaks. The fog characteristic when the remaining toner amount was thus decreased was discretely evaluated. When in the printing test, the fault of the lateral line image as previously mentioned has occurred, a fog evaluation is effected and thereafter, the developing apparatus is detached from the printer, and the operation of feeding the toner therein to the developing sleeve or the developing roller as by shaking by the hands is performed, and the developing apparatus is again mounted on the printer, and a fog evaluation is effected. By these image evaluations, a fog evaluation similar to the afore-described one is effected, and the worst (greatest) result is used as the fog evaluation of the present evaluation.

b-2) The Factor of Fog when the Remaining Toner Amount has Been Decreased

The supply of the nonmagnetic toner to the developing roller is effected by a sponge-like supplying roller being brought into contact with the developing roller so as to be counter-rotated. Accordingly, by this frictional contact between the developing roller and the supplying roller, the deterioration of the toner occurs remarkably and a reduction in a charge imparting property occurs. Thereby, if the number of printed sheets (particularly low coverage rate) increases, the fog amount increases.

Further, in such a toner supplying mechanism, there is formed an area in which the toner hardly changes places around the developing roller and is not circulated, and a toner suffering little from deterioration exists. On the other hand, the toner being circulated suffers from constant deterioration. If during the exhaustion of the toner, the cartridge is detached and the hand is waved, such a toner suffering little from deterioration and the toner having suffered from constant deterioration are mixed together in the developer container. That is, the toners differing greatly in the polarity of charge imparting from each other are mixed together and therefore, the fog amount increases remarkably.

The reason for such an increase in the fog amount is that when in such mixing of the toners, charge imparting is effected to the toners, the toner not deteriorated becomes higher in the charge imparting property and the deteriorated toner can hardly be subjected to charge imparting or has imparted thereto charges of a polarity opposite to the regular polarity. The fog amount is remarkably increased by the toner which cannot be subjected to charge imparting or has imparted thereto the charges of the opposite polarity.

The reason why the toner of the opposite polarity occurs as the fog amount is that the force received in an electric field is in a direction entirely opposite to the toner of the regular polarity, and the toner positively shifts to an ordinary non-print area on the surface of the drum.

In contrast, in the case of the magnetic toner, the toner is conveyed by a magnetic force and therefore, the deterioration of the toner does not remarkably occur and even if the waving of the hand for the process cartridge is effected immediately before the exhaustion of the toner, the toners differing greatly in the polarity are not mixed together and therefore, it is possible to prevent an increase in the fog amount immediately before the exhaustion of the toner.

c-1) Ghost

The supply stripping-off property of the developer was evaluated by a developing ghost. With the peripheral speed and process speed of the developing roller or the developing sleeve taken into account, a ghost image appearing at the cycle of the developing roller or the developing sleeve was evaluated. Specifically, the ghost was judged as an image fault by the ghost in a case where the density difference appearing in a halftone image wherein a solid black patch image of 5 mm square and 25 mm square was printed at the leading edge of paper at the first cycle of the developing roller or the developing sleeve can be visually recognized. In the printer according to each example, image recording was effected by the use of a 600 dpi laser scanner. In the present evaluation, the halftone image means a striped pattern in which one line in a main scanning direction is recorded and thereafter, four lines are non-recorded, and expresses the density of a halftone as a whole.

Here, the image evaluation thereof was carried out on the following standard.

x: A ghost is recognized in both patches.

Δ: A ghost is recognized in one of the patches.

○: A ghost is not recognized in any of the patches.

The evaluation environment was at 32.5° C. and 80% Rh. The ghost evaluation was carried out at the initial time of 100 sheets. A printing test was carried out with record images of a lateral line of an image percentage of 2% continuously passed.

c-2) The Factor of the Occurrence of the Ghost

In a developing apparatus comprising a photosensitive drum and a developing sleeve urged against each other and having no stripping-off and supplying roller, a fresh toner is supplied to that portion of the developing sleeve on which the toner has been consumed in the last revolution, and is conveyed to a regulating portion, but during the printing of solid black, a toner of about 90% or more of a coat amount is consumed. The consumed part is supplied onto the elastic sleeve in a state in which the percentage of the newly supplied toner is high relative to a toner not consumed but left, and is conveyed to the regulating portion. On the other hand, in a portion wherein the toner has not been consumed in the last revolution, the toner on the elastic sleeve is intactly returned to the supplying portion and therefore, is supplied onto the elastic sleeve in a state in which the percentage of the newly supplied toner is low relative to the toner not consumed but left, and is conveyed to the regulating portion. That is, the toner conveyed to the regulating portion causes a difference between the percentages of the new and old toners due to the hysteresis of toner consumption in the last revolution. When the changing of places between the upper layer and lower layer of the toner layer, i.e., the stripping-off and supply cannot be sufficiently effected, a ghost image fault reflecting the hysteresis of the toner consumption in the last revolution occurs in a uniform halftone image.

d-1) Uniformity of Hair Line

The image evaluation was carried out by the continuity of vertical and horizontal 1-dot lines. In the printer according to each example, image recording was effected by the use of a 600 dpi laser scanner. The image recording was effected about a 1-dot line parallel to the direction of progress of the process, and a 1-dot line parallel to the main scanning direction of a laser scanning system. Hair lines each having a length of 2 cm are outputted in the apparatus according to each example, and 100 points are extracted at random about each line, and 200 μm square about the line is observed at respective points through an optical microscope, and a half value width of the density of the line is used as a line width, and the standard deflection of the line width is calculated with respect to each direction. Then, the line standard deflection in a process direction is defined as σv, and the laser scanning direction standard deflection is defined as σh, and the ratio between the two is calculated to thereby obtain a line standard deflection ratio σv/σh. By the use of this value, evaluation was carried out on the following standard.

xx: The line standard deflection ratio σv/σh is less than 0.7 or exceeds 1.43, and the break of a 1-dot line can be visually discriminated.

x: The line standard deflection ratio σv/σh is less than 0.7 or exceeds 1.43.

Δ: The line standard deflection ratio σv/σh is 0.7 or greater, less than 0.8 or 1.25 or greater and 1.43 or less.

○: The line stand deflection ratio σv/σh is 0.8 or greater and less than 1.25.

Evaluation was carried out at the initial time of 50 sheets and at the time of 5,000 sheets. A printing test was carried out with the record image of a lateral line of an image percentage of 2% intermittently passed.

d-2) Factor of the Lowering of Hair Line Uniformity

In magnetic non-contact development, there is the problem that the hair line uniformity differs between length and width. When a magnetic brush develops while moving in parallel to the movement direction of the photosensitive drum the hair line uniformity is good, and becomes liable to break in a direction orthogonal thereto.

e-1) Image Edge Fault

An image edge fault is the image fault that in an image having great density, the boundary of the density difference between the two becomes thin.

Image evaluation was carried out with a solid black image of 25 mm square printed in a halftone image. In the present evaluation, the halftone image means a dotted pattern in which one dot relative to the main scanning direction is recorded, whereafter four dots are non-recorded, and one dot is recorded relative to a direction perpendicular to the main scanning direction, whereafter four dots are non-recorded, and expresses halftone density as a whole. In the halftone and solid black edge portion of the obtained image, on the halftone side of the edge portion, the number of toner particles in one dot of the compacted toner was measured by the use of an optical microscope and further, about a halftone image portion at a position sufficiently separate from the edge portion, the number of toner particles in one dot was likewise measured. In the measurement of the number of toner particles in one dot, fifteen dots were extracted at random in each area to thereby find the mean value of the number of toner particles, which was defined as the number of toner particles in one dot.

x: The number of toner particles measured at the edge is less than 60% of the number of toner particles at the position sufficiently separate from the edge portion.

○: The number of toner particles measured at the edge is 60% or more of the number of toner particles at the position sufficiently separate from the edge portion.

Evaluation was carried out at the initial time of 100 sheets. A printing test was carried out with record images of a lateral line of an image percentage of 2% continuously passed.

e-2) Factor of the Occurrence of an Image Edge Fault

Figure 12B:
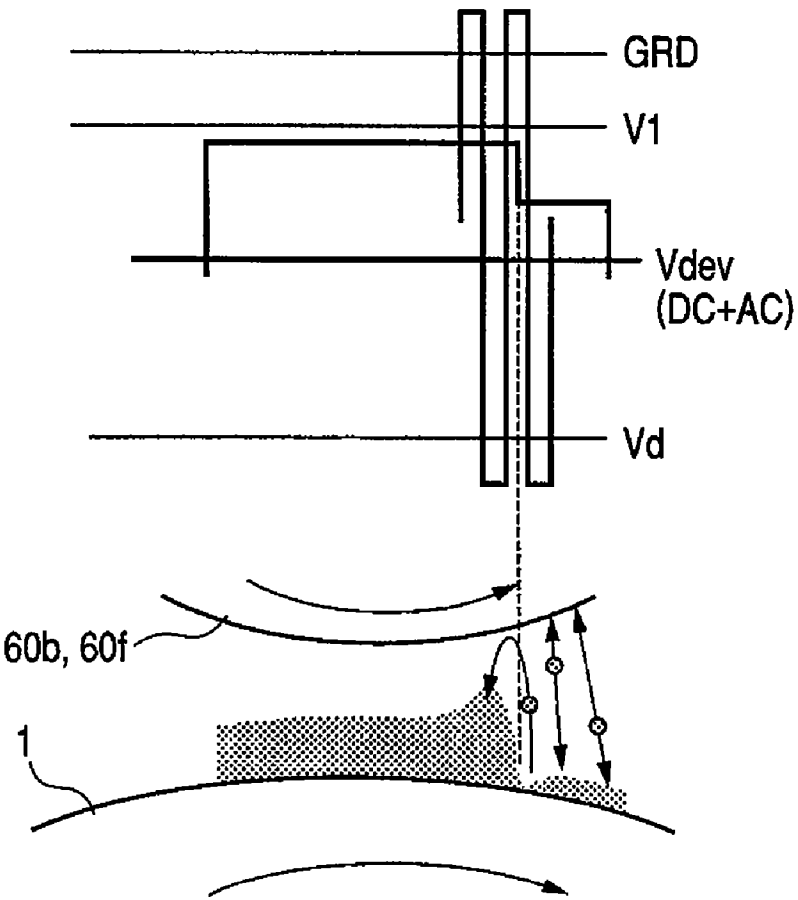
FIGS. 12A and 12B show the mechanism of occurrence of an edge fault.
Figure 12A:
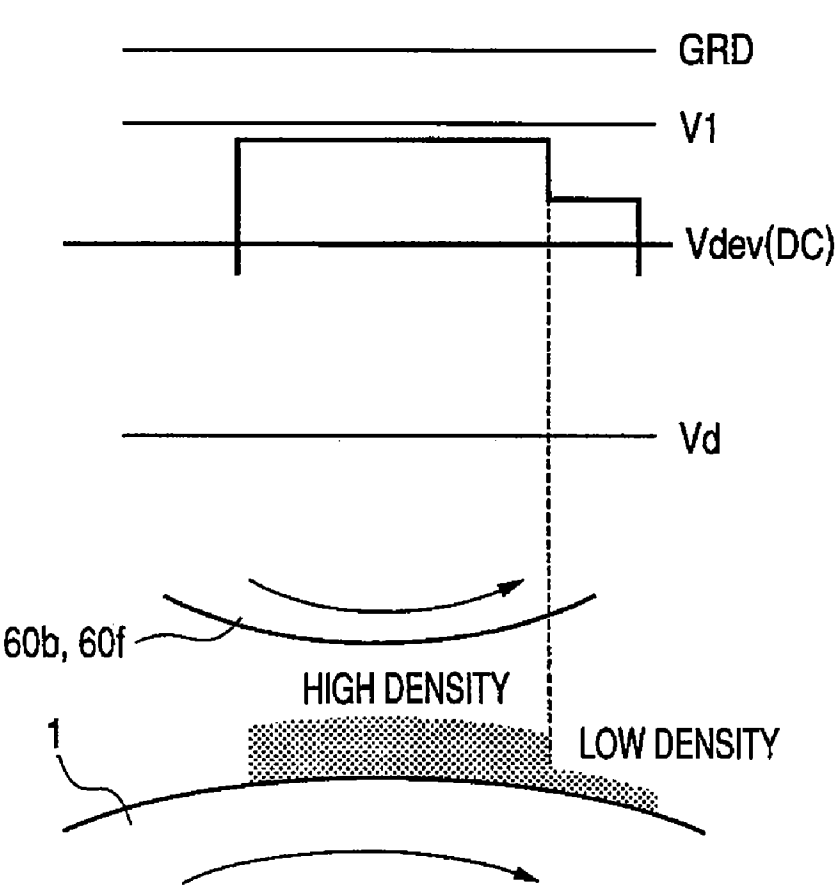

The factor of an image edge fault will now be considered with reference to FIGS. 12A and 12B. When the Vpp value of an AC voltage is made great, the going and coming of the toner occurs in an area developed by the flight of the toner. If at this time, a print area having a great density difference exists, the toner reciprocally moves near a boundary line, whereupon the toner is drawn near to a print area having greater density, and an area in the boundary portion which is lower in density is considered to become lower.

f) Evaluation of Solid Black Density Difference

In Example 1 of the image forming apparatus, a solid black image having black printed on the whole surface thereof is outputted, and the optical reflection density thereof is measured by a densitometer RD-1255 produced by Macbeth Co., Inc. The solid black density in the solid black image corresponding to the first circumferential length of the developer carrying member immediately after the start of printing and the solid black density corresponding to the second and subsequent circumferential lengths of the developer carrying member are measured about 10 points, respectively, and the means thereof are calculated, and from the difference Дtherebetween, evaluation is carried out by the following standard.

x: Дis 0.2 or greater.

Δ: Дis 0.1 or greater and less than 0.2.

○: Дis less than 0.1.

Density evaluation was carried out after the apparatus was left unused for 24 hours after the initial time of 100 sheets. A printing test was carried out with record images of a lateral line of an image percentage of 5% continuously passed. Also, an evaluation environment was at 32.5° C. and 80% Rh.

g-1) Halftone Image Defect 1

Image evaluation was carried out from the number of defects of an image with a halftone image outputted. In the printer according to each example, image recording was effected by the use of a 600 dpi laser scanner. In the present evaluation, the halftone image means a striped pattern in which one line in the main scanning direction is recorded, whereafter two lines are non-recorded, and expresses the density of the halftone as a whole.

Particularly in the present invention, importance is attached to the uniformity of a halftone image, and the defect of a white spot or a black spot of 0.3 mm or greater was evaluated.

x: White spots or black spots having a diameter of 0.3 mm or greater exceeding five spots exist in a halftone image.

Δ: One to five white spots or black spots having a diameter of 0.3 mm or greater exist in a halftone image.

○: Any white spot or black spot having a diameter of 0.3 mm or greater does not exist in a halftone image.

Evaluation was carried out after the printing test of 5,000 sheets. A printing test was carried out with record images of a lateral line of an image percentage of 2% continuously passed.

g-2) Factor of Occurrence of Halftone Image Defect 1

In order to disturb the coat layer by the occurrence of a compact cluster of toner or the mixing of a foreign substance, the defect of the degree of size of the compact cluster or the foreign substance is caused in the halftone image.

h-1) Evaluation of a Ripple Image Fault

In Example 1 of the image forming apparatus, the evaluation of a ripple image fault was carried out. As regards the evaluating method, a solid white image, a solid black image and a halftone image are printed, and the evaluation is visually carried out by the following standard.

x: A ripple-shaped character stain can be confirmed on the solid white image.

Δ: Ripple-shaped unevenness can be visually confirmed in the solid black image or the halftone image.

○: Ripple-shaped unevenness cannot be visually confirmed in the solid white image, the solid black image and the halftone image.

The evaluation of the ripple image fault was carried out after the apparatus was left unused for 24 hours after the initial printing of 100 sheets. A printing test was carried out with record images of a lateral line of an image percentage of 5% continuously passed. Also, the evaluation environment was at 15.0° C. and 10% Rh.

h-2) Factor of a Ripple Image Fault

Description will hereinafter be made of the factor of occurrence of a ripple image fault. The ripple image fault occurs in the toner layer applied as a coat onto the developer carrying member by the regulating blade when the toner layer is disturbed. Specifically, it occurs by the following process. First, the toner having had charges excessively imparted thereto electrically firmly adheres to the surface of the developer carrying member. It becomes difficult for the firmly adhering toner to change places with a newly supplied toner when it is not used for development in the developing portion but is returned into the developer container. Thereupon, the newly supplied toner comes to lightly ride onto the firmly adhering toner. When such a state occurs, it becomes difficult for the newly supplied toner to obtain the sufficient imparting of charges. That is, in the toner coat layer, a layer differing in the charge amount is formed, and disturbance occurs to the toner coat layer. The newly supplied toner is applied as a coat while the imparting of charges is not sufficiently effected and therefore, a ripple-shaped image fault occurs on a uniform image like a solid black image or a halftone image. Further, when such a charge imparting property as under a low-temperature and low-humidity environment becomes high, a ripple-shaped character stain also occurs in a solid white image.

(2) Various Image Evaluations in Example 2 of the Image Forming Apparatus

Description will now be made of various image evaluations by Example 2 of an image forming apparatus which is a cleaner-less system A-1) Cleaner-less Toner Collecting Property The image recording apparatus is stopped during the printing of an evaluation pattern in which a solid black image of about 30-50 mm was printed on the leading edge of a record image, whereafter a solid white image was disposed. The timing at which the image recording apparatus is stopped is a point of time at which the central position of the solid black image on the leading edge has just reached the developing area. Then, the toners having adhered to the surface of the photosensitive drum before and after the development are measured as reflectances, and the ratio thereof is found, whereby it becomes possible to effect the evaluation of the toner collecting efficiency. Actually, the toner on the drum is once transferred to a transparent tape, and the tape to which the toner adheres is stuck on the recording paper or the like, and from on the tape, the net reflectance of the toner is measured as in the measurement of fog.

x: The collection rate is less than 30%.

Δ: The collection rate is 30% or greater and less than 50%.

○: The collection rate is 50% or greater.

Evaluation was carried out at the initial time of 100 sheets. A printing test was carried out with record images of a lateral line of an image percentage of 2% continuously passed.

A-2) Factor of a Reduction in the Cleaner-Less Toner Collecting Property

The greatest difference of Example 2 of the image forming apparatus is that the drum cleaner is disused, and any untransferred toner is collected into the developing apparatus and is recycled. In the present example, the developing roller which is the developer carrying member is urged against the photosensitive drum which is a member to be developed with predetermined pressure, and a developing bias is applied thereto, and the electrostatic latent image formed on the surface of the photosensitive drum is developed (visualized) with the toner which is a developer and at the same time, the untransferred toner on the non-exposed portion (white ground portion) is collected. That is, it is possible that an electric field by which the toner is used for development from the developing roller to the light portion (exposed portion) of the photosensitive drum and an electric field by which the toner is collected from the dark portion (non-exposed portion) of the photosensitive drum to the developing roller are formed at a time.

Figure 13:
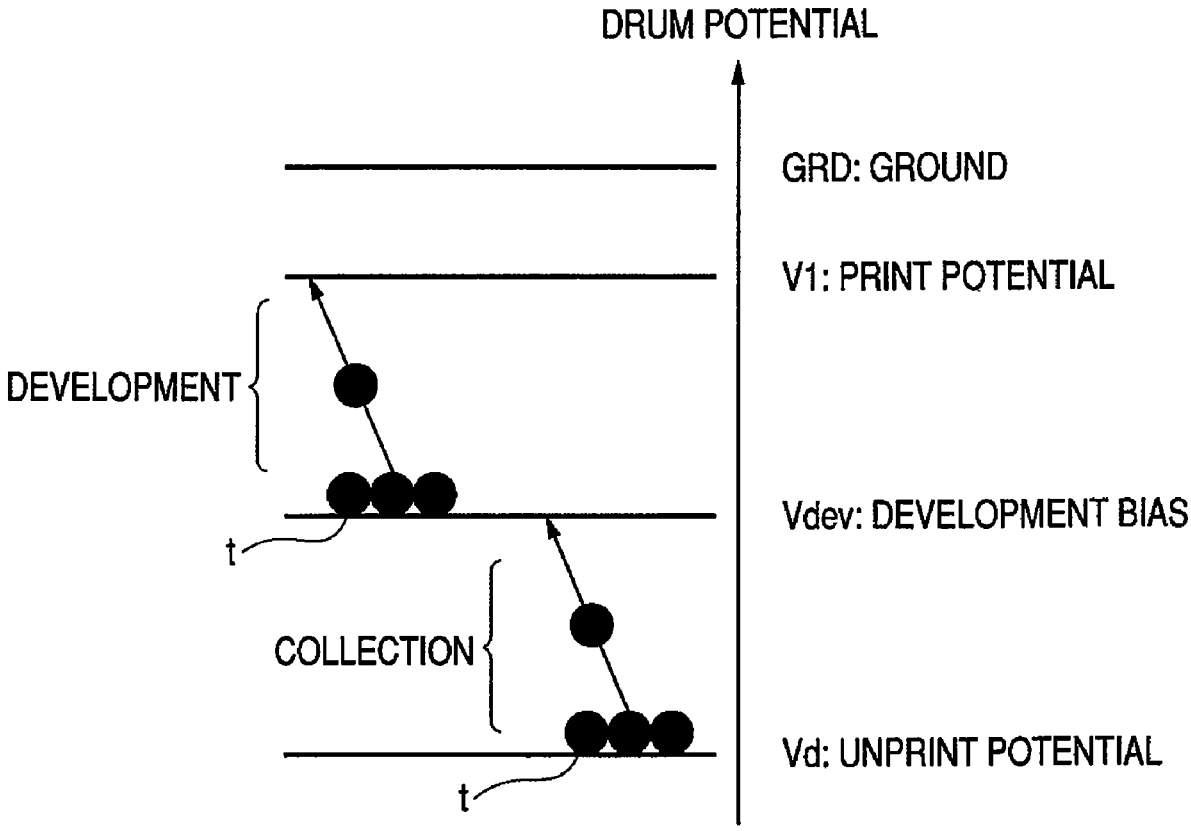
FIG. 13 shows the mechanism of cleaning simultaneous with developing.

As shown in FIG. 13, by the utilization of the potential difference between the developing bias and the potential (V1 in case of solid black) of the printed portion, the toner is shifted from the developing roller to the photosensitive drum to thereby effect reversal development, and by the utilization of the potential difference between the developing bias and the potential (Vd) of the non-printed portion, the returned toner on the photosensitive drum is shifted onto the developing roller and is collected.

Further, by the developing roller being urged and brought into contact, the distance between the photosensitive drum and the developing roller becomes small and the intensity of the electric field is increased to thereby improve the collecting property simultaneous with developing.

In addition, by the developing roller being urged and brought into contact, the development and collection of the electric field by an increase in the developing nip are reliably effected and also, the making of the returned toner negative by the developing roller is promoted and the physical loosening of the returned toner is effected to thereby improve the collecting property.

On the other hand, if the photosensitive drum and the developing roller are opposed to each other in non-contact with each other, the distance therebetween becomes great and therefore, a magnetic collecting force and an electrical collecting force become weak. Therefore, the collection rate is lowered.

Also, if the photosensitive drum and the developing roller are urged against and in contact with each other, the attraction and van der Waals force working by objects contacting with each other become forces of the substantially same order between the photosensitive drum and the toner, between the toner and the developing roller, and between the toner and the toner and therefore, they do not become the factor of a reduction in the collecting property. However, when the photosensitive drum and the developing roller are in non-contact with each other, the aforementioned forces work only between the photosensitive drum and the toner and strip off the toner from the photosensitive drum and therefore, this becomes a hindrance and the collecting property is remarkably reduced.

B-1) Halftone Image Defect 2 (Example 2 of the Image Forming Apparatus)

Like the example 1 of the image forming apparatus, the evaluation of halftone image defect will be carried out with respect to the example 2 of the image forming apparatus.

B-2) Factor of Occurrence of the Halftone Image Defect 2

Like the halftone image defect 1, a halftone image defect 2 is caused by the toner compact cluster and the foreign substance. However, in the cleaner-less system which is Example 2 of the image forming apparatus, the collection of the returned toner is done and therefore, the halftone image defect 2 is liable to occur. Particularly, when as in the non-magnetic contact development, the supplying roller is in contact with the developing roller and is being counter-rotated, physical stress becomes high in the contact portion. When such a construction is used, the compact cluster is liable to occur due to the returned toner and deteriorated toner, and the halftone image defect 2 is remarkably liable to occur.

C-1) Halftone Image Defect Due to Paper Dust

In Example 2 of the image forming apparatus, paper dust (paper fiber) may adhere from the recording paper to the photosensitive drum, and be introduced into the developing apparatus via charging. When the paper dust is introduced into the developing apparatus, the paper dust may become tangled with the developing roller, and the like, to thereby cause an image fault extending in the process progression direction of the developing roller cycle. This was evaluated discretely from the halftone image defect of item B).

A minor axis length of 0.3 mm or greater and a major axis length of 2 mm or greater were regarded as an image fault, and evaluation was carried out with the number of defects in the surface on the following standard.

x: Defects exceeding five points exist in the halftone image.

Δ: One to five defects exist in the halftone image.

○: No defect exists in the halftone image.

C-2) Factor of Occurrence of the Halftone Image Defect Due to Paper Dust

When paper dust included in the returned toner gets mixed with the interior of the developing apparatus, the paper dust adheres to the sponge-like supplying roller for supplying the toner to the developing roller, to thereby cause a reduction in the stripping-off and supplying property. When the paper dust is accumulated on the supplying roller, the toner layer on the developing roller is disturbed to thereby cause a defect extending in the process direction.

D-1) Evaluation of a Solid Black Image Defect

Image evaluation was carried out with a solid black image outputted and from the number of defects of the image. Particularly in the present example, defects of 0.3 mm or greater were evaluated.

x: White spots having a diameter of 0.3 mm or greater and exceeding fifty spots exist in the solid black image.

Δ: Ten to fifty white spots having a diameter of 0.3 mm or greater exist in the solid black image.

○: Less than ten white spots having a diameter of 0.3 mm or greater exist in the solid black image.

The evaluation environment was at 32.5° C. and 80% Rh. A printing test was carried out with record image of a lateral line of an image percentage of 5% continuously passed. Evaluation was carried out with three sheets of solid black images outputted after the lapse of 24 hours after the printing of 100 sheets. Image evaluation was typified by the page of these three sheets which included most defects.

D-2) Factor of Occurrence of the Solid Black Image Defect

Figure 14B:
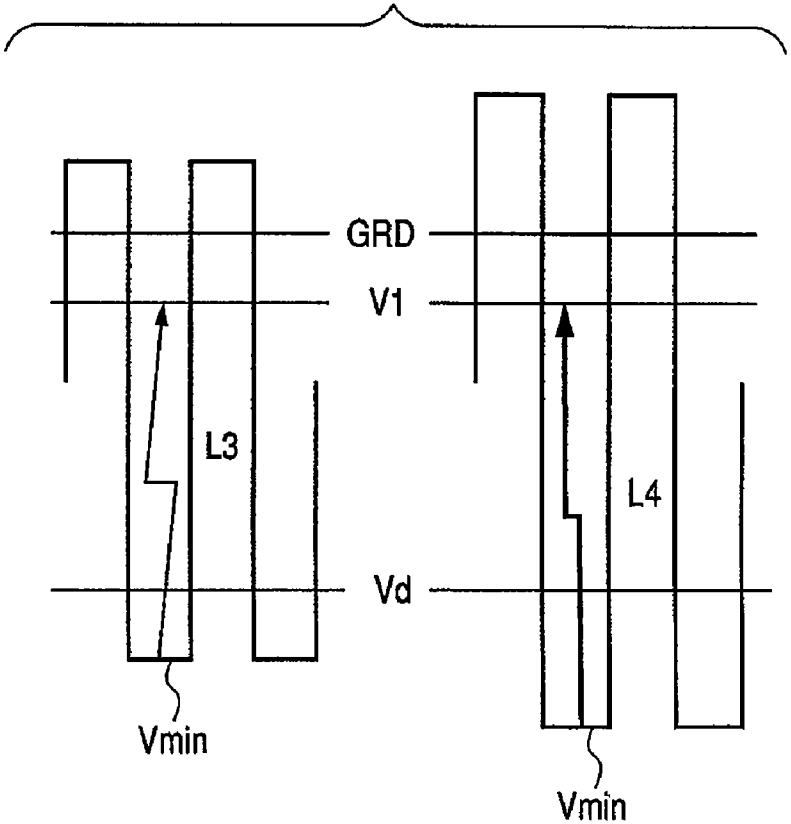
FIGS. 14A, 14B and 14C show the mechanism of occurrence of a solid black image fault.
Figure 14A:
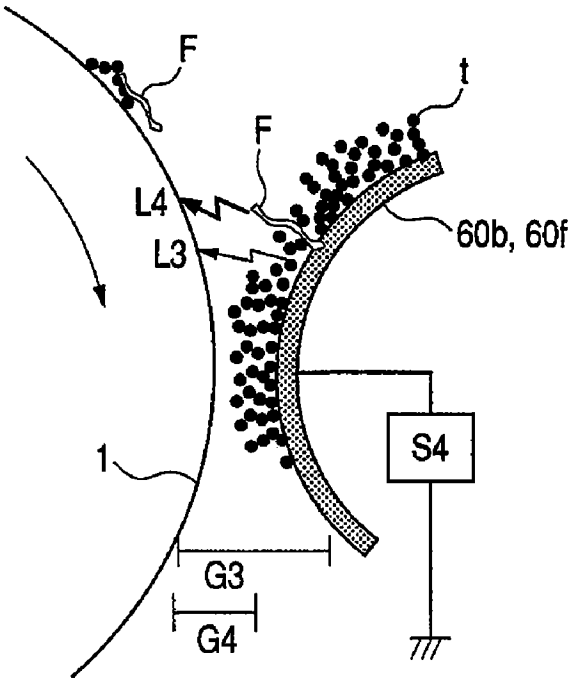

As shown in FIGS. 14A and 14B, when during the application of an AC voltage, a solid white image is being developed, the difference between the surface potential (dark potential Vd) of the photosensitive drum 1 and the maximum value (Vmax) of the developing bias voltage value becomes maximum electric field intensity to thereby bring about a state in which leak L3 is liable to occur.

When the leak L3 occurs, the electrostatic latent image on the photosensitive drum 1 in the pertinent portion is disturbed with a result that part of the potential (dark potential Vd) of a solid white portion on the photosensitive drum 1 approximates to or exceeds light potential (V1) due to the leak and therefore, it is considered that the toner "t" to the photosensitive drum 1 by reversal development shifts with a result that the toner adheres to the pertinent portion of the photosensitive drum 1 and a black-spotted image occurs.

When the leak occurs, there is formed on the photosensitive drum a portion charged with a value of Vmax, irrespective of the intensity of the electric field. If Vmax is great, the contrast (|Vmax−Vdc|) of the developing bias to the DC value Vdc is great and therefore the shift amount of the toner is increased and is very conspicuous on the image.

Figure 14C:
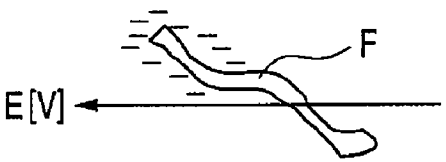

Further, when the paper dust included in the returned toner comes to the developing area together with the toner (FIG. 14A), leak occurs along the paper dust. When as shown in FIG. 14A, the paper dust F has come to the developing area, the gap with respect to the drum becomes G4 smaller than G3. At this time, the intensity of the localized electric field applied to the paper dust is increased (right in FIG. 14B) and leak becomes liable to occur. Also, under a high-temperature and high-humidity environment, the paper dust adsorbs much moisture and lowers in resistance. If at this time, as shown in FIG. 14C, an external electric field E is applied, the inclination of charges occurs and the charge amount increases at the tip end of the paper dust and the leak becomes further liable to occur. From this, it is considered that in the cleaner-less system, as compared with a system with a drum cleaner, the leak becomes, more liable to occur.

[Measurement of the Toner Magnetic Compaction Amount]

Magnetic compaction means that the toner ranges in the shape of a string of beads and compacts. Although the clear and accurate mechanism of occurrence thereof is not apparent, roughly the following is considered to be the mechanism. First, the toner exists in a strong external magnetic field. Next, constant pressure is applied to the toner in a certain particular direction for a particular time or longer. Thereupon, the toner of a small magnetic polarity produces a magnetic polarity, and ranges in the shape of a string of beads and compacts.

As a method of measuring the magnetic compaction amount in the present example, evaluation was carried out by the use of the photograph of toner shapes classified by particle size obtained by a flow particle image analyzer FPIA2100 produced by Sysmex Co. Inc. As the measuring method by FPIA2100, 0.1-5 ml of interfacial active agent as a dispersant is added to 50-150 ml of measurement solvent, and 2-20 mg of measurement sample picked from on the developing sleeve is further added thereto to thereby provide a suspended solution. The solution having the sample suspended therein is subjected to a dispersing process for about one minute by an ultrasonic dispersing machine and is uniformly dispersed, whereafter about 5 ml thereof is supplied to the aforementioned FPIA2100 and measurement is effected. As the standard of evaluation, the rate of toner compaction ranging in the shape of a straight chain is found in toner particles classified into particle size classes 4 and 5 (particle number mean diameter of 10-40 μm) in FPIA2100. Judgment was done from the mean value obtained as the result of this measurement having been effected three times.

Large: The presence percentage of magnetic compaction is 20% or greater.

Medium: The presence percentage of magnetic compaction is 10% or greater and less than 20%.

Small: The presence percentage of magnetic compaction is less than 10%.

The evaluation of the magnetic compaction was carried out after the printing of 5,000 sheets in a printing test. The printing test was carried out with record images of a lateral line of an image percentage of 5% intermittently passed.

(3) Result of the Evaluation

Table 1 below shows the result of various image evaluations in Example 1 of image forming apparatuses (with a drum cleaner) according to Embodiments 1 and 2 and Comparative Examples 1 to 12.

Also, Table 2 shows the result of various image evaluations in Example 2 of image forming apparatuses (cleaner-less system) according to Embodiments 1 and 2 and Comparative Examples 1 to 12.

TABLE 1

| | | | | | Example 1 of image forming apparatus | | |
|---|---|---|---|---|---|---|---|
| Embodiments and Comparative Examples | Mean degree of circularity | \|Br\|/\|B\| | Nsb/(Bs × R) | Magnetic compaction amount | a)fog (high-temperature high-humidity environment $100^{th} \rightarrow 5000^{th}$ sheet | b)fog (toner exhausted) | c)ghost |
| Embodiment 1 Contact, Elastic sleeve Pole position regulation with blade bias | 0.976 | 0.96 | 0.25 | Medium | ○→○ | ○ | ○ |
| Embodiment 2 Contact, Elastic sleeve Pole position regulation with blade bias | 0.967 | 0.96 | 0.25 | Medium | ○→Δ | ○ | ○ |
| Comparative Example 1 Contact, Elastic sleeve Mean degree of circularity low Pole position regulation with blade bias | 0.955 | 0.96 | 0.25 | Medium | ○→X | ○ | ○ |
| Comparative Example 2 Contact, Elastic sleeve Nsb great Pole position regulation with blade bias | 0.980 | 0.96 | 0.54 | Great | ○→X | ○ | Δ |
| Comparative Example 3 Contact, Elastic sleeve Inter-pole position regulation with blade bias | 0.980 | 0.03 | 0.25 | Small | ○→○ | ○ | X |

TABLE 1-continued

| | | | | | | | |
|---|---|---|---|---|---|---|---|
| Comparative Example 4 Contact, Elastic sleeve Pole position regulation without blade bias | 0.980 | 0.96 | 0.25 | Great | Δ→X | Δ | ○ |
| Comparative Example 5 Contact, Elastic sleeve Inter-pole position regulation without blade bias | 0.980 | 0.03 | 0.25 | Small | ○→X | ○ | ○ |
| Comparative Example 6 Magnetic non-contact development Inter-pole position regulation without blade bias | 0.955 | 0.03 | 0.52 | Small | ○→○ | ○ | ○ |
| Comparative Example 7 Magnetic non-contact development Pole position regulation without blade bias | 0.955 | 0.96 | 0.52 | Medium | ○→○ | ○ | ○ |
| Comparative Example 8 Magnetic non-contact development Pole position regulation With blade bias | 0.955 | 0.96 | 0.52 | Medium | ○→○ | ○ | ○ |
| Comparative Example 9 Multi-pole magnet | 0.955 | — | — | Medium | ○→Δ | Δ | Δ |
| Comparative Example 10 Non-magnetic toner | 0.955 | — | — | — | ○○→Δ | X | ○ |
| Comparative Example 11 Non-magnetic toner with blade bias | 0.955 | — | — | — | ○○→○ | X | ○ |
| Comparative Example 12 Non-contact conveying roller | 0.955 | — | — | — | ○→Δ | Δ | ○ |

| | Example 1 of image forming apparatus | | | | |
|---|---|---|---|---|---|
| Embodiments and Comparative Examples | d)uniformity of hair line 100th sheet → 5000th sheet | e)image edge fault | f)solid black density difference | g)halftone image defect 1 | h)ripple wave-shaped image fault (low-temperature low-humidity environment) |
| Embodiment 1 Contact, Elastic sleeve Pole position regulation with blade bias | ○→○ | ○ | ○ | ○ | ○ |
| Embodiment 2 Contact, Elastic sleeve Pole position regulation with blade bias | ○→Δ | ○ | ○ | ○ | ○ |
| Comparative Example 1 Contact, Elastic sleeve Mean degree of circularity low Pole position regulation with blade bias | ○→X | ○ | ○ | ○ | ○ |
| Comparative Example 2 Contact, Elastic sleeve Nsb great Pole position regulation with blade bias | ○→X | ○ | X | ○ | Δ |
| Comparative Example 3 Contact, | ○→○ | ○ | X | ○ | Δ |

TABLE 1-continued

| | | | | | |
|---|---|---|---|---|---|
| Elastic sleeve Inter-pole position regulation with blade bias | | | | | |
| Comparative Example 4 Contact, Elastic sleeve Pole position regulation without blade bias | ○→X | ○ | ○ | ○ | ○ |
| Comparative Example 5 Contact, Elastic sleeve Inter-pole position regulation without blade bias | ○→○ | ○ | ○ | ○ | ○ |
| Comparative Example 6 Magnetic non-contact development Inter-pole position regulation without blade bias | X→X | X | ○ | ○ | ○ |
| Comparative Example 7 Magnetic non-contact development Pole position regulation without blade bias | X→XX | X | ○ | ○ | Δ |
| Comparative Example 8 Magnetic non-contact development Pole position regulation With blade bias | X→XX | X | ○ | ○ | X |
| Comparative Example 9 Multi-pole magnet | X→X | ○ | ○ | ○ | X |
| Comparative Example 10 Non-magnetic toner | ○→○ | ○ | ○ | Δ | ○ |
| Comparative Example 11 Non-magnetic toner with blade bias | ○→○ | ○ | ○ | Δ | ○ |
| Comparative Example 12 Non-contact conveying roller | ○→○ | ○ | X | Δ | X |

TABLE 2

| Embodiments and Comparative Examples | Mean Degree of circularity | \|Br\|/\|B\| | Nsb/(Bs × R) | Magnetic compaction amount (Example 1) | Example 2 of image forming apparatus | | | |
|---|---|---|---|---|---|---|---|---|
| | | | | | A)Cleaner-less collecting property | B)Half-tone image defect 2 | C)Halftone image defect due to paper dust | D)Solid black image defect (high-temperature high-humidity environment) |
| Embodiment 1 Contact, Elastic sleeve Pole position regulation with blade bias | 0.976 | 0.96 | 0.25 | Medium | ○ | ○ | ○ | ○ |
| Embodiment 2 Contact, Elastic sleeve Pole position regulation with blade bias | 0.967 | 0.96 | 0.25 | Medium | ○ | ○ | ○ | ○ |
| Comparative Example 1 Contact, Elastic sleeve, Mean degree of circularity low Pole position regulation with blade bias | 0.955 | 0.96 | 0.25 | Medium | ○ | ○ | ○ | ○ |

TABLE 2-continued

| Embodiments and Comparative Examples | Mean Degree of circularity | \|Br\|/\|B\| | Nsb/(Bs × R) | Magnetic compaction amount (Example 1) | Example 2 of image forming apparatus | | | |
|---|---|---|---|---|---|---|---|---|
| | | | | | A)Cleaner-less collecting property | B)Half-tone image defect 2 | C)Halftone image defect due to paper dust | D)Solid black image defect (high-temperature high-humidity environment) |
| Comparative Example 2 Contact, Elastic sleeve Nsb great Pole position regulation with blade bias | 0.980 | 0.96 | 0.54 | Great | ○ | ○ | Δ | ○ |
| Comparative Example 3 Contact, Elastic sleeve Inter-pole position regulation with blade bias | 0.980 | 0.03 | 0.25 | Small | ○ | ○ | ○ | ○ |
| Comparative Example 4 Contact, Elastic sleeve Pole position regulation without blade bias | 0.980 | 0.96 | 0.25 | Great | ○ | ○ | Δ | ○ |
| Comparative Example 5 Contact, Elastic sleeve Inter-pole position regulation without blade bias | 0.980 | 0.03 | 0.25 | Small | ○ | ○ | ○ | ○ |
| Comparative Example 6 Magnetic non-contact development Inter-pole position regulation without blade bias | 0.955 | 0.03 | 0.52 | Small | X | ○ | ○ | X |
| Comparative Example 7 Magnetic non-contact development Pole position regulation without blade bias | 0.955 | 0.96 | 0.52 | Medium | X | ○ | ○ | X |
| Comparative Example 8 Magnetic non-contact development Pole position regulation with blade bias | 0.955 | 0.96 | 0.52 | Medium | X | ○ | ○ | X |
| Comparative Example 9 Multi-pole magnet | 0.955 | — | — | Medium | Δ | ○ | ○ | ○ |
| Comparative Example 10 Non-magnetic toner | 0.955 | — | — | — | ○ | X | X | ○ |
| Comparative Example 11 Non-magnetic toner with blade bias | 0.955 | — | — | — | ○ | X | X | ○ |
| Comparative Example 12 Non-contact conveying roller | 0.955 | — | — | — | ○ | Δ | X | ○ |

Superiority of Comparative Art

At first, there will be shown the superiority to comparative examples corresponding to the magnetic non-contact developing type and the nonmagnetic contact developing type which are the conventional art.

(1-1) Comparison with the Magnetic Non-contact Developing Type (Comparative Example 6)

In Example 1 of the image forming apparatus, the developing apparatus 60C (FIG. 6) according to Comparative Example 6 which is of the magnetic non-contact developing type causes the occurrence of the lowering of hair line uniformity and an image edge fault. Comparative Example 6 forms a magnetic brush by a magnetic field and effects development, whereby depending on whether the development is in the movement direction of the brush, a difference becomes liable to occur to the hair line uniformity during the development. Also, the distance between the developing sleeve 60*f* and the photosensitive drum 1 is great and by the AC electric field, the toner flies irrespective of the image portion or the non-image portion with a result that the toner is swept up to the edge portion of the image and a density difference occurs between the edge portion and the central portion of the image.

It can be seen that in the evaluation of the cleaner-less system by Example 2 of the image forming apparatus, the toner collecting property is remarkably lowered. This is considered to be because due to being of the non-contact developing type, the force for stripping off the toner contacting with the photosensitive drum is great and the force working for the collection is insufficient.

Also, a solid black image defect occurred. Although in a normal state, the leak by the developing bias does not occur, it has been confirmed that when under a high-temperature and high-humidity environment, a foreign substance such as paper dust comes into between the developing sleeve and the photosensitive drum, leak occurs by way of that.

(1-2) Comparison with the Nonmagnetic Contact Developing Type (Comparative Examples 10 and 11)

Description will now be made of the developing apparatuses 60F and 60G (FIGS. 9 and 10) according to Comparative Examples 10 and 11 which are of the nonmagnetic contact developing type. In Example 1 of the image forming apparatus, Comparative Example 10 causes the deterioration of the endurance to fog. This is attributable to the fact that due to the supplying and stripping operation by the elastic roller 60*k*, the toner receives mechanical stress and the toner charging characteristic is lowered. At this time, a reduction in density by the deterioration of the toner is also seen. On the other hand, in Comparative Example 11, a blade bias is applied and therefore, charges can be imparted to the deteriorated toner lowered in the charging characteristic and thus, the deterioration of the endurance to fog is suppressed. However, the fog immediately before the exhaustion of the toner was aggravated in both of Comparative Examples 10 and 11. The reason is that when the toner in the developing apparatus is decreased, an undeteriorated toner which was not concerned in circulation is mixed with the aforementioned deteriorated toner to thereby remarkably lower the toner charging characteristic, and vehement fog is caused. In the state in which the deteriorated toner and the undeteriorated toner are mixed together, fog is aggravated even if as in Comparative Example 11, a blade bias is applied. Also, in both of Comparative Examples 10 and 11, a toner compact cluster or the like adheres to the elastic roller, and although slightly, a halftone image defect occurs.

On the other hand, in the cleaner-less evaluation by Example 2 of the image forming apparatus, the collecting property is good, but a halftone image defect seeming to be attributable to the elastic roller 60*k* occurs. In Example 1 of the image forming apparatus, the image defect is slight, but in Example 2 of the image forming apparatus, besides the mechanical stress by the elastic roller 60*k*, the toner once used for development is returned into the developing apparatus via the transferring and charging steps, whereby more deteriorated toner is produced and the toner makes a compact cluster to thereby cause a defect to the halftone image. Further, the evil due to the paper dust mixed in the developing apparatus is also great, and such paper dust adheres to the surface of the elastic roller to thereby cause a cyclic image fault.

(1-3) Advantage of the Present Invention over the Conventional Art (1-3a) Example 1 of the Image Forming Apparatus On the other hand, the developing apparatus 60A (FIGS. 1 and 2) according to Embodiment 1 can constitute a good image forming apparatus in both of Examples 1 and 2 of the image forming apparatus. Particularly it uses a spherical toner having a mean degree of circularity of 0.965 or greater and therefore, it is improved in the uniformity of the halftone. That is, the quality of image is improved and the particulate feeling of the quality of image is not conspicuous.

Comparison will first be made with respect to Example 1 of the image forming apparatus.

The hair line uniformity which previously posed a problem in Comparative Example 6 had no difference depending on the direction and uniform image reproduction was possible. The magnetic force in the developing portion is substantially of the same degree, but it has become possible to keep the toner amount coating the developing sleeve and the abutting portion of the regulating blade against the sleeve proper, and to eliminate the influence of the magnetic brush during development because by using a DC bias, the formation of a long magnetic brush is suppressed even in a similar magnetic field. Also, no image edge fault occurred and uniform image reproduction was possible. This is because the developing sleeve 60*b* is brought into contact with the photosensitive drum 1 to thereby effect DC development, whereby the toner is prevented from being swept up, by the reciprocation of the toner.

Also, in Embodiment 1, the deterioration of endurance to fog which posed a problem in Comparative Example 10 was not seen. In Comparative Example 10, use is made of the elastic roller 60*k* for stripping off and supplying the toner and therefore, locally high pressure occurs from the conveyance by the elastic roller 60*k*. On the other hand, the elastic roller 60*k* is not used in Embodiment 1. The conveyance of the toner is effected by a magnetic force. The conveyance by the magnetic force makes the mechanical stress to the toner small, and enables the stripping off and supply of the toner on the developing sleeve 60*b* to be effected. Further, as compared with the elastic roller 60*k*, the force reaches in non-contact, and this is excellent in the range and efficiency of the circulation of the toner. Consequently, the stripping off and supply of the toner can be effected without any stress being applied to the toner, and there is no defect such as ghost and it becomes possible to effect the conveyance of the toner. Therefore, even immediately before the exhaustion of the toner, the deteriorated toner and the undeteriorated toner are not mixed together. As the result, the fog immediately before the exhaustion of the toner which posed a problem in Comparative Examples 10 and 11 does not occur in the present example. Also, likewise, the toner compact cluster does not occur and the halftone image defect 1 is not caused.

(1-3b) Example 2 of the Image Forming Apparatus

Next, evaluation in Example 2 of the image forming apparatus is carried out about Embodiment 1.

Since the developing sleeve 60*b* and the photosensitive drum 1 are disposed in contact with each other, the distance between the developing sleeve 60*b* and the photosensitive drum 1 becomes close, whereby the area in which and the intensity with which the electric field or the magnetic field works increase, and the collecting property of the untransferred toner adhering to the unexposed portion of the photosensitive drum 1 is considered to have been improved, and the toner collecting property was good and further, the influence of the halftone image defect and paper dust seen in Comparative Examples 10 and 11 ended in a good result because the elastic roller 60*k* was eliminated and the conveyance by the magnetic force was effected. The solid black image defect seen in Comparative Example 1 was neither seen. A great electric field is applied as the electric field, and this is considered to be because such a great potential difference as will cause discharge does not occur.

(1-4) Comparison with Comparative Example 9

Also, it is also conceivable to use the multi-pole magnet roll 60*q* as in Comparative Example 9 to improve the stripping off and supplying property by a rotating magnetic force, but the result obtained shows inferiority in ghost performance. Also, the magnetic force vibrates in the regulating portion and the developing portion and therefore, the coat state of the toner layer is unstable with a result that the fog was somewhat bad. Also, since the coat state of the toner layer was unstable, the disturbance of the coat state became more remarkable under a low-temperature and low-humidity environment, and a ripple-shaped image fault occurred. The magnetic force becomes more or less weak by the multi-pole magnet roll 60*q*, but the influence of the magnetic brush remains present, and this example is inferior in hair line uniformity. On the other hand, due to the contact DC development, the image edge fault and the cleaner-less collecting property are improved by the contact of the photosensitive drum.

(1-5) Comparison with Comparative Example 12

Comparative Example 12 is an example in which in contrast with Comparative Example 10, an attempt is made to change the construction of the stripping-off and supplying member to thereby achieve the compatibility of fog and ghost, and the fog immediately before the exhaustion of the toner was somewhat improved, but was insufficient. Also, the fixed stripping off member 60*j* is provided and therefore, this example is inferior particularly in the halftone image defect in Example 2 of the image forming apparatus and the halftone image defect due to paper dust. As regards the image, because of the fixed stripping-off member 60*j*, there is no cyclicity, but yet an image fault incessantly occurred in a streak shape. After printing, the developing apparatus 60H was disassembled with a result that an adhering substance such as paper dust was confirmed on the stripping-off member 60*j*. The reason why the halftone image defect occurred more in Example 2 of the image forming apparatus which is cleaner-less than in the case of Example 1 of the image forming apparatus having the drum cleaner 8 is considered to be that the deterioration of the toner progressed due to the influence of the collected toner or the compaction of the toner was promoted with the foreign substance included in the collected toner as a core, with a result that a compact cluster occurred. Also, a ripple-shaped image fault occurred in the halftone image. Because of the fixed stripping-off member 60*j*, this example is inferior in the place changeability of the toner, as compared with Comparative Example 7. Under a low-temperature and low-humidity environment, the toner having high charges electrically firmly adhered to the surface of the developing roller 60*h* and therefore, this toner cannot be sufficiently stripped off by the fixed stripping-off member 60*j*. Therefore, when the toner in the developing apparatus is supplied onto the toner firmly adhering to the developing roller 60*h*, the toner in the developing apparatus supplied afterwards cannot sufficiently obtain the imparting of charges and thus, it is considered that the coat state became unstable and the ripple-shaped image fault occurred.

(1-6) Comparison with the Other Comparative Examples

Example 1 of the Image Forming Apparatus

At first, comparison is made about Example 1 of the image forming apparatus (with a drum cleaner).

(1-6a) Comparison with Comparative Examples 4 and 5

Comparison will first be made with Comparative Examples 4 and 5 in which the blade bias is not applied.

In Comparative Example 4, in contrast with Embodiment 1, the blade bias is not applied. In a case where the blade bias is not applied, under a high-temperature and high-humidity environment, fog is initially slight, but is aggravated as the number of printed sheets is increased. This is because a proper toner layer thickness and proper charge imparting were not provided by the regulating blade 60*c*. That is, the abutting position of the regulating portion was made into a pole position, whereby relative to the toner conveying amount by the regulating portion, a toner amount capable of being subjected to proper charge imparting was exceeded. Further, because of the regulation at the pole position, high stress was received at a portion whereat the magnetic force was strong and therefore, the magnetic compaction amount increased. Thereby, the charge imparting property of the magnetically compacted toner was aggravated, and the fog was aggravated during the increase in the number of printed sheets. Further, the magnetically compacted toner deficiently subjected to charge imparting coated the developing portion and therefore, tailing occurred and hair line uniformity was aggravated.

Next, Comparative Example 5 is such that the abutting position in Comparative Example 4 was set to between the poles, instead of the pole position. In order to suppress the magnetic compaction and effect proper charge imparting, the abutting position was changed from the pole position to the inter-pole position. The magnetic compaction is suppressed and the charge imparting property is improved and therefore, the hair line uniformity is bettered. However, the fog amount under a high-temperature and high-humidity environment when the number of printed sheets was increased could not be reduced. It is considered that because the developing sleeve 60*b* is urged against the photosensitive drum 1, a fog amount occurs if even a small amount of toner which is not sufficient in the charge imparting property exists. Accordingly, in Comparative Example 5, the magnetic compaction is suppressed and the charge imparting property is improved, whereby fog and hair line uniformity are improved, but the charge imparting property is insufficient and thus, the fog during the increase in the number of endurance sheets under a high-temperature and high-humidity environment cannot be suppressed.

(1-6c) Comparison with Comparative Example 3

Comparison with Comparative Example 3 will now be made. Comparative Example 3, in contrast with Comparative Example 5, is such that a blade bias is applied. By the blade bias being applied, the charge imparting property was also improved to the toner reduced in the charge imparting property to thereby suppress the fog during the increase in the number of printed sheets under a high-temperature and high-humidity environment. However, a remarkable density difference occurred in a solid black image. Specifically, sufficient density was obtained only for the circumferential length of the developing sleeve, and a remarkable density reduction was caused for the second and subsequent circumferential lengths. The reason is considered to be as follows. Use is made of a spherical toner having a mean degree of circularity of 0.965 or greater and therefore, the adhering force thereof to the surface of the developing sleeve is weak. Therefore, if sufficient charge imparting is not effected, the toner cannot pass the regulating blade. Also, the blade bias is applied and therefore, an electrical attraction works between the regulating blade and the developing sleeve. Therefore, the toner cannot pass the regulating blade portion and becomes liable to be repulsed. Particularly, because of the inter-pole regulating position, as regards the magnetic flux density near the abutting portion, a component in a horizontal direction Bθ becomes dominant to the surface of the developing sleeve. In this case, the toner near the regulating portion becomes liable to more in a direction horizontal to the surface of the developing sleeve. That is, when the regulating force by the regulating portion becomes strong, a magnetically resisting force is remarkably reduced, and it becomes difficult for this force to pass through the regulating portion. In addition, a force toward the magnetic pole upstream of the regulating portion works and therefore, it becomes more difficult to pass through the regulating portion. Further, the developing sleeve 60*b* is urged against and brought into contact with the photosensitive drum 1 and the toner is a spherical toner and therefore, the developing efficiency is very high. Therefore, when a solid black image is printed, the toner amount existing on the developing sleeve immediately after development becomes remarkably small and thus, in order to newly replenish the interior of the developer container 60*e* with the toner, a high supplying property becomes necessary. It is considered that in spite of the high supply of the toner in the developing apparatus becoming necessary during the printing of an image of a high printing percentage like a solid black image, solid black density is maintained over only a length corresponding to one revolution of the developing sleeve from the leading edge of the solid black image due to a reduction in the adhering force to the surface of the developing sleeve 60*b*, and an increase in the difficulty with which the toner passes the regulating blade 60*c*, and a density reduction was extremely caused after the second and subsequently revolutions. Also, ghost was aggravated with the aggravation of the supplying property.

(1-6d) About the Evaluation of the Solid Black Density Difference

Embodiment 1 will be compared with Comparative Examples 2, 3, 6 and 11 to thereby describe the advantageous effect of the present embodiment.

First, as previously described, in Comparative Example 3, a remarkable density reduction was caused for the second and subsequent circumferential lengths of the developing sleeve. On the other hand, in Embodiment 1 and Comparative Examples 6 and 11, there is no reduction in the solid black density for the second and subsequent revolutions of the developing sleeve. As regards Comparative Example 6, this is the non-contact developing type and the developing efficiency thereof is as low as 55%, and the toner supplying property from within the developer container 60*e* may be small as compared with the contact developing type and therefore, it is considered that is difficult for a density difference to occur in solid black. This is because provision is made of the elastic roller for stripping off and supplying the toner, and the supply of the toner is appropriately effected. Accordingly, a serious problem was not posed in Comparative Examples 6 and 11 which are the conventional art.

In Embodiment 1, the abutting position of the regulating portion was made into the pole position. By doing so, a magnetic attraction works so as to resist a force working in a direction in which the toner is repulsed near the abutting position by the blade bias and becomes capable of passing through the regulating portion, and is considered to suppress the occurrence of a solid black density difference. Also, a perpendicular magnetic field is dominant and therefore, the horizontal movement of the developing sleeve is suppressed, and the toner is suppressed from being repulsed in the regulating portion. As the result, it becomes easy for the toner to pass the regulating portion, whereby the occurrence of the solid black density difference is remarkably suppressed.

However, a solid black density difference also occurs in Comparative Example 2. The difference of Comparative Example 2 from Embodiment 1 is that in Embodiment 1, $Nsb/(Bs\times R)\leqq 0.5$, whereas in Comparative Example 2, $Nsb/(Bs\times R)>0.5$.

Figure 15B:
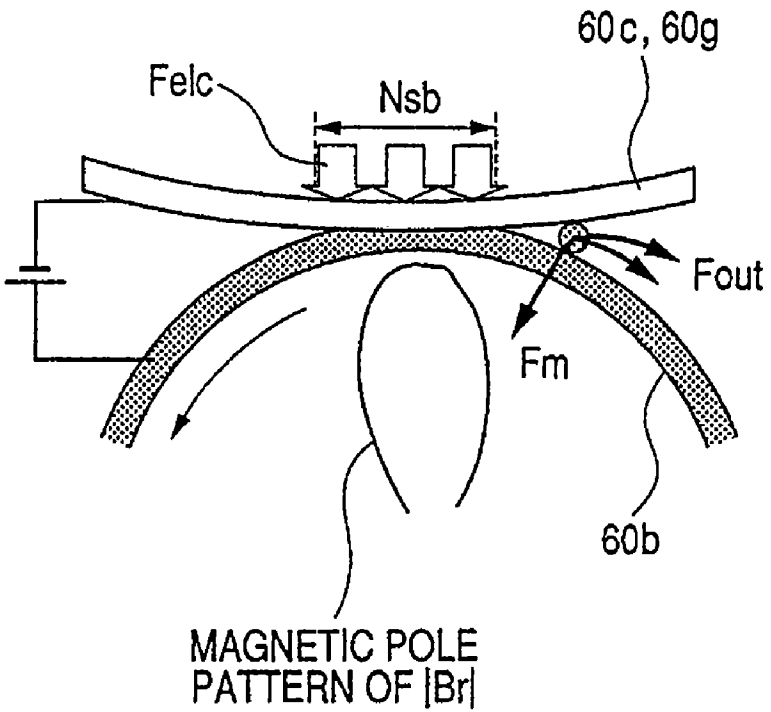
FIGS. 15A and 15B are typical views when Nsb is small and when Nsb is great.
Figure 15A:
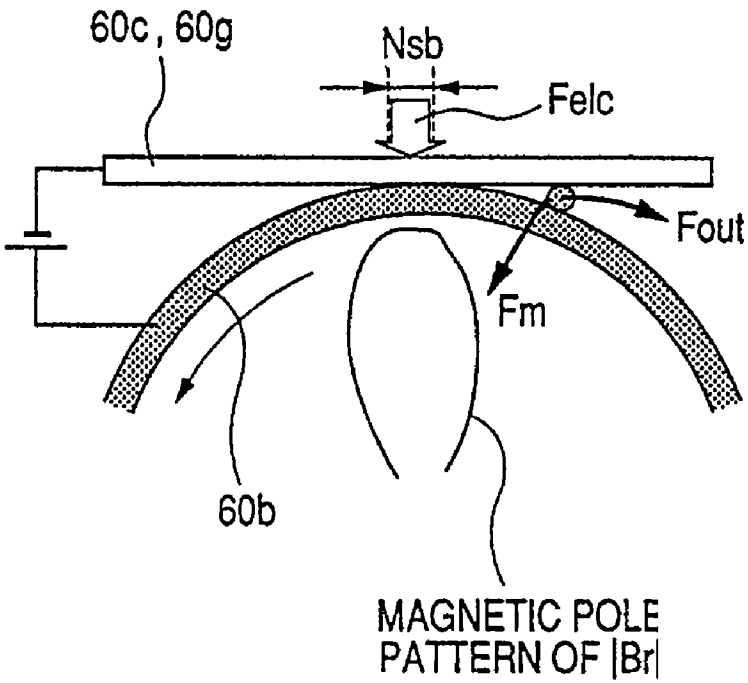

FIGS. 15A and 15B represent typical views when Nsb changed relative to the magnetic pole width. Felc is indicative of an attraction working between the regulating blade 60*c*, 60*g* and the developing sleeve 60*b* during the application of the blade bias. At that time, the ease of escape of the toner is typically shown as Fout. Here, for simplicity, only one particle of the toner is indicated. Also, Fm designates a magnetic attraction working to hold the toner on the surface of the developing sleeve 60*b*.

As shown in FIG. 15B, under such an abutting condition, the nip width between the developing sleeve 60*b* and the regulating blade 60*c* or 60*g* widens, and an area in which the electrical attraction Felc works between the developing sleeve 60*b* and the regulating blade 60*c*, 60*g* due to the application of the blade bias is enlarged, and it becomes difficult for the toner to pass the regulating portion. That is, the ease of escape Fout of the toner increases. In addition, a magnetic brush is formed and therefore, the movement of the toner is limited and therefore, within the range of $Nsb/(Bs\times R)>0.5$, it becomes more difficult to pass the regulating portion.

On the other hand, in Embodiment 1, $Nsb/(Bs\times R)=0.25$ ($\leqq 0.5$). Therefore, this embodiment has no solid black density difference, and is good. As shown in FIG. 15A, the nip width between the developing sleeve 60*b* and the regulating blade 60*c* or 60*g* is narrow and therefore, the area in which Felc in the regulating portion by the application of the blade bias is decreased, and Fout becomes small, thus remarkable suppressing the difficulty with which the toner passes. Further, in the area wherein such a perpendicular magnetic field as in the present invention is dominant, the area in which the magnetic brush is formed and the movement of the toner is limited is remarkably decreased and therefore, it becomes easy for the toner to pass the regulating portion.

Accordingly, it becomes very important that in the area wherein the perpendicular magnetic field is dominant, $Nsb/(Bs\times R)\leqq 0.5$.

As described above, it is because the pole position abutting is adopted and $Nsb/(Bs\times R)\leqq 0.5$ and the ease with which the toner passes the regulating portion is improved that in the present embodiment the solid black density difference is not caused in spite of being the contact developing type, and the absence of the abutting member for stripping off and supplying, and the fact that the blade bias is applied.

(1-6e) About the Aggravation of Hair Line Uniformity Due to the Magnetic Compaction of the Toner Description will hereinafter be made of the faulty image due to an increase in the magnetic compaction amount of the toner. First, Embodiment 1 and Comparative Examples 1 to 6 will be compared with one another about the relation between the magnetic compaction amount and the aggravation of hair line uniformity.

In Embodiment 1 and Comparative Examples 3 and 5, the hair line uniformity is good from the initial stage till the time of increase in the number of printed sheets. In Comparative Example 6, the hair line uniformity is aggravated from the initial stage. The reason is that as previously described, the photosensitive drum 1 and the developing sleeve 60*f* are in non-contact with other and therefore, a magnetic brush by a magnetic field is formed to thereby develop, whereby depending on the movement direction of the brush, a difference becomes liable to occur in the hair line uniformity during development. However, it never happens that the hair line uniformity is further aggravated during the time of increase in the number of printed sheets. The reason is that the regulating blade 60*g* is made to abut at the inter-pole position, and the increase in the magnetic compaction amount is suppressed, and the magnetic compaction amount is not increased when the number of printed sheets is increased. It is considered to be because regulation is effected at the inter-pole position and there is not the earring of the toner (magnetic brush i.e. toner which stands like the ears of rice) in the regulating portion and it is easy for the toner to pass the regulating portion that in spite of Nsb/(Bs×R)>0.5, the magnetic compaction amount does not increase.

Comparative Example 2 differs in Nsb/(Bs×R)>0.5 and the abutting condition at the regulating position from Embodiment 1. During the time of increase in the number of printed sheets, the magnetic compaction amount increases and the hair line uniformity is somewhat lowered. The reason why the magnetic compaction amount increases is considered to be that in the regulating portion, the area receiving stress in a portion wherein the magnetic field is strong has increased.

Comparative Example 1 is an example in which as compared with Embodiment 1, the mean degree of circularity of the toner is low, i.e., 0.955. The magnetic compaction amount is equal to that in Embodiment 1, nevertheless the hair line uniformity is somewhat aggravated. This is considered low and therefore, it is easy for the magnetic brush to be formed.

Also, in Embodiment 1, the magnetic compaction amount is somewhat great, as compared with Comparative Examples 3 and 5. Nevertheless, the hair line uniformity is good. The reason for this is considered to be that by the application of the blade bias, the charge imparting property of the toner is improved to thereby suppress the formation of the ears. Also, when the blade bias is applied, an attraction works between the regulating blade and the developing sleeve and the toner which is not sufficiently subjected to charge imparting encounters a difficulty in passing the regulating portion, and only the toner properly subjected to charge imparting passes the regulating portion. That is, by the blade bias being applied, only the toner properly subjected to charge imparting coats the developing sleeve to thereby suppress the earring in the developing portion, and suppress the lowering of the hair line uniformity. On the other hand, Comparative Example 2 and Comparative Example 4 suffer from a great magnetic compaction amount and are bad in the hair line uniformity. As the difference between Comparative Example 2 and Comparative Example 4, attention is paid to whether the blade bias is applied when a very great magnetic compaction amount has been produced. When a very great magnetic compaction amount is produced, the hair line uniformity is aggravated irrespective of the presence or absence of the application of the blade bias. That is, to suppress the lowering of the hair line uniformity, it is necessary to suppress the magnetic compaction amount of the toner from becoming very great.

Thus, in Embodiment 1, the lowering of the hair line uniformity is suppressed for the following reasons. The developing sleeve 60*b* is urged against and brought into contact with the photosensitive drum 1 to thereby suppress the earring in the developing area. Use is made of a spherical toner having a mean degree of circularity of 0.965 or greater to thereby suppress the formation of the magnetic brush. In spite of the pole position regulation being adopted, the area to which the toner stress in a state in which the earring in the regulating portion has been formed is applied is made as small as Nsb/(Bs×R)≦0.5 to thereby remarkably suppress the magnetic compaction amount of the toner.

Further, even if the magnetic compaction amount is increased by the blade bias being applied, it becomes possible to effect proper charge imparting, and the lowering of the hair line uniformity is suppressed.

(1-6f) About the Aggravation of the Fog Amount Due to the Magnetic Compaction of the Toner Embodiment 1 and Comparative Examples 1 to 7 will now be compared with one another about the relation between the magnetic compaction amount and the aggravation of the fog amount. Embodiment 1 and Comparative Examples 3, 6 and 7 suffer from no increase in the fog amount during the time of increase in the number of printed sheets under a high-temperature and high-humidity environment, and are good. In Comparative Examples 6 and 7, there is not increase in the fog amount irrespective of the magnetic compaction amount. That is, even if the magnetic compaction occurs, the fog is not aggravated in the non-contact developing type.

On the other hand, in Comparative Examples 1, 2 and 4 which are of the contact developing type, the fog amount increases with an increase in the magnetic compaction amount.

From this, it is considered that in a system using a monocomponent magnetic toner, a faulty image in which the fog amount increases with an increase in the magnetic compaction amount of the toner does not occur in the non-contact developing type, but occurs with an increase in the magnetic compaction amount only in the contact developing type.

Description will now be made of the cause of the fog amount increasing when the magnetic compaction occurs. The magnetically compacted toner can be considered to be a toner having an apparently large particle diameter. Generally, a toner having a large particle diameter, as compared with a toner having a small particle diameter, is reduced in the charge imparting property. In addition, the magnetically compacted toner is formed in the shape of a string of beads and therefore, it is difficult for such toner to be subjected to uniform charge imparting, and to obtain proper charge imparting. If the toner coating the developing sleeve while thus remaining not properly subjected to charge imparting is conveyed to the developing portion and contacts with the photosensitive drum, an electrical force becomes small between the surface of the photosensitive drum and the toner, and other force working by contacting such as van der Waals force or a water bridging force than the electrical force becomes relatively great and becomes dominant. As a result, the toner adheres to the surface of the photosensitive drum and the fog amount increases.

From this, it is considered that it is impossible or difficult for such a phenomenon to occur in the conventional non-contact developing type in which the photosensitive drum and the developing sleeve are in non-contact with each other and therefore a serious problem was not posed.

Comparative Example 3 and Embodiment 1 of the contact development did not suffer from an increase in the fog amount resulting from an increase in the magnetic compaction amount, and were good. On the other hand, in Comparative Example 5, the fog amount increased in spite of the magnetic compaction amount being small. Comparative Example 3 and Comparative Example 5 are both small in the magnetic compaction amount. The difference between the two is the difference of whether the blade bias is applied or not. That is, in Comparative Example 5, it is considered that the fog amount was not increased by the magnetic compaction, but was increased as the result of a reduction in the chargeability of the toner caused by the liberation or embedding of the extraneous additive of the toner. Particularly under a high-temperature and high-humidity environment, the fluidity of the toner is lowered and the stress applied to the toner is increased to thereby cause the liberation or embedding of the extraneous additive. As the result, it is considered that the fog amount is increased by the lowering of the charge imparting property due to the high-humidity environment and the deterioration of the toner such as the liberation or embedding of the extraneous additive. On the other hand, in Comparative Example 3, even if the charge imparting property is lowered by the high-humidity environment and the deterioration of the toner, the blade bias is applied and therefore, proper charge imparting is effected and thus, there is no increase in the fog amount.

Also in Embodiment 1, an increase in the fog amount is suppressed even if the magnetic compaction amount is increased. Since the blade bias is applied, charge impacting can be properly effected even to the toner difficult to impart charges like the magnetic compaction and therefore, the fog amount is remarkably suppressed. Also, as described in the previous item, an attraction works between the developing sleeve 60*b* and the regulating blade 60*c* due to the application of the blade bias and the toner which could not be properly subjected to charge imparting cannot pass the regulating portion, and it becomes easy for the toner properly subjected to charge imparting to pass the regulating portion and therefore, it becomes possible to obtain a toner layer having proper charges.

On the other hand, in Comparative Example 2, in spite of the blade bias being applied, the magnetic compaction amount was increased and the fog was aggravated. Comparative Example 2 differs the abutting condition at the regulating position that $Nsb/(Bs \times R) > 0.5$ from Embodiment 1. The reason why the magnetic compaction amount was increased is considered to be that in the regulating portion, the area which receives stress in a portion wherein the magnetic field was strong was increased. On the other hand, in Embodiment 1, in spite of the pole position regulation being adopted, the area to which the toner stress in a state in which the earring in the regulating portion is formed is applied is made as small as $Nsb/(Bs \times R) \leqq 0.5$, whereby the magnetic compaction amount of the toner is remarkably suppressed.

Comparative Example 1 is an example in which the mean degree of circularity of the toner is as low as 0.955, as compared with Embodiment 1. The magnetic compaction amount is equal to that in Embodiment 1, nevertheless the fog amount is aggravated. Since the mean degree of circularity is low, the formation of the magnetic brush is easy, and this example is inferior in the charge imparting property to Embodiment 1. Further, because of the toner being an amorphous toner, another force such as van der Waals force or a water bridging force than an electrical force generated when the toner contacts with the photosensitive drum in the developing portion becomes locally strong, and the fog amount is increased by the toner contacting with the photosensitive drum.

Also, the difference in the mean degree of circularity of the toner affects the transferring property. When as in the present embodiment, the mean degree of circularity is as high as 0.965 or greater, the transferring property is good. That is, the electrical force is dominant, and the toner behaves in accordance with the electric field and the polarity of the charge imparting of the toner. The toner providing the fog is weak in the charge imparting property or has an opposite polarity. Such a toner is inferior in the transferring property to the toner having obtained proper charge imparting in the transferring portion. That is, it is not transferred onto paper, but is liable to be residual on the photosensitive drum. As the result, any increase in the fog amount on the paper can be suppressed. On the other hand, when the mean degree of circularity is lowered, the force working by contacting becomes dominant. That is, such toner is a toner weak in the charge imparting property which is formed as the fog or having an opposite polarity, and is more difficult to transfer than the toner property subjected to charge imparting, but contacts with the paper which is a transfer material, whereby it becomes liable to be transferred onto the paper. As the result, it causes an increase in the fog amount on the paper.

As described above, in the present invention, in spite of the pole position regulation by the regulating blade, the magnetic compaction amount can be suppressed. Further, the increase in the fog amount resulting from the increase in the magnetic compaction amount occurring only in the contact developing type using a magnetic toner can be remarkably suppressed by the application of the blade even if the magnetic compaction amount is increased.

Also, the increase in the fog when the magnetic compaction is increased causes a more serious problem in the cleanerless system which is Example of the image forming apparatus.

The toner on the photosensitive drum 1 is not transferred, but remains as an untransferred toner. In the transfer, a bias of the polarity of the toner is applied and therefore, a toner of the opposite polarity to the toner or small in the charging amount is liable to remain. The toner having such charges reaches the charging roller 2. By receiving discharge here, the toner has charges imparted thereto, and can be collected in the developing portion "a". Also, the toner which was not sufficiently subjected to charge imparting adheres to the charging roller 2, but has charges imparted thereto by the abutting member 10 against the charging roller 2 or by receiving discharge again, and shifts from the charging roller 2 to the photosensitive drum 1, and is collected in the developing portion.

However, if the fog amount is increased when the magnetic compaction amount is increased, the charging roller 2 is remarkably contaminated with the toner. If the toner having caused the magnetic compacting becomes the untransferred toner, such toner, like the toner not magnetically compacted, has a polarity opposite to the polarity of the toner or charges small in the charging amount. If in this state, such toner reaches the charging roller 2 and receives discharge, whereby charges can be imparted thereto, the toner can be collected in the developing portion. However, the magnetically compacted toner is weak in the charge impacting property and therefore, it becomes difficult for such toner to obtain charge imparting sufficient to be capable of being collected or to separate from the charging roller 2. As the result, the toner amount adhering to the charging roller 2 becomes remarkably greater than the toner amount separating from the charging roller 2. Thereby, the charging roller becomes remarkably stained with the toner to thereby cause faulty charging. If further aggravated, charging becomes entirely impossible due to the stains of the charging roller 2, and there arises the serious problem that an entirely black image results and the transfer material P twines around the fixing apparatus 7 to thereby cause a trouble to the apparatus. In the present embodiment, this problem can also be remarkably suppressed.

As described above, in the present invention, the increase in the fog amount during the increase in the magnetic compaction amount which is a problem inherent to the contact developing type using a magnetic toner is suppressed.

Use is made of a spherical toner having a mean degree of circularity of 0.965 or greater to thereby suppress the formation of the pole position regulation being adopted, the area to which the toner stress in a state in which the earring in the regulating portion has been applied is made as small as $Nsb/(Bs \times R) \leqq 0.5$, whereby the magnetic compaction amount is remarkably suppressed. Further, by applying the blade bias, it becomes possible to effect proper charge imparting even if the magnetic compaction amount is increased, and any increase in the fog amount is suppressed. In addition, the toner used is a spherical toner having a mean degree of circularity of 0.965 or greater and therefore, the increase in the fog amount on the paper is remarkably suppressed.

Also, the increase in the fog when the magnetic compaction is increased causes the serious problem that in the cleaner-less system which is Example 2 of the image forming apparatus, charging becomes entirely impossible due to the stains of the charging roller 2, and an entirely black image results and the transfer material P twines around the fixing apparatus 7 to thereby cause a trouble to the apparatus, but this problem is remarkably suppressed.

(1-6g) Comparison with Comparative Example 8

Comparative Example 8 is an example in which in contrast with Comparative Example 7, a blade bias is applied. Because it is of the non-contact developing type, Comparative Example 8, like Comparative Examples 6 and 7 is bad in the uniformity of thin line by tailing. Under a low-temperature and low-humidity environment, a ripple-shaped image fault occurs. First, the mirror image force between the surface of the developing sleeve 60*f* which is a metal sleeve and the toner heightens. Further, the charge imparting property of the toner is improved by the blade bias and therefore, the mirror image force becomes greater. As a result, it becomes impossible for the toner to obtain proper charge imparting even if a toner is supplied from the developing apparatus 60D onto the toner electrostatically firmly adhering to the surface of the developing sleeve 60*f*. That is, an unstable toner layer is formed, and a ripple-shaped image fault is formed.

On the other hand, in Embodiment 1, the ripple-shaped image fault does not occur, and this embodiment is good. Since the developing sleeve 60*b* has the elastic layer 60*b*2 and use is made of a spherical toner having a mean degree of circularity of 0.965 or greater, the mirror image force is weak. Therefore, even if the blade bias is applied, the toner does not firmly adhere to the developing sleeve 60*b*.

(1-7) Comparison with the Other Comparative Example

Example 2 of the Image Forming Apparatus

Comparison will now be made about Example 2 of the image forming apparatus (Cleaner-less System).

(1-7a) Cleaner-less Collecting Property and Solid Black Image Fault

About the toner collecting property in the cleaner-less system, Comparative Examples 6, 7 and 8 which are of the non-contact developing type were bad in the collecting property, while on the other hand, Embodiments 1 and 2 and Comparative Examples 1 to 5 and 10 to 12 were good because of the contact development. However, in Comparative Example 9 which is of the contact developing type, although slightly, a reduction in the collecting property was somewhat seen. It is also conceivable to use a multi-pole magnet roll to improve the supplying and stripping-off property by a rotating magnetic force, but the magnetic force vibrates in the regulating portion and the developing portion and therefore, the toner layer is unstable and thus, the collecting property is considered to have been reduced. About the solid black image fault, because of the non-contact development being adopted and an AC voltage being superimposed upon a developing bias, the leak due to paper dust occurs and a solid black image fault occurs. On the other hand, in Embodiments 1 and 2 and Comparative Examples 1 to 5 and 9 to 12, neither the leak due to paper dust nor the solid black image fault occurred, but a good image was obtained.

(1-7b) Halftone Image Defect 2 and Halftone Image Defect Due to Paper Dust

About the halftone image defect 2, Embodiments 1 and 2 and Comparative Examples 1 to 9 were good. On the other hand, in Comparative Examples 10 and 11, the elastic roller 60*k* for stripping off and supplying the toner is brought into contact with the developing roller 60*h* and is counter-rotated with the developing roller 60*h* and therefore, the toner receives stress and the compact cluster of the toner is liable to occur. Further, because of the cleaner-less system being adopted, the untransferred toner is collected and therefore, the toner is more liable to be deteriorated. Thus, a compact cluster becomes liable to be produced, and it is considered that in Example 2 of the image forming apparatus, the halftone image defect was aggravated. In Comparative Example 12, because of the fixed abutting member 60*j* being adopted, the stress applied to the toner was reduced, thus resulting in a slight image fault. From what has been described above, again in the cleaner-less system according to the present embodiment, the stress received by the toner is low and therefore, it is difficult for the compact cluster of the toner to occur.

Description will now be made of the halftone image defect due to paper dust.

In Comparative Examples 10 to 12 which caused a halftone image defect 2, a halftone image defect due to paper dust occurred. The reason for this is considered to be due to paper dust mixed in the developing device, and it is considered that the paper dust adhered to the surface of the elastic roller to thereby cause a cyclic image fault, or adhered to the abutting member to thereby cause a streak-like image fault.

Description will now be made of Embodiments 1 and 2 and Comparative Examples 3 to 8 which did not cause the halftone image defect 2. Comparative Examples 3, 5 and 6 which adopt the inter-pole position regulation by the regulating blade were good. This is considered to be because the inter-pole position regulation is adopted and therefore, the toner has a good property of changing places and thus, the influence of the paper dust is small.

On the other hand, in Comparative Example 4 adopting the pole position regulation by the regulating blade, although slightly, the halftone image defect due to paper dust occurred. The reason for this is that because of the pole position regulation, the property of the toner changing places near the regulating portion is lowered, and when the paper dust gets mixed in that area, the toner coat is disturbed and therefore, the halftone image defect due to the paper dust occurs.

In Embodiments 1 and 2, however, in spite of the pole position regulation being adopted, the halftone image defect due to paper dust did not occur, and these embodiments are good. The reason for this is that the blade bias is applied and therefore, the toner near the regulating portion becomes liable to escape from the regulating portion with a result that the property of changing places is improved and the toner coat layer is suppressed from being disturbed by the paper dust.

Also, in Comparative Examples 7 and 8, in spite of the pole position regulation being adopted, the halftone image defect due to paper dust does not occur. The reason for this will be set forth below. Comparative Examples 7 and 8, which are of the non-contact developing type, are bad in the collecting property. Therefore, the amount of collected toner is small and thus, the collected amount of paper dust included in the collected toner is also small, and the amount of paper dust getting mixed in the developing device is small. As the result, in spite of the pole position regulation, the halftone image defect due to the paper dust does not occur.

From what has been described above, in the present invention, because the pole position regulation is adopted and the collecting property is high, the toner coat layer is much affected and disturbed by the paper dust, and the halftone image defect is liable to occur, nevertheless the blade bias is applied to thereby improve the property of the toner changing places, whereby a good halftone image can be obtained.

(1-8) Effects of Embodiments 1 and 2

Thus, the effect of Embodiments 1 and 2 is that in Example 1 of the image forming apparatus, the suppression of the fog amount, the suppression of the fog amount during the exhaustion of the toner, the suppression of the ghost, the suppression of the image edge fault, the suppression of the halftone image defect 1 and the suppression of the ripple-shaped image fault can be effected well-balancedly.

Further, the developing sleeve 60*b* is urged against the photosensitive drum 1, the spherical toner is used and the blade bias is applied, to thereby remarkably suppress a density reduction occurring for the second and subsequent revolutions of the solid black developing sleeve.

Also, the magnetic compaction amount of the toner is suppressed during the increase in the number of printed sheets under a high-temperature and high-humidity environment. Further, even if the magnetic compaction is produced, it is made easy for only the toner property subjected to charge imparting to pass the regulating portion.

Thereby, earring i.e. magnetic brush can be suppressed to thereby maintain the hair line uniformity.

Further, when the magnetic compaction occurs, the increase in the fog amount occurring because of the contact developing type is suppressed from remarkably appearing.

Further, the developing apparatus of the present invention is also effective in an image recording apparatus using a toner recycle system which is Example 2 of the image forming apparatus, and is effective for the cleaner-less collecting property, the halftone image defect 2, the halftone image defect due to the paper dust, the solid black image fault, and the like. Particularly, in the cleaner-less system, when an increase in the fog amount due to the magnetic compaction occurs, charging becomes entirely impossible due to the stains of the charging roller, thus resulting in an entirely black image, and the transfer material may twine around the fixing apparatus to thereby cause a trouble to the apparatus, but this can be remarkably suppressed in the present invention.

Also, when as in Embodiment 1, the mean degree of circularity is 0.970 or greater, the above-described effects can be stably obtained.

[About the Range of the Relation among the Regulation Position, the Regulating Portion Abutting Width and the Magnetic Poles]

Description will hereinafter be made of the relation between the abutting position of the regulating blade 60*c* against the developing sleeve 60*b* and the magnetic poles (the range of 0 to 45 in FIG. 3, and the range of Nsb/(Bs×R). While only the range of 0 to 45 degrees in FIG. 3 is described here, the present invention depends on the value of |Br|/|B| also at −45 to 0 degree and 45 to 135 degrees, and the effects of the present invention are also had at −45 to 0 degree and 45 to 135 degrees. Further, again in a case where use is made of a magnet roll having a different magnetic pole arrangement, the present invention depends on the value of |Br|/|B|, and the effects of the present invention are bad irrespective of the magnet roll.

(1) Embodiments 3, 4, 5, 6, 7, 8, 9 and 10

Embodiments 3 to 10 basically conform to the developing apparatus 60A according to Embodiment 1, but differ in the following points from one another.

In FIG. 3, the abutting position θ of the regulating blade 60*c* is defined as 12 degrees, 12 degrees, 16 degrees, 9 degrees, 26 degrees, 22 degrees, 19 degrees and 26 degrees in Embodiments 3 to 10, respectively. In this case, |Br|/|B| becomes 0.88, 0.88, 0.80, 0.93, 0.52, 0.65, 0.72 and 0.52, respectively.

Also, the microhardness of the surface of the developing sleeve is defined as 59 degrees, 51 degrees, 51 degrees, 59 degrees, 59 degrees, 72 degrees, 72 degrees and 51 degrees, respectively, and the microhardness of the surface of the regulating blade is defined as 100 degrees, 72 degrees, 80 degrees, 80 degrees, 100 degrees, 100 degrees, 100 degrees and 72 degrees, respectively.

Here, the regulating blades 60*c* used having the microhardness of 100 degrees are formed of phosphor bronze, and each of the other regulating blades comprises an electrically conductive layer having a thickness of 50 μm formed on the surface of urethane having a thickness of 1.5 mm, and methods of manufacturing them conform to Comparative Example 2. Also, the blade bias was directly applied to the electrically conductive layer. Also, the drawing pressure between the regulating blade and the developing sleeve was 60 N/m, 60 N/m, 60 N/m, 60 N/m, 45 N/m, 50 N/m, 55 N/m and 50 N/m, respectively.

The nip width Nsb between the regulating blade 60*c* and the developing sleeve 60*b* at this time was 1.5 mm, 2.9 mm, 2.4 mm, 2.0 mm, 1.5 mm, 1.0 mm, 1.0 mm and 2.9 mm, respectively, and Nsb/(Bs×R) was 0.25, 0.49, 0.41, 0.34, 0.25, 0.17, 0.17, 0.49, 0.54, 0.17 and 0.54, respectively.

(2) Comparative Examples 13, 14 and 15

Comparative Examples 13 to 15 basically conform to the developing apparatus 60A described in Embodiment 1, but differ in the following points from one another.

In FIG. 3, the abutting position e of the regulating blade is defined as 9 degrees, 28 degrees and 28 degrees in Comparative Examples 13 to 15, respectively. In this case, |Br|/|B| becomes 0.93, 0.46 and 0.46, respectively.

Also, the microhardness of the surface of the sleeve is defined as 51 degrees, 72 degrees and 51 degrees, respectively, and the microhardness of the surface of the regulating blade is defined as 58 degrees, 100 degrees and 58 degrees, respectively.

Here, the regulating blade 60*c* used comprises an electrically conductive layer having a thickness of 50 μm formed on the surface of urethane having a thickness of 1.5 mm, and a method of manufacturing the same conforms to Comparative Example 2. Also, the blade bias was directly applied to the electrically conductive layer. Also, the drawing pressure between the regulating blade 60*c* and the developing sleeve 60*b* was 60 N/m, 60 N/m, 60 N/m, 60 N/m, 45 N/m, 50 N/m, 55 N/m and 50 N/m, respectively.

The nip width Nsb between the regulating blade 60*c* and the developing sleeve 60*b* at this time is 3.2 mm, 1.0 mm and 3.2 mm, respectively, and Nsb/(Bs×R) is 0.54, 0.17 and 0.54, respectively.

(3) Method of Evaluating Embodiments 3 to 10 and Comparative Examples 13 to 15

In Example 1 of the image forming apparatus, there was carried out the image evaluation by the aforedescribed a) fog evaluation, d) hair line uniformity and f) solid black density difference. The result is shown in Table 3 below.

TABLE 3

| Embodiments and Comparative Examples | \|Br\|/\|B\| | Nsb/(Bs × R) | f)Solid black density difference | d)hair line uniformity | a)fog (5,000th sheet) |
|---|---|---|---|---|---|
| Embodiment 3 | 0.88 | 0.25 | ○ | ○ | ○ |
| Embodiment 4 | 0.88 | 0.49 | Δ | Δ | ○ |
| Embodiment 5 | 0.80 | 0.41 | Δ | Δ | ○ |
| Embodiment 6 | 0.93 | 0.34 | ○ | ○ | ○ |
| Embodiment 7 | 0.52 | 0.25 | Δ | ○ | ○ |
| Embodiment 8 | 0.65 | 0.17 | Δ | ○ | ○ |
| Embodiment 9 | 0.72 | 0.17 | ○ | ○ | ○ |
| Embodiment 10 | 0.52 | 0.49 | Δ | Δ | ○ |
| Comparative Example 13 | 0.93 | 0.54 | X | X | X |
| Comparative Example 14 | 0.46 | 0.17 | X | ○ | ○ |
| Comparative Example 15 | 0.46 | 0.54 | X | X | X |

The superiority of the present invention will hereinafter be shown in the relation between the abutting position of the regulating blade against the elastic sleeve and the magnetic poles and the range of Nsb/(Bs×R). Specifically, Embodiments 3 to 10 and Comparative Examples 13 to 15 will be described.

(3-1) f) About the Solid Black Density Difference Evaluation

Figure 16:
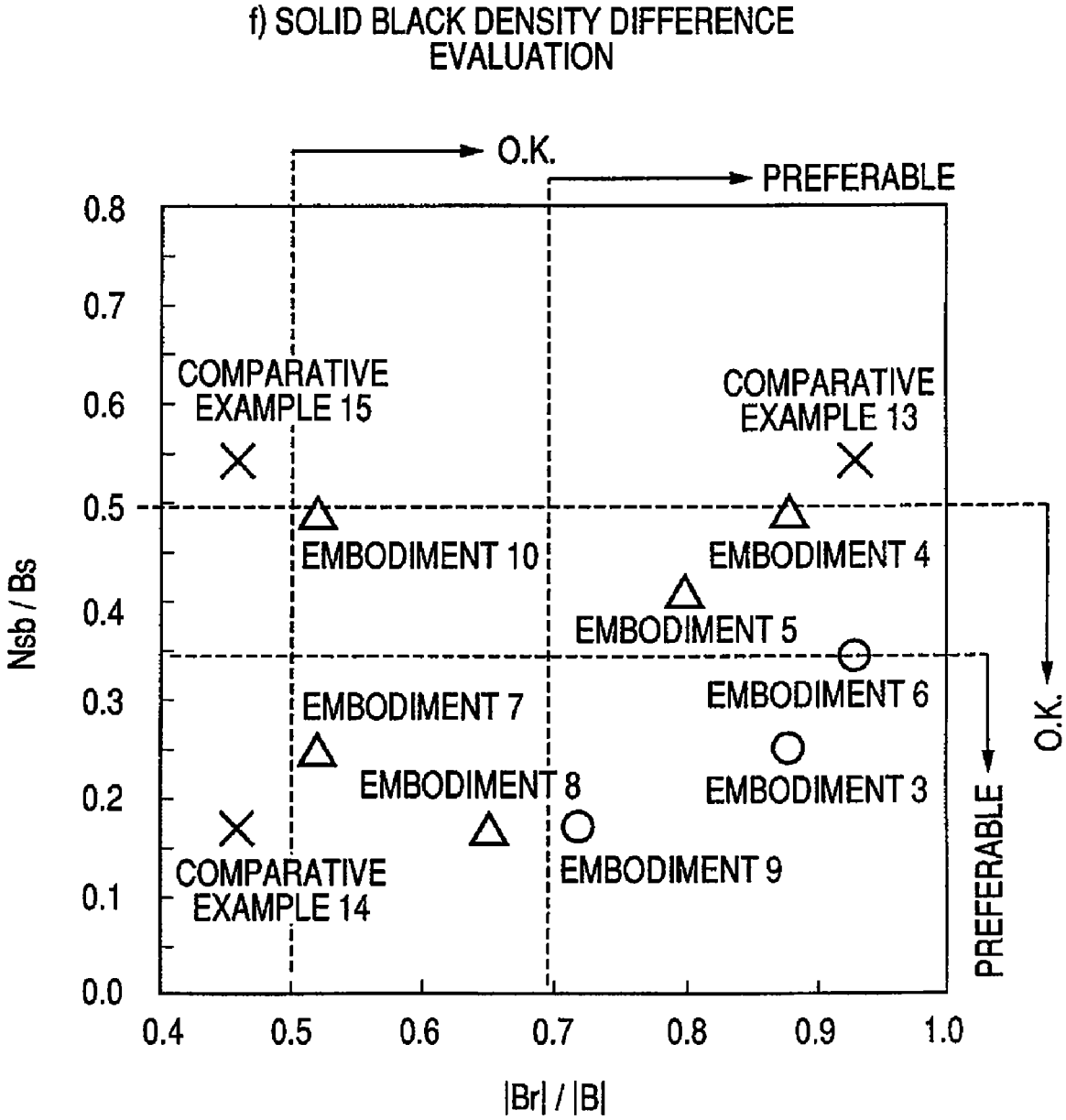
FIG. 16 is a graph of the result of the evaluation of solid black density difference.

First, FIG. 16 shows the result of the evaluation about f) the solid black density difference evaluation for the first circumferential length and the second and subsequent circumferential lengths of the developer carrying member.

As can be seen from Comparative Examples 14 and 15 shown in FIG. 16, the solid black density differences for the first circumferential length and the second and subsequent circumferential lengths of the developer carrying member became great in the range of $|Br|/|B|<0.5$. Description will first be made of a factor for which such density differences as in Comparative Examples 14 and 15 occur. In Comparative Examples 14 and 15, use is made of a spherical toner having a mean degree of circularity of 0.980, and the developing sleeve 60*b* is urged against and brought into contact with the photosensitive drum 1. Thereby, the developing efficiency becomes high, and after images of a high print rate have been printed, it is necessary to supply a greater toner amount quickly. Also, use is not made of an elastic roller for effecting supply, but the toner is magnetically supplied by the magnet roll 60*a* in the developing sleeve 60*b* and therefore, the supplying property is made more difficult. Further, by the blade bias being applied, a solid black density difference is liable to occur. During the application of the blade bias, an electrical attraction works between the surface of the developing sleeve 60*b* and the regulating blade 60*c*, and it becomes difficult for the toner to pass the regulating portion. Particularly, when a spherical toner is used, the adhering force thereof to the surface of the developing sleeve 60*b* becomes small and therefore, the passage of the toner through the regulating portion is more suppressed. On the other hand, as shown in FIG. 16, in Embodiments 7, 8 and 10, the range of $|Br|/|B|\geqq 0.5$ is adopted, whereby the solid black density difference for the first circumferential length and the second and subsequent circumferential lengths of the developer carrying member became small, and was bettered. Further, as in Embodiment 9, $|Br|/|B|\geqq 0.7$ is adopted, whereby a good image was obtained without any density difference. The reason for this is that the abutting portion of the regulating blade is restricted to an area in which a perpendicular magnetic field is dominant, i.e., the range of $|Br|/|B|\geqq 0.5$ and more preferably the range of $|Br|/|B|\geqq 0.7$, to thereby improve a restraining force for holding the toner in the regulating portion on the surface of the developing sleeve, with a result that it becomes possible to effect supply sufficiently, and the solid black density difference is made small.

Accordingly, in the present embodiment, to suppress the image fault due to the solid black density difference for the first circumferential length of the developer carrying member, it is preferable to restrict the abutting position of the regulating blade to $|Br|/|B|\geqq 0.5$, and more preferably to $|Br|/|B|\geqq 0.7$.

However, in Comparative Example 13, the abutting portion of the regulating blade is set to the range of $|Br|/|B|\geqq 0.5$, and more preferably to the range of $|Br|/|B|\geqq 0.7$, nevertheless a density difference occurred. That is, simply by setting the abutting position of the regulating blade 60*c* to $|Br|/|B|\geqq 0.5$, it is impossible to suppress the image fault due to the solid black density difference for the first circumferential length and the second and subsequent circumferential lengths of the developer carrying member. In Embodiments 4 and 5, the range of the ratio Nsb/(Bs×R) of the nip width of the developing sleeve contacting with the elastic sleeve to a half-value width of |Br| of the nearest magnetic pole was defined as Nsb/(Bs×R)≦0.5, whereby the density difference was made small to thereby suppress the image fault. Further, in Embodiments 3 and 6, Nsb/(Bs×R)≦0.35 was adopted, whereby there was obtained a good image without any solid black density difference.

The reason for this is that |Br|/|B|≧0.5 and in the range of Nsb/(Bs×R)>0.5, the passage of the toner in the regulating portion is suppressed. Specifically, in an area wherein a perpendicular magnetic field is dominant, the toner is liable to cause earring (to be made into a magnetic brush) near the regulating portion. However, in order that the toner may pass the regulating portion while causing earring, the nip width is wide as compared with the magnetic pole width and therefore, it is remarkably difficult for the toner to pass. Particularly, the blade bias is applied and the electrical attraction is working between the developing sleeve and the regulating blade and therefore, the ease of the passage of the toner is remarkably reduced. As the result, the toner supply for the second and subsequent circumferential length cannot be sufficiently effected, and a density difference occurs. On the other hand, in the present embodiment, by adopting the range of Nsb/(Bs×R)≦0.5, and more preferably the range of Nsb/(Bs×R)≦0.35, it is possible to effect the supply of the toner well without receiving the influence of the reduction in the ease of the passage of the toner in the regulating portion which is caused by the magnetic brush of the toner. Further, in the problem that by the application of the blade bias, the electrical attraction works between the developing sleeve and the regulating blade, whereby it becomes difficult for the toner to pass, the area in which the attraction works becomes sufficiently small, whereby there can be obtained a good image free of any solid black density difference.

From what has been described above, for the suppression of the image fault due to the solid black density difference for the first circumferential length and the second and subsequent circumferential lengths of the developer carrying member, the abutting position of the regulating blade is set to |Br|/|B|≧0.5, and more preferably to |Br|/|B|≧0.7, and the nip width between the developing sleeve and the regulating blade is set to the range of Nsb/(Bs×R)≦0.5, and more preferably to the range of Nsb/(Bs×R)≦0.35.

(3-2) About the Evaluation of the Hair Line Uniformity

Figure 17:
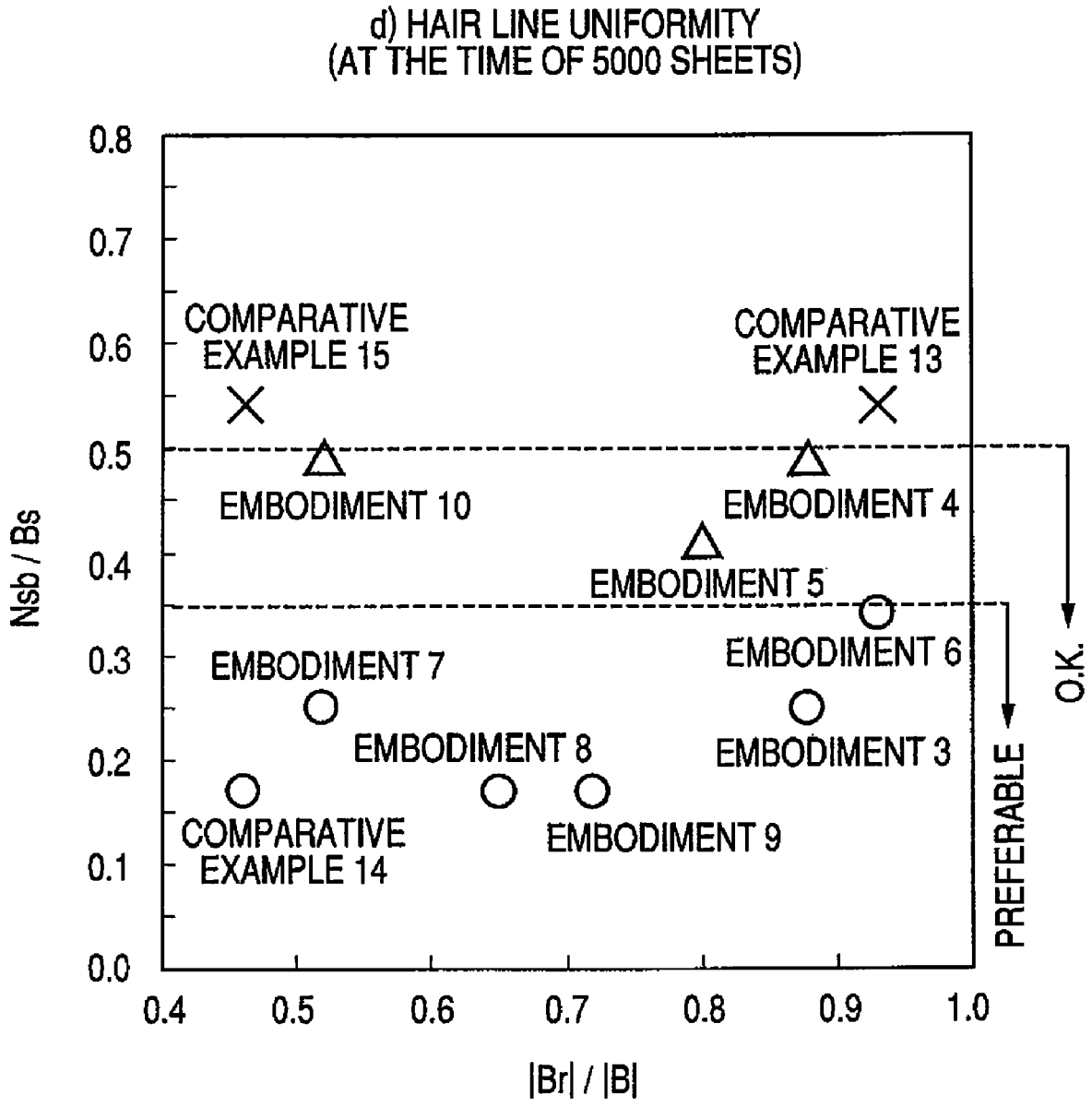
FIG. 17 is a graph of the result of the evaluation of hair line uniformity.

Description will now be made of the evaluation of the hair line uniformity which is a problem caused by an increase in the magnetic compaction amount. The result is shown in FIG. 17.

When as in Comparative Examples 13 and 15, the nip width is in the range of Nsb/(Bs×R)>0.5, the hair line uniformity is aggravated. On the other hand, in Embodiments 4, 5 and 10, Nsb/(Bs×R)≦0.5 is adopted. Further, in Embodiments 3 and 6 to 9, Nsb/(Bs×R)≦0.35 is adopted. The reason for this is considered to be that in Nsb/(Bs×R)≦0.5, any increase in the magnetic compaction amount is suppressed.

More particularly, the reason can be considered as follows. In the area wherein the perpendicular magnetic field is dominant, the toner receives strong stress under a strong magnetic field and therefore is liable to cause magnetic compaction. However, by Nsb/(Bs×R)≦0.5 being adopted, the area in which the toner receives strong stress under the strong magnetic field is sufficiently narrowed to thereby suppress any increase in the magnetic compaction amount. Also, by the blade bias being applied, an electrical attraction works between the developing sleeve and the regulating blade. Thereby, the toner upstream of the abutting position of the regulating blade (immediately before the passage through the regulating portion) becomes liable to escape from the abutting position. As the result, the same toner can be suppressed from stagnating in the upstream portion of the abutting position, to thereby suppress the magnetic compaction. Also, by the blade bias being applied, charges can be imparted to the magnetically compacted toner in the shape of a string of beads to which it is difficult to impart charges.

Thereby, even if the magnetic compaction occurs, the toner coats the developing sleeve by the electrical force and therefore, it becomes difficult for the toner to form a magnetic brush in the developing portion, and the hair line uniformity can be maintained.

From what has been described above, in the present embodiment, even in the area wherein the perpendicular magnetic field is dominant, the increase in the magnetic compaction amount can be remarkably suppressed and further, even if the magnetic compaction amount is increased, the hair line uniformity can be improved.

(3-3) a) About the Fog Amount Evaluation

Description will be further made of the fog amount evaluation during an increase in the number of printed sheets under a high-temperature and high-humidity environment which is a problem arising in the contact developing type when the magnetic compaction is increased.

Figure 18:
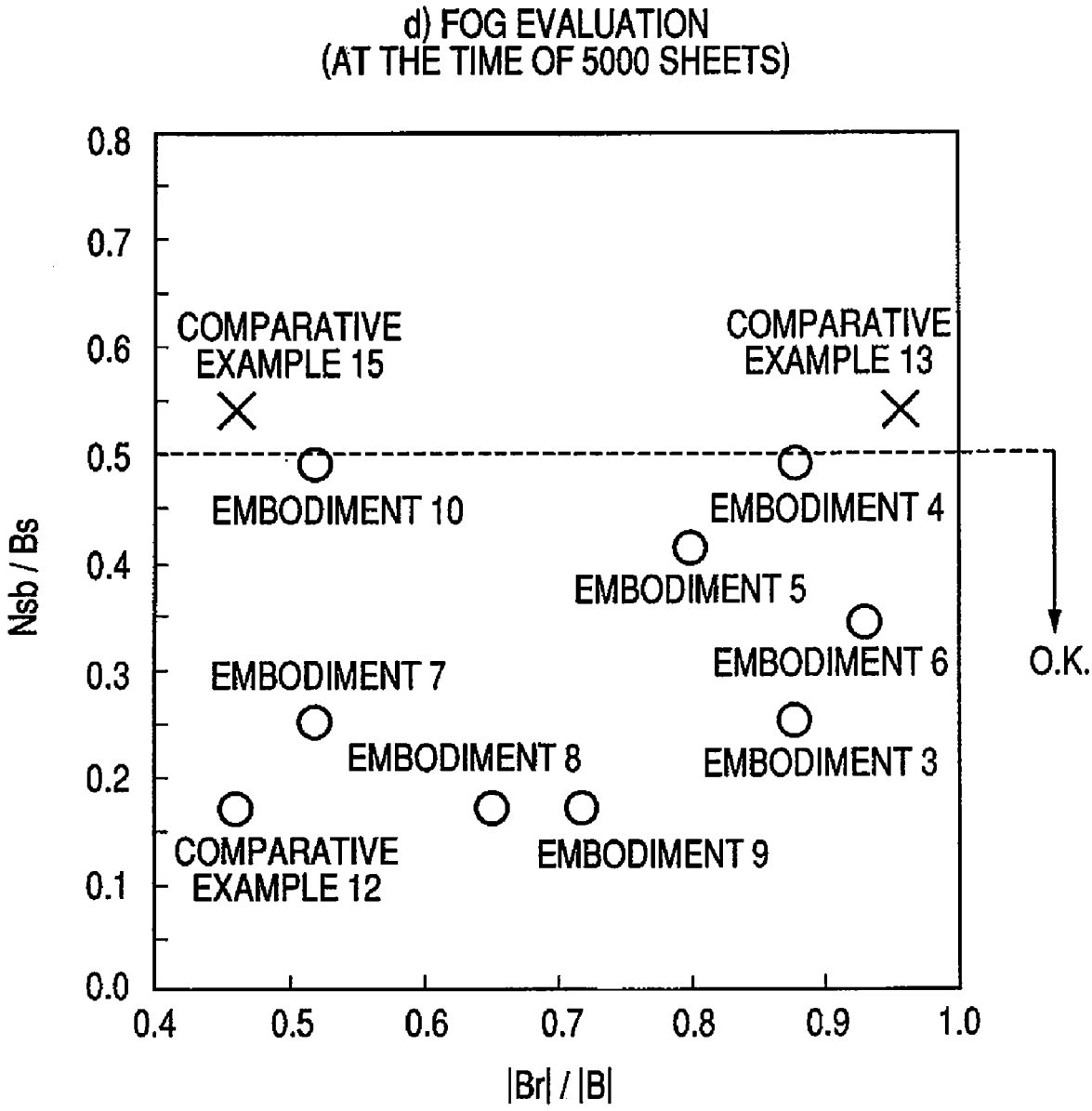
FIG. 18 is a graph of the result of the evaluation of fog.

As in the preceding item, it is considered that the fog amount is aggravated with an increase in the magnetic compaction amount. As shown in FIG. 18, the fog amount is aggravated in Comparative Examples 13 and 15 wherein Nsb/(Bs×R)>0.5 and the magnetic compaction amount is great.

On the other hand, in Embodiments 3 to 10 and Comparative Example 12 wherein Nsb/(Bs×R)≦0.5, the fog amount is good. The reason for this is that as in the preceding item, the magnetic compaction amount is suppressed, and even if the magnetic compaction amount is increased, the toner properly subjected to charge imparting passes the regulating portion and therefore, the fog amount can be remarkably suppressed.

As described above, the present invention can remarkably suppress any increase in the magnetic compaction amount even in the area wherein the perpendicular magnetic field is dominant, and further, can suppress the fog amount during an increase in the number of printed sheets under a high-temperature and high-humidity environment even if the magnetic compaction amount is increased.

(3-4) Overall Evaluation

Figure 19:
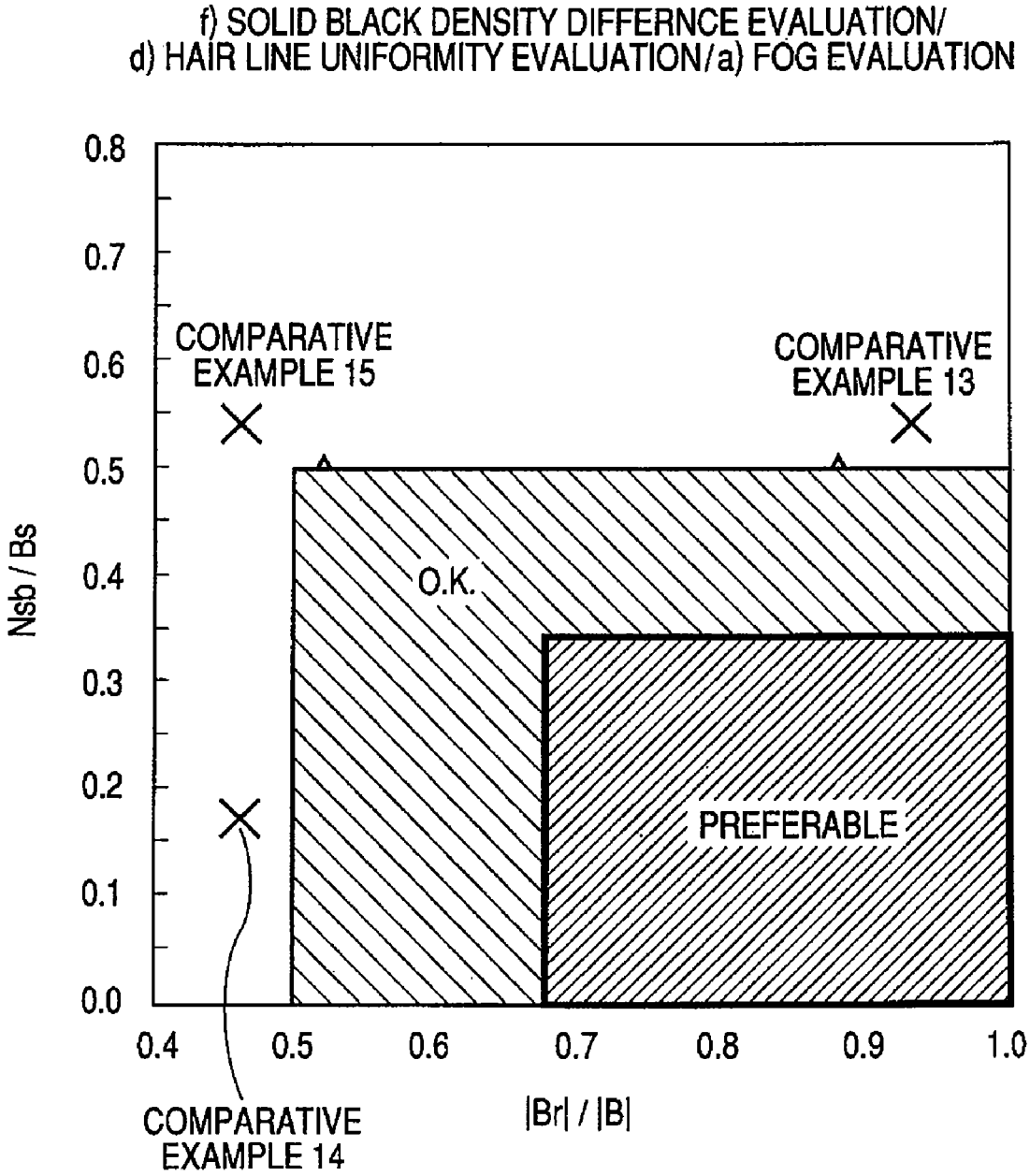
FIG. 19 is a graph of the result of overall evaluation.

Summing up about Embodiments 3 to 10 and Comparative Examples 13 to 15, as shown in FIG. 19, the abutting position of the regulating blade 60*c* may preferably be |Br|/|B|≧0.5, and more preferably be |Br|/|B|≧0.7. Further, the abutting condition of the regulating portion may preferably be within the range of Nsb/(Bs×R)≦0.5, Nsb/(Bs×R)≦0.35. At |Br|/|B|≧0.7 and Nsb/(Bs×R)≦0.35, all image evaluations are stably good.

In the range of |Br|/|B|<0.5, the toner is a spherical toner, and by the application of the blade bias, it become remarkably difficult for the toner to pass the regulating portion. Further, the spherical toner is used and the developing sleeve 60*b* is urged against and brought into contact with the photosensitive drum 1 and therefore, the developing efficiency is high and thus, when the toner is consumed at a high printing rate, the residual toner on the developing sleeve 60*b* after development is extremely decreased. In this state, it is necessary to supply the toner onto the developing sleeve 60*b*, but if it is difficult for the toner to pass the regulating portion, a density difference will occur to the solid black.

In the range of Nsb/(Bs×R)>0.5, the magnetic compaction amount is remarkably increased, and the lowering of the hair line uniformity and the aggravation of the fog occur. Particularly, an increase in the fog amount resulting from the increase in the magnetic compaction which poses a serious problem in the cleaner-less system occurs.

In the present embodiment, in order to suppress the image fault due to the solid black density difference, the abutting position of the regulating blade was set to |Br|/|B|≧0.5, and more preferably to |Br|/|B|≧0.7. However, when the regulating blade abuts in the area wherein the perpendicular magnetic field is dominant, a toner magnetically compacted in the shape of a string of beads becomes liable to be produced. That is, the suppression of the production of the magnetically compacted toner and the suppression of the solid black density difference have been matters contrary to each other.

In the present embodiment, however, the abutting condition of the regulating blade 60*c* is set to the range of Nsb/(Bs×R)≦0.5, and preferably to the range of Nsb/(Bs×R)≦0.35, and the blade bias is applied to the regulating blade 60*c* whereby the magnetic compaction amount of the toner can be remarkably decreased. Further, even if the magnetic compaction amount of the toner is increased, the lowering of the hair line uniformity attributable to the magnetic compaction and any increase in the fog amount can be remarkably suppressed. That is, the compatibility of the suppression of the image fault due to the solid black density difference and the suppression of the image fault (hair line uniformity and fog) due to the production of the magnetically compacted toner can be achieved.

As described above, in the present embodiment, the contrary problems of the lowering of the hair line uniformity and the increase in the fog amount due to the reduction in the density for the second and subsequent circumferential lengths of the solid black developing sleeve and the increase in the magnetic compaction amount of the toner can be solved and be made compatible.

Embodiment When an AC Voltage is Applied as the Developing Bias

Description will now be made of Embodiment 11 when an AC voltage is applied as the developing bias.

This Embodiment 11 is characterized in that the voltage applied between the developer amount regulating means and the developer carrying member through the developer is a voltage comprising a DC bias and an alternating bias superimposed one upon the other, and is of the polarity side of the aforedescribed developer.

In Embodiment 11, the specification of the developing bias applying voltage source S2 in the developing apparatus 60A according to Embodiment 1 was changed, and an AC voltage (1.2 kHz, rectangular wave, peak-to-peak voltage of 200 V) which is an alternating bias was superimposed upon a DC voltage of −450V and was applied.

As a specific example, DC (−450V)+AC (Vpp200V) is applied to the developing sleeve, and DC (−550V) is applied as the blade bias. As the result, the voltage between the developing sleeve and the regulating blade assumes a form in which the DC component generates a potential difference of 100 V in terms of a DC value and an AC voltage is also superimposed at the same time.

Embodiment 11 is an example in which in contrast with Embodiment 1, an AC bias is superimposed, and by AC being applied, the fog is somewhat imposed as compared with Embodiment 1. Particularly, in the measurement of the fog on the photosensitive drum after development, a more distinct difference was seen, and the effect that a certain degree of AC bias reduces the fog was seen. Also, by AC being applied, even in the case of the developing sleeve 60*c* having a defect due to the adherence of a foreign substance or the like, the defective region does not appear in an image, and a wide margin can be secured for the reproduction of the halftone. Further, in the evaluation of the collecting property by the Example 2 of the image forming apparatus, there was obtained a result that the application of AC can make the collection rate higher.

Furthermore, a voltage comprising an AC bias superimposed upon a DC bias is applied between the regulating blade 60*c* and the developing sleeve 60*b* and therefore, the magnetic compaction amount was suppressed by vibration. Thereby, the lowering of the hair line uniformity and the increase in the fog amount due to the tailing during an increase in the number of printed sheets under a high-temperature and high-humidity environment can be remarkably suppressed. Still further, the toner is vibrated by the vibration of the AC bias and it becomes easy for the toner to pass the regulating portion and therefore, there was obtained the effect that the uniformity of the solid black density difference is improved.

In Example 1 of the image forming apparatus according to the present invention, the suppression of the fog amount, the suppression of the fog amount during the exhaustion of the toner, the suppression of the ghost, the suppression of the image edge fault, the suppression of the halftone image defect 1 and the suppression of the ripple-shaped image fault can be effected well-balancedly.

Further, the reduction in the density for the second and subsequent circumferential lengths of the solid black developing sleeve occurring due to the developing sleeve being urged against the photosensitive drum, the spherical toner being used and the blade bias being applied is remarkably suppressed.

Also, the magnetic compaction amount of the toner is suppressed during an increase in the number of printed sheets under a high-temperature and high-humidity environment. Further, even if the magnetic compaction is produced, only the toner properly subjected to charge imparting is made to easily pass the regulating portion. Thereby, earring is suppressed, whereby the hair line uniformity can be maintained.

Furthermore, the increase in the fog amount due to the contact developing type when the magnetic compaction occurs is remarkably suppressed. In addition, the contrary problems of the reduction in the density for the second and subsequent circumferential lengths of the solid black developing sleeve and the lowering of the hair line uniformity and the increase in the fog amount due to the magnetic compaction can be solved and be made compatible.

Still further, the developing apparatus according to the present embodiment is also effective in an image forming apparatus using a toner recycle system, and is effective for the cleaner-less collecting property, the halftone image defect 2, the halftone image defect due to paper dust, the solid black image defect, and the like. Particularly, in the cleaner-less system, if the fog amount due to the magnetic compaction is increased, charging becomes entirely impossible because of the stains of the charging roller, thus resulting in an entirely black image, and the transfer material twines around the fixing apparatus to thereby cause a trouble to the apparatus, but in the present embodiment, this can be remarkably suppressed.

Also, it has been confirmed that the effect of the present embodiment is effective in the range of $|V|max \leqq |Vd|$.

That is provision is made of voltage applying means for applying a developing bias V comprising an alternating bias superimposed upon a DC bias to the developer carrying member, and the relation between the maximum value $|V|max$ of the absolute value of the developing bias V and a predetermined voltage value Vd (dark potential) charging the surface of the member to be developed by the charging means satisfies $$|V|max \leqq |Vd|,$$

and the developing bias V is applied to the developer carrying member and the member to be developed is developed with the developer.

As a specific example, DC(−450V)+AC(Vpp200V) is applied to the developing sleeve, and Vd=−700V and therefore, $|V|max=|(-450-200/2)|=550V<|-700V|=|Vd|$ is satisfied.

<<Effects and Add-Up of the Present Invention>>

The present invention is effective in the following points.

Effect 1: The suppression of the fog amount, the suppression of the fog amount during the exhaustion of the developer, the suppression of the ghost, the suppression of the image edge fault, the suppression of the ripple-shaped image fault can be effected well-balanced. Further, the present invention has particularly excellent effects in the following points.

The reduction in the solid black density for the second and subsequent revolutions of the developer carrying member occurring due to the developer carrying member being urged against the member to be developed, a spherical toner, i.e., a mono-component magnetic toner having a mean degree of circularity of 0.965 or greater, being used as the developer, and a voltage (blade bias) being applied to the developer amount regulating means is remarkably suppressed.

Also, the magnetic compaction amount of the toner is suppressed during the increase in the number of printed sheets under a high-temperature and high-humidity environment. Further, even if magnetic compaction is produced, it is made easy for only the toner properly subjected to charge imparting to pass the regulating portion.

Thereby, even if magnetic compaction occurs, earring can be suppressed to thereby maintain the hair line uniformity.

Further, an increase in the fog amount occurring because of the contact developing type during an increase in the magnetically compacted toner is remarkably suppressed.

In addition, the suppression of an image fault resulting from an increase in the magnetically compacted toner (the fog during an increase in the number of printed sheets under a high-temperature and high-humidity environment) and the suppression of a reduction in the solid black density for the second and subsequent revolutions of the developer carrying member can be made compatible.

Effect 2: Particularly in the case of a toner having a mean degree of circularity of 0.970 or greater, there can be obtained a stable image free of any image defect, and a further improvement and stability of the effect 1 can be achieved.

Effect 3: By adopting $|Br|/|B| \geqq 0.7$, it is possible to improve the effect 1 and the effect 2, and particularly, it is possible to remarkably suppress the solid black density difference.

Effect 4: By adopting $Nsb/(Bs \times R) \leqq 0.35$, it is possible to improve the effect 1 to the effect 3, and particularly, it is possible to remarkably suppress the solid black density difference and the lowering of the hair line uniformity.

Effect 5: The voltage applied between the developer amount regulating member and the developer carrying member is a DC voltage, and the potential of the developer amount regulating member is more adjacent to the charging polarity side of the toner than the potential of the developer carrying member, whereby the effect 1 to the effect 4 can be improved, and particularly, it is possible to remarkably suppress magnetic compaction from occurring during an increase in the number of printed sheets under a high-temperature and high-humidity environment to thereby cause an increase in the fog amount and the lowering of the hair line uniformity.

Effect 6: The voltage applied between the developer amount regulating member and the developer carrying member is a voltage comprising a DC voltage and an AC voltage superimposed one upon the other, and the DC component of the potential of the developer amount regulating member is more adjacent to the charging polarity side of the developer than the DC component of the potential of the developer carrying member, whereby the effect 1 to the effect 5 can be improved, and particularly, magnetic compaction can be remarkably suppressed from occurring during the increase in the number of printed sheets under the high-temperature and high-humidity environment to thereby cause an increase in the fog amount and the lowering of the hair line uniformity. Further, the magnetic compaction amount can be suppressed and furthermore, the aggravation of the solid black density difference can be suppressed.

Effect 7: A DC voltage is applied to the developer carrying member, whereby the effect 1 to the effect 6 can be improved, and particularly the lowering of the hair line uniformity and the image edge fault can be suppressed.

Effect 8: $|V|max \leqq |Vd|$ is satisfied, whereby the effect 1 to the effect 6 can be improved, and without the hair line uniformity for an alternating bias as the developing bias and the image edge fault being aggravated, the uniformity of the halftone can be improved, and the fog amount can be reduced.

Effect 9: The developing apparatus can collect the untransferred developer residual on the image bearing member, whereby the effect 1 to the effect 8 can be improved, and in an image recording apparatus adopting the toner recycle system, the effect 9 is effective for the cleaner-less collecting property, the halftone image defect 2, the halftone image defect due to paper dust, the solid black image defect, and the like. Particularly, in the toner recycle system, when an increase in the fog amount due to magnetic compaction occurs, charging becomes entirely impossible due to the stains of the charging roller, thus resulting in an entirely black image, and the transfer material twines around the fixing apparatus to thereby cause a trouble to the apparatus, but this can be remarkably suppressed in the present invention.

Effect 10: The voltage applied between the developer amount regulating member and the developer carrying member is a DC voltage, and the potential of the developer amount regulating member is more adjacent to the charging polarity side of the toner than the potential of the developer carrying member, and the developing apparatus on the image bearing member, whereby the effect 1 to the effect 8 can be improved, and in the toner recycle system, when an increase in the fog amount due to magnetic compaction occurs, charging becomes entirely impossible due to the stains of the charging roller, thus resulting in an entirely black image, and the transfer material twines around the fixing apparatus to thereby cause a trouble to the apparatus, but in the present invention, this can be more remarkably suppressed than by the effect 9.

Effect 11: The voltage applied between the developer amount regulating member and the developer carrying member is a voltage comprising a DC voltage and an AC voltage superimposed one upon the other, and the DC component of the potential of the developer amount regulating member is more adjacent to the charging polarity side of the developer than the DC component of the potential of the developer carrying member, and the developing apparatus can collect the untransferred developer residual on the image bearing member, whereby the effect 1 to the effect 9 can be improved, and in the toner recycle system, when an increase in the fog amount due to magnetic compaction charging becomes entirely impossible due to the stains of the charging roller, thus resulting in an entirely black image, and the transfer material twines around the fixing apparatus to thereby cause a trouble to the apparatus, but in the present invention, this can be more remarkably suppressed than by the effect 9. Further, an alternating electric field works between the developer amount regulating member and the developer carrying member and therefore, magnetic compaction is remarkably suppressed and thus, an increase in the fog amount due to the magnetic compaction can be more remarkably suppressed than by the effect 10.

Other Embodiments

1) While in the foregoing embodiments, a laser printer has been shown as the image recording apparatus, this is not restrictive, but of course, use may be made of other image recording apparatuses (image forming apparatuses) such as an electrophotographic copying machine, a facsimile apparatus and a word processor.

2) In the case of an electrostatic recording apparatus, the image bearing member as the member to be charged is an electrostatic recording dielectric member.

3) The developing apparatus of the present invention is not restricted to a developing apparatus for an image bearing member (such as an electrophotographic photosensitive member or an electrostatic recording dielectric member) in an image recording apparatus, but can of course be widely and effectively used as developing processing means (including collection) for a member to be developed.

This application claims priority from Japanese Patent Application No. 2005-021757 filed on Jan. 28, 2005, which is hereby incorporated by reference herein.

What is claimed is:

1. A developing apparatus comprising:

a rotatable developer carrying member carrying a developer thereon to develop an electrostatic image formed on an image bearing member with the developer;

non-rotatable magnetic field generating means provided inside said developer carrying member for magnetically attracting the developer toward said developer carrying member; and a developer amount regulating member contacting with said developer carrying member to regulate an amount of the developer carried on said developer carrying member, wherein said developer carrying member is provided with an elastic layer on a surface thereof, and is urged against said image bearing member, wherein the developer is a mono-component magnetic toner having a mean degree of circularity of 0.965 or greater, and wherein a voltage is applied between said developer carrying member and said developer amount regulating member through the developer, and wherein the following expressions and are satisfied:

$$|Br|/|B| \geqq 0.5$$

$$Nsb/(Bs \times R) \leqq 0.5, \text{ and}$$

where

B (G) is a magnetic flux density formed on the surface of said developer carrying member by said magnetic field generating means at a contact position between said developer amount regulating member and said developer carrying member, Nsb (mm) is a contact width between said developer amount regulating member and said developer carrying member, Br (G) is a perpendicular component of the magnetic flux density (G) in a direction perpendicular to the surface of said developer carrying member, Bs (rad) is a half-value width of the perpendicular component of the magnetic flux density formed on the surface of said developer carrying member by a nearest magnetic pole of magnetic poles of said magnetic field generating means at the contact position, and R (mm) is a radius of said developer carrying member.

2. A developing apparatus according to claim 1, wherein the mean degree of circularity of said mono-component magnetic toner is 0.970 or greater.

3. A developing apparatus according to claim 1, wherein the following expression is satisfied:

$$|Br|/|B| \geqq 0.7.$$

4. A developing apparatus according to claim 1, wherein the following expression is satisfied:

$$Nsb/(Bs \times R) \leqq 0.35.$$

5. A developing apparatus according to claim 1, wherein the voltage is a DC voltage, and a potential of said developer amount regulating member is more adjacent to a charging polarity of the developer than a potential of said developer carrying member.

6. A developing apparatus according to claim 1, wherein the voltage is a superimposed voltage of a DC voltage and an AC voltage, and a DC component of a potential of said developer amount regulating member is more adjacent to a charging polarity of the developer than a DC component of a potential of said developer carrying member.

7. A developing apparatus according to claim 1, wherein a DC voltage without an AC voltage is applied to said developer carrying member during development.

8. A developing apparatus according to claim 1, wherein a superimposed voltage of a DC voltage and an AC voltage is applied to said developer carrying member during development, and a relation between a maximum value |V|max (V) of an absolute value of the superimposed voltage and an absolute value |Vd| (V) of a dark section potential of said image bearing member satisfies:

$$|V|\max \leqq |Vd|.$$

9. A developing apparatus according to claim 1, wherein said developing apparatus is provided in a cartridge detachably mountable to a main body of an image forming apparatus.

10. A developing apparatus according to claim 1, wherein said developing apparatus and said image bearing member are provided in a cartridge detachably mountable to a main body of an image forming apparatus.

11. A developing apparatus according to any one of claims 1 to 10, wherein said developing apparatus collects an untransferred developer residual on said image bearing member.

12. A developing apparatus according to claim 11, wherein said developing apparatus performs a developing operation and at the same time, performs a collecting operation of collecting the untransferred developer residual on said image bearing member.

* * * * *